US010109282B2

(12) United States Patent
Del Galdo et al.

(10) Patent No.: US 10,109,282 B2
(45) Date of Patent: Oct. 23, 2018

(54) APPARATUS AND METHOD FOR GEOMETRY-BASED SPATIAL AUDIO CODING

(71) Applicants: Fraunhofer-Gesellschaft zur Foerderung der angewandten Forschung e.V., Munich (DE); Friedrich-Alexander-Universitaet Erlangen-Nuernberg, Buckenhof (DE)

(72) Inventors: Giovanni Del Galdo, Martinroda (DE); Oliver Thiergart, Forchheim (DE); Juergen Herre, Erlangen (DE); Fabian Kuech, Erlangen (DE); Emanuel Habets, Spardorf (DE); Alexandra Craciun, Erlangen (DE); Achim Kuntz, Hemhofen (DE)

(73) Assignees: Friedrich-Alexander-Universitaet Erlangen-Nuernberg, Buckenhof (DE); Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 532 days.

(21) Appl. No.: 13/907,510

(22) Filed: May 31, 2013

(65) Prior Publication Data

US 2013/0268280 A1 Oct. 10, 2013

Related U.S. Application Data

(63) Continuation of application No. PCT/EP2011/071644, filed on Dec. 2, 2011.

(Continued)

(51) Int. Cl.

*G10L 19/00* (2013.01)
*G10L 19/02* (2013.01)

(Continued)

(52) U.S. Cl.

CPC ..... *G10L 19/00* (2013.01); *G10L 19/02* (2013.01); *G10L 19/167* (2013.01); *G10L 19/20* (2013.01);

(Continued)

(58) Field of Classification Search

CPC ..... G10L 21/00; G10L 19/0018; G10L 19/16; G10L 25/78; G10L 13/033; G10L 19/008;

(Continued)

(56) References Cited

U.S. PATENT DOCUMENTS 6,072,878 A 6/2000 Moorer
6,600,824 B1 7/2003 Matsuo (Continued)

FOREIGN PATENT DOCUMENTS

CN 1452851 A 10/2003
CN 1714600 A 12/2005

(Continued)

OTHER PUBLICATIONS

Schultz-Amling et al., "Virtual acoustic zoom based on parametric spatial audio representations", U.S. Appl. No. 61/287,596, Dec. 17, 2009, 11 pages.

(Continued)

*Primary Examiner* — Abdelali Serrou

(74) *Attorney, Agent, or Firm* — Perkins Coie LLP; Michael A. Glenn

(57) ABSTRACT

An apparatus for generating at least one audio output signal based on an audio data stream having audio data relating to one or more sound sources is provided. The apparatus has a receiver for receiving the audio data stream having the audio data. The audio data has one or more pressure values for each one of the sound sources. Furthermore, the audio data has one or more position values indicating a position of one of the sound sources for each one of the sound sources. Moreover, the apparatus has a synthesis module for generating the at least one audio output signal based on at least one of the one or more pressure values of the audio data of the audio data stream and based on at least one of the one or more position values of the audio data of the audio data stream.

17 Claims, 34 Drawing Sheets

Related U.S. Application Data

(60) Provisional application No. 61/419,623, filed on Dec. 3, 2010, provisional application No. 61/420,099, filed on Dec. 6, 2010.

(51) Int. Cl.

| | |
|---|---|
| ***G10L 19/16*** | (2013.01) |
| ***G10L 19/20*** | (2013.01) |
| ***H04R 3/00*** | (2006.01) |
| ***H04R 1/32*** | (2006.01) |
| *G10L 19/008* | (2013.01) |

(52) U.S. Cl.
CPC ..... *H04R 1/326* (2013.01); *H04R 3/005* (2013.01); *G10L 19/008* (2013.01); *H04R 2430/21* (2013.01)

(58) Field of Classification Search
CPC . G10L 2021/02165; G10L 2021/02166; G10L 21/0232; G10L 19/00; G10L 19/005; G10L 19/20; G10L 15/07; H04R 2225/43; H04R 1/406; H04R 3/04; H04R 3/02; H04R 5/027; H04R 1/326; H04R 2205/024; G06F 3/16; A61B 5/04845
See application file for complete search history.

(56) References Cited

U.S. PATENT DOCUMENTS

| | | | | |
|---|---|---|---|---|
| 6,618,485 | B1 | 9/2003 | Matsuo | |
| 6,904,152 | B1 | 6/2005 | Moorer | |
| 7,606,373 | B2 | 10/2009 | Moorer | |
| 8,229,754 | B1 * | 7/2012 | Ramirez | G11B 27/034 345/440 |
| 8,405,323 | B2 | 3/2013 | Finney et al. | |
| 9,299,353 | B2 * | 3/2016 | Sole | G10L 19/008 |
| 2001/0038580 | A1 * | 11/2001 | Jung | G10H 1/0091 369/30.23 |
| 2001/0055397 | A1 * | 12/2001 | Norris | G10H 1/0091 381/79 |
| 2002/0001389 | A1 | 1/2002 | Amiri et al. | |
| 2004/0138873 | A1 | 7/2004 | Heo et al. | |
| 2004/0157661 | A1 | 8/2004 | Ueda et al. | |
| 2004/0186734 | A1 | 9/2004 | Heo et al. | |
| 2005/0141728 | A1 | 6/2005 | Moorer | |
| 2005/0281410 | A1 | 12/2005 | Grosvenor et al. | |
| 2006/0002566 | A1 | 1/2006 | Choi et al. | |
| 2006/0010445 | A1 | 1/2006 | Peterson et al. | |
| 2006/0050897 | A1 * | 3/2006 | Asada | H04R 3/12 381/98 |
| 2006/0171547 | A1 | 8/2006 | Lokki et al. | |
| 2006/0269070 | A1 * | 11/2006 | Miura | H04R 5/04 381/17 |
| 2007/0032894 | A1 | 2/2007 | Uenishi et al. | |
| 2007/0203598 | A1 | 8/2007 | Seo et al. | |
| 2007/0297616 | A1 | 12/2007 | Plogsties et al. | |
| 2008/0004729 | A1 * | 1/2008 | Hiipakka | H04R 5/04 700/94 |
| 2008/0298597 | A1 * | 12/2008 | Turku | H04S 5/00 381/27 |
| 2008/0298610 | A1 * | 12/2008 | Virolainen | H04S 7/302 381/307 |
| 2009/0043591 | A1 | 2/2009 | Breebaart et al. | |
| 2009/0051624 | A1 | 2/2009 | Finney et al. | |
| 2009/0122994 | A1 * | 5/2009 | Ohta | H04S 1/002 381/17 |
| 2009/0129609 | A1 | 5/2009 | Oh et al. | |
| 2009/0147961 | A1 | 6/2009 | Lee et al. | |
| 2009/0252356 | A1 | 10/2009 | Goodwin et al. | |
| 2009/0264114 | A1 * | 10/2009 | Virolainen | H04M 3/56 455/416 |
| 2010/0061558 | A1 * | 3/2010 | Faller | G10L 19/008 381/23 |
| 2010/0114582 | A1 * | 5/2010 | Beack | H04S 7/30 704/500 |
| 2010/0169103 | A1 | 7/2010 | Pulkki et al. | |
| 2010/0198601 | A1 * | 8/2010 | Mouhssine | G10L 19/008 704/500 |
| 2010/0208904 | A1 | 8/2010 | Nakajima et al. | |
| 2011/0015770 | A1 * | 1/2011 | Seo | G10L 19/008 700/94 |
| 2011/0216908 | A1 * | 9/2011 | Galdo | G10L 19/008 381/17 |
| 2011/0222694 | A1 * | 9/2011 | Del Galdo | H04S 3/02 381/17 |
| 2011/0249821 | A1 * | 10/2011 | Jaillet | G10L 19/008 381/22 |
| 2011/0313763 | A1 | 12/2011 | Amada | |
| 2012/0014535 | A1 | 1/2012 | Oouchi et al. | |
| 2012/0020481 | A1 * | 1/2012 | Usami | H04S 7/30 381/17 |
| 2012/0140947 | A1 | 6/2012 | Shin | |
| 2013/0016842 | A1 | 1/2013 | Schultz-Amling et al. | |

FOREIGN PATENT DOCUMENTS

| | | | |
|---|---|---|---|
| CN | 101473645 | A | 7/2009 |
| CN | 101485233 | A | 7/2009 |
| EP | 2154910 | A1 | 2/2010 |
| GB | 2414369 | A | 11/2005 |
| JP | H01109996 | A | 4/1989 |
| JP | H04181898 | A | 6/1992 |
| JP | H1063470 | A | 3/1998 |
| JP | 2001045590 | A | 2/2001 |
| JP | 2002051399 | A | 2/2002 |
| JP | 2004193877 | A | 7/2004 |
| JP | 2004242728 | A | 9/2004 |
| JP | 2006503491 | A | 1/2006 |
| JP | 2008028700 | A | 2/2008 |
| JP | 2008197577 | A | 8/2008 |
| JP | 2008245984 | A | 10/2008 |
| JP | 2009089315 | A | 4/2009 |
| JP | 2009216473 | A | 9/2009 |
| JP | 2009246827 | A | 10/2009 |
| JP | 2009537876 | A | 10/2009 |
| JP | 2010147692 | A | 7/2010 |
| JP | 2010525646 | A | 7/2010 |
| JP | 2010193451 | A | 9/2010 |
| JP | 2010232717 | A | 10/2010 |
| RU | 2315371 | C2 | 1/2008 |
| RU | 2383939 | C2 | 3/2010 |
| RU | 2396608 | C2 | 8/2010 |
| TW | 200701823 | | 1/2007 |
| WO | WO-2004077884 | A1 | 9/2004 |
| WO | 2005/098826 | A1 | 10/2005 |
| WO | WO-2006006935 | A1 | 1/2006 |
| WO | 2006/072270 | A1 | 7/2006 |
| WO | 2006/105105 | A2 | 10/2006 |
| WO | WO-2007025033 | A2 | 3/2007 |
| WO | WO-2008128989 | A1 | 10/2008 |
| WO | 2009046223 | A2 | 4/2009 |
| WO | 2009/089353 | A1 | 7/2009 |
| WO | 2010017978 | A1 | 2/2010 |
| WO | WO-2010028784 | A1 | 3/2010 |
| WO | 2010122455 | A1 | 10/2010 |
| WO | 2010/128136 | A1 | 11/2010 |

OTHER PUBLICATIONS

Chien, Jen-Tzung et al., "Car Speech Enhancement Using Microphone Array Beamforming and Post Filters", Proceedings of the 9th Australian International Conference on Speech Science & Technology; Melbourne, Dec. 2-5, 2002, pp. 568-572.

Del Galdo, G. et al., "Generating Virtual Microphone Signals Using Geometrical Information Gathered by Distributed Arrays", IEEE, 2011 Joint Workshop on Hands-free Speech Communications and Microphone Arrays., May 30-Jun. 1, 2011, pp. 185-190.

(56) References Cited

OTHER PUBLICATIONS

Del Galdo et al., "Optimized Parameter Estimation in Directional Audio Coding Using Nested Mircophone Arrays", AES Convention Paper 7911; Presented at the 127th Convention; New York, NY, USA, Oct. 9-12, 2009, 9 pages.
Engdegard, J. et al., "Spatial Audio Object Coding (SAOC)—The Upcoming MPEG Standard on Parametric Object Based Audio Coding", Audio Engineering Society Convention Paper, Presented at the 124th Convention, Amsterdam, The Netherlands, May 17-20, 2008, 15 pages.
Fahy, F.J., "Sound energy and sound intensity", Chapter 4, Essex: Elsevier Science Publishers Ltd., 1989, pp. 38-88.
Faller, C. , "Microphone Front-Ends for Spatial Audio Coders", Audio Engineering Society Convention Paper 7508; Presented at the 125th Convention, San Francisco, CA, USA, Oct. 2-5, 2008, 10 pages.
Faller, C., "Obtaining a Highly Directive Center Channel from Coincident Stereo Microphone Signals", AES Convention Paper 7380; Presented at the 124th Convention; Amsterdam, The Netherlands, May 17-20, 2008, 7 pages.
Furness, R. , "Ambisonics—An Overview", Minim Electronics Limited, Burnham, Slough,U.K.; AES 8th International Conference; Apr. 1990, pp. 181-190.
Gallo, Emmanuel et al., "Extracting and Re-Rendering Structured Auditory Scenes from Field Recordings", AES 30th Int'l Conference; Saariselkä, Finland, Mar. 15-17, 2007, 11 pages.
Gerzon, M., "Ambisonics in Multichannel Broadcasting and Video", Journal Audio Engineering Society, vol. 33, No. 11, Nov. 1985, pp. 859-871.
Herre, J. et al., "Interactive Teleconferencing Combining Spatial Audio Object Coding and DirAC Technology", AES Convention Paper 8098; Presented at the 128th Convention; London, UK, May 22-25, 2010, 12 pages.
Herre, J. et al., "MPEG Surround—The ISO/MPEG Standard for Efficient and Compatible Multi-Channel Audio Coding", Audio Engineering Society Convention Paper, Presented at the 122nd Convention, Vienna, Austria, May 5-8, 2007, 23 pages.
Kallinger, M. et al. "A Spatial Filtering Approach for Directional Audio Coding", AES Convention Paper 7653; Presented at the 126th Convention; Munich, Germany, May 7-10, 2009, 10 pages.
Kallinger, M. et al., "Enhanced Direction Estimation using Microphone Arrays for Directional Audio Coding", in Hands-Free Speech Communication and Microphone Arrays (HSCMA), May 2008, pp. 45-48.
Kuntz, A. et al., "Limitations in the Extrapolation of Wave Fields from Circular Measurements", 15th European Signal Processing Conference (EUSIPCO 2007), Poznan, Poland, Sep. 3-7, 2007, pp. 2331-2335.
Marro, C. et al., "Analysis of Noise Reduction and Dereverberation Techniques Based on Microphone Arrays With Postfiltering", IEEE Transactions on Speech and Audio Processing, vol. 6, No. 3, May 1998, pp. 240-259.
Pulkki, V., "Directional audio coding in spatial sound reproduction and stereo upmixing", AES 28th International Conference, Piteå, Sweden, Jun. 30-Jul. 2, 2006, pp. 1-8.
Pulkki, V., "Spatial Sound Reproduction with Directional Audio Coding", J. Audio Eng. Soc., Helsinki Univ. of Technology, Finland; 55(6), Jun. 2007, pp. 503-516.
Rickard, S. et al., "On the Approximate W-Disjoint Orthogonality of Speech", In the International Conference on Acoustics, Speech and Signal Processing, Apr. 2002, vol. 1, pp. I-529-I-532.
Roy, R. et al. , "Direction-of-Arrival Estimation by Subspace Rotation Methods—*ESPRIT*", In IEEE International Conference on Acoustics, Speech, and Signal Processing (ICASSP), Stanford, CA, USA, Apr. 1986, pp. 2495-2498.
Roy, R. et al., "ESPRIT—Estimation of Signal Parameters Via Rotational Invariance Techniques", IEEE Transactions on Acoustics, Speech, and Signal Processing, vol. 37, No. 7, Jul. 1989, pp. 984-995.
Schmidt, R. , "Multiple Emitter Location and Signal Parameter Estimation", IEEE Transactions on Antennas and Propagation, vol. 34, No. 3, Mar. 1986, pp. 276-280.
Schultz-Amling, R. et al., "Acoustical Zooming Based on a Parametric Sound Field Representation", AES Convention Paper 8120; Presented at the 128th Convention; London, UK, May 22-25, 2010, 9 pages.
Schultz-Amling, R. et al., "Planar Microphone Array Processing for the Analysis and Reproduction of Spatial Audio using Directional Audio Coding", Audio Engineering Society, Convention Paper 7375, Presented at the 124th Convention, Amsterdam, The Netherlands, May 17-20, 2008, 10 pages.
Simmer, K. U. et al., "Time Delay Compensation for Adaptive Multichannel Speech Enhancement Systems", Proceedings of ISSSE-92, Paris, Sep. 1-4, 1992, 4 pages.
Steele, Michael J. , "Optimal Triangulation of Random Samples in the Plane", The Annals of Probability, vol. 10, No. 3, Aug. 1982, pp. 548-553.
Vilkamo, J. et al., "Directional Audio Coding: Virtual Microphone-Based Synthesis and Subjective Evaluation", J. Audio Eng. Soc., vol. 57, No. 9., Sep. 2009, pp. 709-724.
Walther, A. et al., "Linear Simulation of Spaced Microphone Arrays Using B-Format Recordings", Audio Engineering Society, Convention Paper 7987, Presented at the 128th Convention, May 22-25, 2010, London, UK, 7 pages.
Williams, E.G., "Fourier Acoustics: Sound Radiation and Nearfield Acoustical Holography; Chapter 3, The Inverse Problem: Planar Nearfield Acoustical Holography", Academic Press, Jun. 1999, pp. 89-114.
Karbasi, Amin et al., "A New DOA Estimation Method Using a Circular Microphone Array", School of Comp. and commun. Sciences, Ecole Polytechnique Federale de Lausanne CH-1015 Lausanne, Switzerland, 2007, 778-782.

* cited by examiner diffuse sound and noise

APPARATUS AND METHOD FOR GEOMETRY-BASED SPATIAL AUDIO CODING

CROSS-REFERENCE TO RELATED APPLICATIONS

This application is a continuation of copending International Application No. PCT/EP2011/071644, filed Dec. 2, 2011, which is incorporated herein by reference in its entirety, and additionally claims priority from U.S. Application No. 61/419,623, filed Dec. 3, 2010, and from U.S. Application No. 61/420,099, filed Dec. 6, 2010, all of which are incorporated herein by reference in their entirety.

BACKGROUND OF THE INVENTION

The present invention relates to audio processing and, in particular, to an apparatus and method for geometry-based spatial audio coding.

Audio processing and, in particular, spatial audio coding, becomes more and more important. Traditional spatial sound recording aims at capturing a sound field such that at the reproduction side, a listener perceives the sound image as it was at the recording location. Different approaches to spatial sound recording and reproduction techniques are known from the state of the art, which may be based on channel-, object- or parametric representations.

Channel-based representations represent the sound scene by means of N discrete audio signals meant to be played back by N loudspeakers arranged in a known setup, e.g. a 5.1 surround sound setup. The approach for spatial sound recording usually employs spaced, omnidirectional microphones, for example, in AB stereophony, or coincident directional microphones, for example, in intensity stereophony. Alternatively, more sophisticated microphones, such as a B-format microphone, may be employed, for example, in Ambisonics, see:

[1] Michael A. Gerzon. Ambisonics in multichannel broadcasting and video. J. Audio Eng. Soc, 33(11):859-871, 1985.

The desired loudspeaker signals for the known setup are derived directly from the recorded microphone signals and are then transmitted or stored discretely. A more efficient representation is obtained by applying audio coding to the discrete signals, which in some cases codes the information of different channels jointly for increased efficiency, for example in MPEG-Surround for 5.1, see:

[21] J. Herre, K. Kjörling, J. Breebaart, C. Faller, S. Disch, H. Purnhagen, J. Koppens, J. Hilpert, J. Rödén, W. Oomen, K. Linzmeier, K. S. Chong: "MPEG Surround—The ISO/MPEG Standard for Efficient and Compatible Multichannel Audio Coding", 122nd AES Convention, Vienna, Austria, 2007, Preprint 7084.

A major drawback of these techniques is, that the sound scene, once the loudspeaker signals have been computed, cannot be modified.

Object-based representations are, for example, used in Spatial Audio Object Coding (SAOC), see

[25] Jeroen Breebaart, Jonas Engdegård, Cornelia Falch, Oliver Hellmuth, Johannes Hilpert, Andreas Hoelzer, Jeroens Koppens, Werner Oomen, Barbara Resch, Erik Schuijers, and Leonid Terentiev. Spatial audio object coding (saoc)—the upcoming mpeg standard on parametric object based audio coding. In Audio Engineering Society Convention 124, 5 2008.

Object-based representations represent the sound scene with N discrete audio objects. This representation gives high flexibility at the reproduction side, since the sound scene can be manipulated by changing e.g. the position and loudness of each object. While this representation may be readily available from an e.g. multitrack recording, it is very difficult to be obtained from a complex sound scene recorded with a few microphones (see, for example, [21]). In fact, the talkers (or other sound emitting objects) have to be first localized and then extracted from the mixture, which might cause artifacts.

Parametric representations often employ spatial microphones to determine one or more audio downmix signals together with spatial side information describing the spatial sound. An example is Directional Audio Coding (DirAC), as discussed in

[22] Ville Pulkki. Spatial sound reproduction with directional audio coding. J. Audio Eng. Soc, 55(6):503-516, June 2007.

The term "spatial microphone" refers to any apparatus for the acquisition of spatial sound capable of retrieving direction of arrival of sound (e.g. combination of directional microphones, microphone arrays, etc.).

The term "non-spatial microphone" refers to any apparatus that is not adapted for retrieving direction of arrival of sound, such as a single omnidirectional or directive microphone.

Another example is proposed in:

[23] C. Faller. Microphone front-ends for spatial audio coders. In Proc. of the AES 125$^{th}$ International Convention, San Francisco, October 2008.

In DirAC, the spatial cue information comprises the direction of arrival (DOA) of sound and the diffuseness of the sound field computed in a time-frequency domain. For the sound reproduction, the audio playback signals can be derived based on the parametric description. These techniques offer great flexibility at the reproduction side because an arbitrary loudspeaker setup can be employed, because the representation is particularly flexible and compact, as it comprises a downmix mono audio signal and side information, and because it allows easy modifications on the sound scene, for example, acoustic zooming, directional filtering, scene merging, etc.

However, these techniques are still limited in that the spatial image recorded is always relative to the spatial microphone used. Therefore, the acoustic viewpoint cannot be varied and the listening-position within the sound scene cannot be changed.

A virtual microphone approach is presented in

[20] Giovanni Del Galdo, Oliver Thiergart, Tobias Weller, and E. A. P. Habets. Generating virtual microphone signals using geometrical information gathered by distributed arrays. In Third Joint Workshop on Hands-free Speech Communication and Microphone Arrays (HSCMA '11), Edinburgh, United Kingdom, May 2011.

which allows to compute the output signals of an arbitrary spatial microphone virtually placed at will (i.e., arbitrary position and orientation) in the environment. The flexibility characterizing the virtual microphone (VM) approach allows the sound scene to be virtually captured at will in a postprocessing step, but no sound field representation is made available, which can be used to transmit and/or store and/or modify the sound scene efficiently. Moreover only one source per time-frequency bin is assumed active, and therefore, it cannot correctly describe the sound scene if two or more sources are active in the same time-frequency bin. Furthermore, if the virtual microphone (VM) is applied at the receiver side, all the microphone signals need to be sent over the channel, which makes the representation inefficient, whereas if the VM is applied at the transmitter side, the sound scene cannot be further manipulated and the model loses flexibility and becomes limited to a certain loudspeaker setup. Moreover, it does not considers a manipulation of the sound scene based on parametric information.

In

[24] Emmanuel Gallo and Nicolas Tsingos. Extracting and re-rendering structured auditory scenes from field recordings. In AES 30th International Conference on Intelligent Audio Environments, 2007, the sound source position estimation is based on pairwise time difference of arrival measured by means of distributed microphones. Furthermore, the receiver is dependent on the recording and requires all microphone signals for the synthesis (e.g., the generation of the loudspeaker signals).

The method presented in

[28] Svein Berge. Device and method for converting spatial audio signal. U.S. patent application Ser. No. 10/547,151, uses, similarly to DirAC, direction of arrival as a parameter, thus limiting the representation to a specific point of view of the sound scene. Moreover, it does not propose the possibility to transmit/store the sound scene representation, since the analysis and synthesis need both to be applied at the same side of the communication system.

SUMMARY

According to an embodiment, an apparatus for generating at least one audio output signal based on an audio data stream having audio data relating to one or more sound sources may have: a receiver for receiving the audio data stream having the audio data, wherein the audio data has for each one of the one or more sound sources one or more sound pressure values, wherein the audio data furthermore has for each one of the one or more sound sources one or more position values indicating a position of one of the sound sources, wherein each one of the one or more position values has at least two coordinate values, and wherein the audio data furthermore has one or more diffuseness-of-sound values for each one of the sound sources; and a synthesis module for generating the at least one audio output signal based on at least one of the one or more sound pressure values of the audio data of the audio data stream, based on at least one of the one or more position values of the audio data of the audio data stream and based on at least one of the one or more diffuseness-of-sound values of the audio data of the audio data stream.

According to another embodiment, an apparatus for generating an audio data stream having sound source data relating to one or more sound sources may have: a determiner for determining the sound source data based on at least one audio input signal recorded by at least one microphone and based on audio side information provided by at least two spatial microphones, the audio side information being spatial side information describing spatial sound; and a data stream generator for generating the audio data stream such that the audio data stream has the sound source data; wherein each one of the at least two spatial microphones is an apparatus for the acquisition of spatial sound capable of retrieving direction of arrival of sound, and wherein the sound source data has one or more sound pressure values for each one of the sound sources, wherein the sound source data furthermore has one or more position values indicating a sound source position for each one of the sound sources.

According to another embodiment, an apparatus for generating a virtual microphone data stream may have: an apparatus for generating an audio output signal of a virtual microphone, and an apparatus mentioned above for generating an audio data stream as the virtual microphone data stream, wherein the audio data stream has audio data, wherein the audio data has for each one of the one or more sound sources one or more position values indicating a sound source position, wherein each one of the one or more position values has at least two coordinate values, wherein the apparatus for generating an audio output signal of a virtual microphone has: a sound events position estimator for estimating a sound source position indicating a position of a sound source in the environment, wherein the sound events position estimator is adapted to estimate the sound source position based on a first direction of arrival of sound emitted by a first real spatial microphone being located at a first real microphone position in the environment, and based on a second direction of arrival of sound emitted by a second real spatial microphone being located at a second real microphone position in the environment; and an information computation module for generating the audio output signal based on a recorded audio input signal being recorded by the first real spatial microphone, based on the first real microphone position and based on a virtual position of the virtual microphone, wherein the first real spatial microphone and the second real spatial microphone are apparatuses for the acquisition of spatial sound capable of retrieving direction of arrival of sound, and wherein the apparatus for generating an audio output signal of a virtual microphone is arranged to provide the audio output signal to the apparatus for generating an audio data stream, and wherein the determiner of the apparatus for generating an audio data stream determines the sound source data based on the audio output signal provided by the apparatus for generating an audio output signal of a virtual microphone, the audio output signal being one of the at least one audio input signal of the apparatus mentioned above for generating an audio data stream.

According to another embodiment, a system may have: an apparatus mentioned above for generating at least one audio output signal, and an apparatus mentioned above for generating an audio data stream.

Another embodiment may have an audio data stream having audio data relating to one or more sound sources, wherein the audio data has for each one of the one or more sound sources one or more sound pressure values, wherein the audio data furthermore has for each one of the one or more sound sources one or more position values indicating a sound source position, wherein each one of the one or more position values has at least two coordinate values, and wherein the audio data furthermore has one or more diffuseness-of-sound values for each one of the one or more sound sources.

According to another embodiment, a method for generating at least one audio output signal based on an audio data stream having audio data relating to one or more sound sources may have the steps of: receiving the audio data stream having the audio data, wherein the audio data has for each one of the one or more sound sources one or more sound pressure values, wherein the audio data furthermore has for each one of the one or more sound sources one or more position values indicating a position of one of the sound sources, wherein each one of the one or more position values has at least two coordinate values, and wherein the audio data furthermore has one or more diffuseness-of-sound values for each one of the sound sources; and generating the at least one audio output signal based on at least one of the one or more sound pressure values of the audio data of the audio data stream, based on at least one of the one or more position values of the audio data of the audio data stream and based on at least one of the one or more diffuseness-of-sound values of the audio data of the audio data stream.

According to another embodiment, a method for generating an audio data stream having sound source data relating to one or more sound sources may have the steps of: determining the sound source data based on at least one audio input signal recorded by at least one microphone and based on audio side information provided by at least two spatial microphones, the audio side information being spatial side information describing spatial sound; and generating the audio data stream such that the audio data stream has the sound source data; wherein each one of the at least two spatial microphones is an apparatus for the acquisition of spatial sound capable of retrieving direction of arrival of sound, and wherein the sound source data has one or more sound pressure values for each one of the sound sources, wherein the sound source data furthermore has one or more position values indicating a sound source position for each one of the sound sources.

According to still another embodiment, a method for generating an audio data stream having audio data relating to one or more sound sources may have the steps of: receiving audio data having at least one sound pressure value for each one of the sound sources, wherein the audio data furthermore has one or more position values indicating a sound source position for each one of the sound sources, and wherein the audio data furthermore has one or more diffuseness-of-sound values for each one of the sound sources; generating the audio data stream such that the audio data stream has the at least one sound pressure value for each one of the sound sources, such that the audio data stream furthermore has the one or more position values indicating a sound source position for each one of the sound sources, and such that the audio data stream furthermore has one or more diffuseness-of-sound values for each one of the sound sources.

Another embodiment may have a computer program for implementing the methods mentioned above when being executed on a computer or a processor.

The audio data may be defined for a time-frequency bin of a plurality of time-frequency bins. Alternatively, the audio data may be defined for a time instant of a plurality of time instants. In some embodiments, one or more pressure values of the audio data may be defined for a time instant of a plurality of time instants, while the corresponding parameters (e.g., the position values) may be defined in a time-frequency domain. This can be readily obtained by transforming back to time domain the pressure values otherwise defined in time-frequency. For each one of the sound sources, at least one pressure value is comprised in the audio data, wherein the at least one pressure value may be a pressure value relating to an emitted sound wave, e.g. originating from the sound source. The pressure value may be a value of an audio signal, for example, a pressure value of an audio output signal generated by an apparatus for generating an audio output signal of a virtual microphone, wherein that the virtual microphone is placed at the position of the sound source.

The above-described embodiment allows to compute a sound field representation which is truly independent from the recording position and provides for efficient transmission and storage of a complex sound scene, as well as for easy modifications and an increased flexibility at the reproduction system.

Inter alia, important advantages of this technique are, that at the reproduction side the listener can choose freely its position within the recorded sound scene, use any loudspeaker setup, and additionally manipulate the sound scene based on the geometrical information, e.g. position-based filtering. In other words, with the proposed technique the acoustic viewpoint can be varied and the listening-position within the sound scene can be changed.

According to the above-described embodiment, the audio data comprised in the audio data stream comprises one or more pressure values for each one of the sound sources. Thus, the pressure values indicate an audio signal relative to one of the sound sources, e.g. an audio signal originating from the sound source, and not relative to the position of the recording microphones. Similarly, the one or more position values that are comprised in the audio data stream indicate positions of the sound sources and not of the microphones.

By this, a plurality of advantages are realized: For example, a representation of an audio scene is achieved that can be encoded using few bits. If the sound scene only comprises a single sound source in a particular time frequency bin, only the pressure values of a single audio signal relating to the only sound source have to be encoded together with the position value indicating the position of the sound source. In contrast, traditional methods may have to encode a plurality of pressure values from the plurality of recorded microphone signals to reconstruct an audio scene at a receiver. Moreover, the above-described embodiment allows easy modification of a sound scene on a transmitter, as well as on a receiver side, as will be described below. Thus, scene composition (e.g., deciding the listening position within the sound scene) can also be carried out at the receiver side.

Embodiments employ the concept of modeling a complex sound scene by means of sound sources, for example, point-like sound sources (PLS=point-like sound source), e.g. isotropic point-like sound sources (IPLS), which are active at specific slots in a time-frequency representation, such as the one provided by the Short-Time Fourier Transform (STFT).

According to an embodiment, the receiver may be adapted to receive the audio data stream comprising the audio data, wherein the audio data furthermore comprises one or more diffuseness values for each one of the sound sources. The synthesis module may be adapted to generate the at least one audio output signal based on at least one of the one or more diffuseness values.

In another embodiment, the receiver may furthermore comprise a modification module for modifying the audio data of the received audio data stream by modifying at least one of the one or more pressure values of the audio data, by modifying at least one of the one or more position values of the audio data or by modifying at least one of the diffuseness values of the audio data. The synthesis module may be adapted to generate the at least one audio output signal based on the at least one pressure value that has been modified, based on the at least one position value that has been modified or based on the at least one diffuseness value that has been modified.

In a further embodiment, each one of the position values of each one of the sound sources may comprise at least two coordinate values. Furthermore, the modification module may be adapted to modify the coordinate values by adding at least one random number to the coordinate values, when the coordinate values indicate that a sound source is located at a position within a predefined area of an environment.

According to another embodiment, each one of the position values of each one of the sound sources may comprise at least two coordinate values. Moreover, the modification module is adapted to modify the coordinate values by applying a deterministic function on the coordinate values, when the coordinate values indicate that a sound source is located at a position within a predefined area of an environment.

In a further embodiment, each one of the position values of each one of the sound sources may comprise at least two coordinate values. Moreover, the modification module may be adapted to modify a selected pressure value of the one or more pressure values of the audio data, relating to the same sound source as the coordinate values, when the coordinate values indicate that a sound source is located at a position within a predefined area of an environment.

According to an embodiment, the synthesis module may comprise a first stage synthesis unit and a second stage synthesis unit. The first stage synthesis unit may be adapted to generate a direct pressure signal comprising direct sound, a diffuse pressure signal comprising diffuse sound and direction of arrival information based on at least one of the one or more pressure values of the audio data of the audio data stream, based on at least one of the one or more position values of the audio data of the audio data stream and based on at least one of the one or more diffuseness values of the audio data of the audio data stream. The second stage synthesis unit may be adapted to generate the at least one audio output signal based on the direct pressure signal, the diffuse pressure signal and the direction of arrival information.

According to an embodiment, an apparatus for generating an audio data stream comprising sound source data relating to one or more sound sources is provided. The apparatus for generating an audio data stream comprises a determiner for determining the sound source data based on at least one audio input signal recorded by at least one microphone and based on audio side information provided by at least two spatial microphones. Furthermore, the apparatus comprises a data stream generator for generating the audio data stream such that the audio data stream comprises the sound source data. The sound source data comprises one or more pressure values for each one of the sound sources. Moreover, the sound source data furthermore comprises one or more position values indicating a sound source position for each one of the sound sources. Furthermore, the sound source data is defined for a time-frequency bin of a plurality of time-frequency bins.

In a further embodiment, the determiner may be adapted to determine the sound source data based on diffuseness information by at least one spatial microphone. The data stream generator may be adapted to generate the audio data stream such that the audio data stream comprises the sound source data. The sound source data furthermore comprises one or more diffuseness values for each one of the sound sources.

In another embodiment, the apparatus for generating an audio data stream may furthermore comprise a modification module for modifying the audio data stream generated by the data stream generator by modifying at least one of the pressure values of the audio data, at least one of the position values of the audio data or at least one of the diffuseness values of the audio data relating to at least one of the sound sources.

According to another embodiment, each one of the position values of each one of the sound sources may comprise at least two coordinate values (e.g., two coordinates of a Cartesian coordinate system, or azimuth and distance, in a polar coordinate system). The modification module may be adapted to modify the coordinate values by adding at least one random number to the coordinate values or by applying a deterministic function on the coordinate values, when the coordinate values indicate that a sound source is located at a position within a predefined area of an environment.

According to a further embodiment, an audio data stream is provided. The audio data stream may comprise audio data relating to one or more sound sources, wherein the audio data comprises one or more pressure values for each one of the sound sources. The audio data may furthermore comprise at least one position value indicating a sound source position for each one of the sound sources. In an embodiment, each one of the at least one position values may comprise at least two coordinate values. The audio data may be defined for a time-frequency bin of a plurality of time-frequency bins.

In another embodiment, the audio data furthermore comprises one or more diffuseness values for each one of the sound sources.

BRIEF DESCRIPTION OF THE DRAWINGS

Embodiments of the present invention will be described in the following, in which.

DETAILED DESCRIPTION OF THE INVENTION

Before providing a detailed description of embodiments of the present invention, an apparatus for generating an audio output signal of a virtual microphone is described to provide background information regarding the concepts of the present invention.

Figure 12:
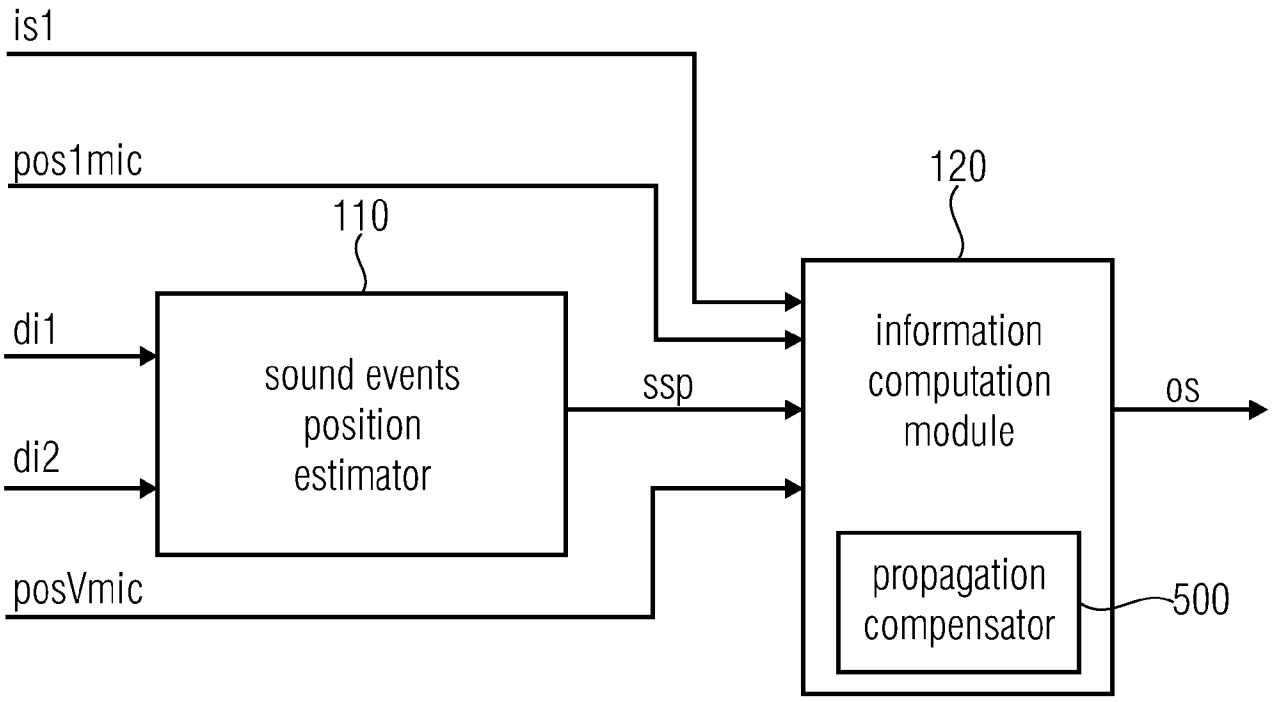
FIG. 12 illustrates an apparatus for generating an audio output signal of a virtual microphone according to an embodiment.

FIG. 12 illustrates an apparatus for generating an audio output signal to simulate a recording of a microphone at a configurable virtual position posVmic in an environment. The apparatus comprises a sound events position estimator 110 and an information computation module 120. The sound events position estimator 110 receives a first direction information di1 from a first real spatial microphone and a second direction information di2 from a second real spatial microphone. The sound events position estimator 110 is adapted to estimate a sound source position ssp indicating a position of a sound source in the environment, the sound source emitting a sound wave, wherein the sound events position estimator 110 is adapted to estimate the sound source position ssp based on a first direction information di1 provided by a first real spatial microphone being located at a first real microphone position pos1mic in the environment, and based on a second direction information di2 provided by a second real spatial microphone being located at a second real microphone position in the environment. The information computation module 120 is adapted to generate the audio output signal based on a first recorded audio input signal is1 being recorded by the first real spatial microphone, based on the first real microphone position pos1mic and based on the virtual position posVmic of the virtual microphone. The information computation module 120 comprises a propagation compensator being adapted to generate a first modified audio signal by modifying the first recorded audio input signal is1 by compensating a first delay or amplitude decay between an arrival of the sound wave emitted by the sound source at the first real spatial microphone and an arrival of the sound wave at the virtual microphone by adjusting an amplitude value, a magnitude value or a phase value of the first recorded audio input signal is1, to obtain the audio output signal.

Figure 13:
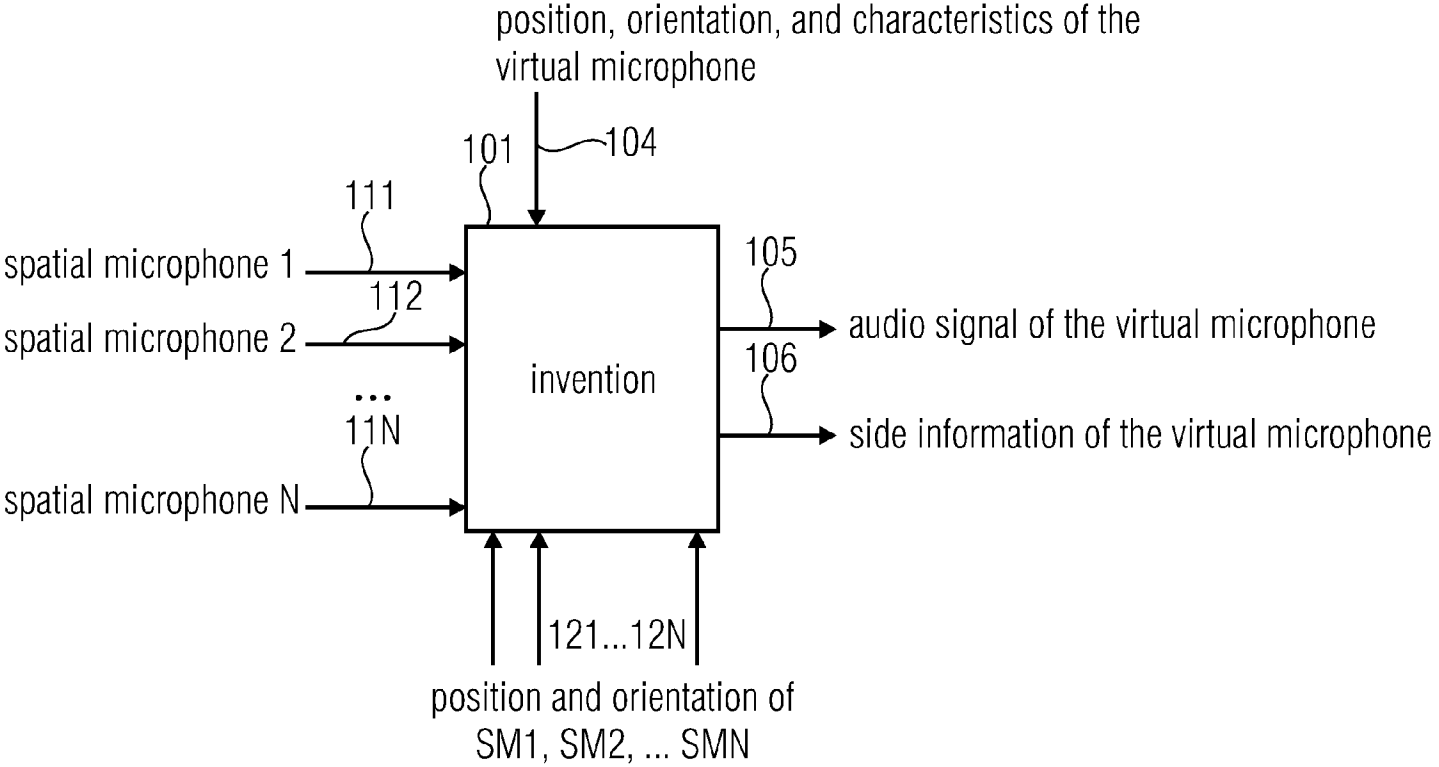
FIG. 13 illustrates the inputs and outputs of an apparatus and a method for generating an audio output signal of a virtual microphone according to an embodiment.

FIG. 13 illustrates the inputs and outputs of an apparatus and a method according to an embodiment. Information from two or more real spatial microphones 111, 112, . . . , 11N is fed to the apparatus/is processed by the method. This information comprises audio signals picked up by the real spatial microphones as well as direction information from the real spatial microphones, e.g. direction of arrival (DOA) estimates. The audio signals and the direction information, such as the direction of arrival estimates may be expressed in a time-frequency domain. If, for example, a 2D geometry reconstruction is desired and a traditional STFT (short time Fourier transformation) domain is chosen for the representation of the signals, the DOA may be expressed as azimuth angles dependent on k and n, namely the frequency and time indices.

In embodiments, the sound event localization in space, as well as describing the position of the virtual microphone may be conducted based on the positions and orientations of the real and virtual spatial microphones in a common coordinate system. This information may be represented by the inputs 121 . . . 12N and input 104 in FIG. 13. The input 104 may additionally specify the characteristic of the virtual spatial microphone, e.g., its position and pick-up pattern, as will be discussed in the following. If the virtual spatial microphone comprises multiple virtual sensors, their positions and the corresponding different pick-up patterns may be considered.

The output of the apparatus or a corresponding method may be, when desired, one or more sound signals 105, which may have been picked up by a spatial microphone defined and placed as specified by 104. Moreover, the apparatus (or rather the method) may provide as output corresponding spatial side information 106 which may be estimated by employing the virtual spatial microphone.

Figure 14:
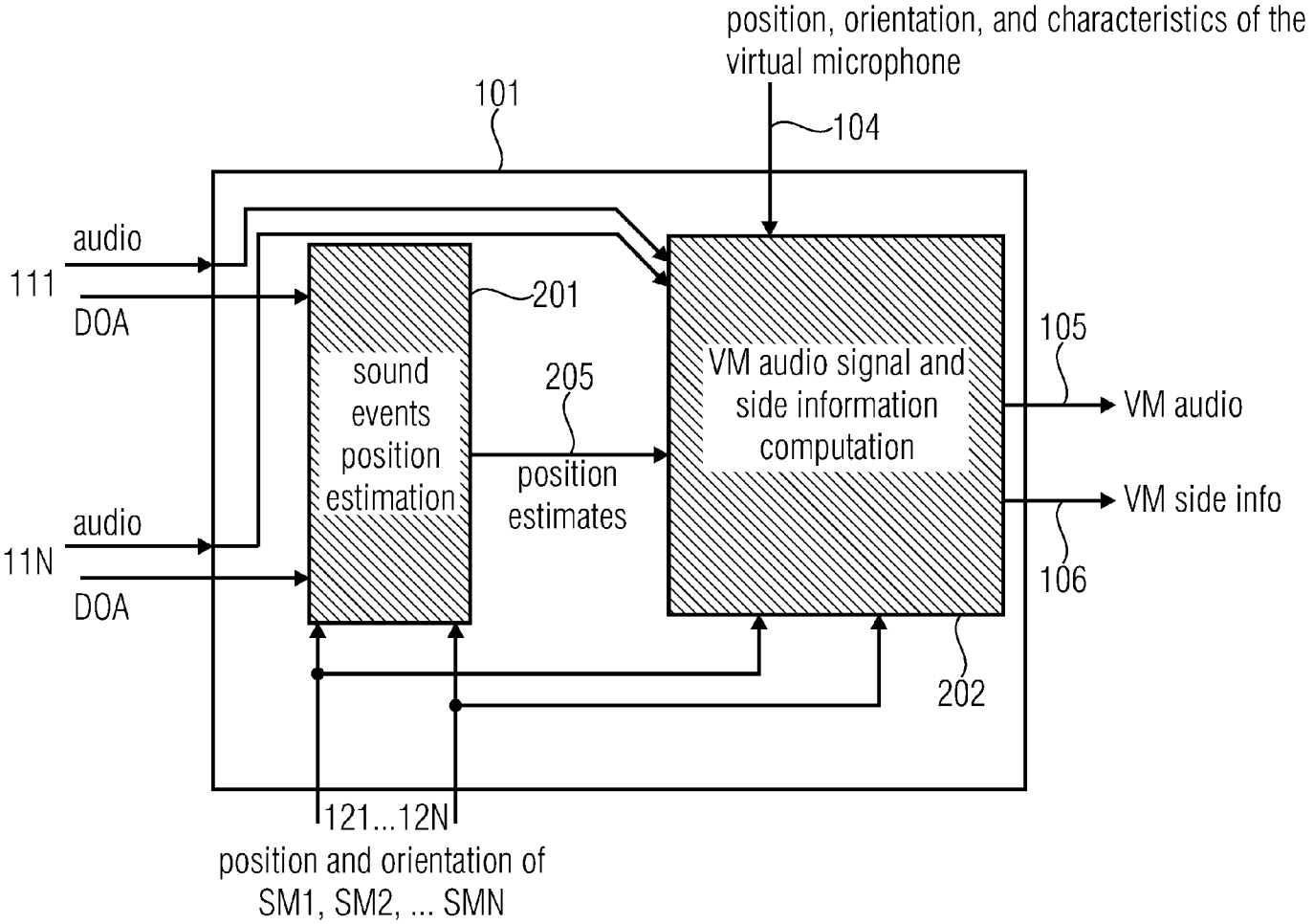
FIG. 14 illustrates the basic structure of an apparatus for generating an audio output signal of a virtual microphone according to an embodiment which comprises a sound events position estimator and an information computation module.

FIG. 14 illustrates an apparatus according to an embodiment, which comprises two main processing units, a sound events position estimator 201 and an information computation module 202. The sound events position estimator 201 may carry out geometrical reconstruction on the basis of the DOAs comprised in inputs 111 . . . 11N and based on the knowledge of the position and orientation of the real spatial microphones, where the DOAs have been computed. The output of the sound events position estimator 205 comprises the position estimates (either in 2D or 3D) of the sound sources where the sound events occur for each time and frequency bin. The second processing block 202 is an information computation module. According to the embodiment of FIG. 14, the second processing block 202 computes a virtual microphone signal and spatial side information. It is therefore also referred to as virtual microphone signal and side information computation block 202. The virtual microphone signal and side information computation block 202 uses the sound events' positions 205 to process the audio signals comprised in 111 . . . 11N to output the virtual microphone audio signal 105. Block 202, if necessitated, may also compute the spatial side information 106 corresponding to the virtual spatial microphone. Embodiments below illustrate possibilities, how blocks 201 and 202 may operate.

In the following, position estimation of a sound events position estimator according to an embodiment is described in more detail.

Depending on the dimensionality of the problem (2D or 3D) and the number of spatial microphones, several solutions for the position estimation are possible.

Figure 15:
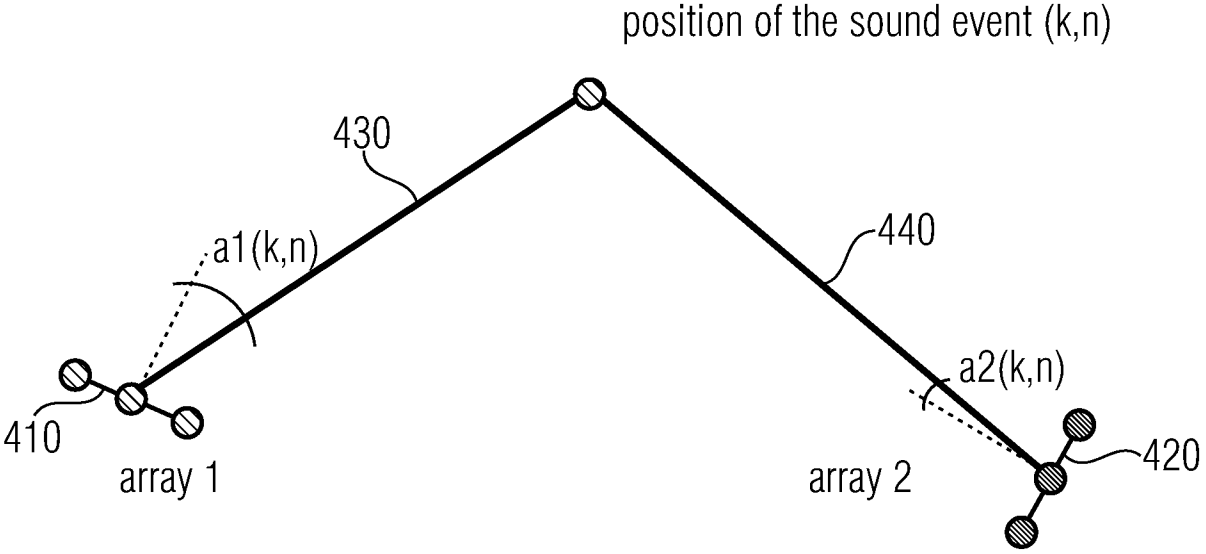
FIG. 15 shows an exemplary scenario in which the real spatial microphones are depicted as Uniform Linear Arrays of 3 microphones each.

If two spatial microphones in 2D exist, (the simplest possible case) a simple triangulation is possible. FIG. 15 shows an exemplary scenario in which the real spatial microphones are depicted as Uniform Linear Arrays (ULAs) of 3 microphones each. The DOA, expressed as the azimuth angles a1(*k, n*) and a2(*k, n*), are computed for the time-frequency bin (k, n). This is achieved by employing a proper DOA estimator, such as ESPRIT,

[13] R. Roy, A. Paulraj, and T. Kailath, "Direction-of-arrival estimation by subspace rotation methods—ESPRIT," in IEEE International Conference on Acoustics, Speech, and Signal Processing (ICASSP), Stanford, Calif., USA, April 1986, or (root) MUSIC, see

[14] R. Schmidt, "Multiple emitter location and signal parameter estimation," IEEE Transactions on Antennas and Propagation, vol. 34, no. 3, pp. 276-280, 1986 to the pressure signals transformed into the time-frequency domain.

In FIG. 15, two real spatial microphones, here, two real spatial microphone arrays 410, 420 are illustrated. The two estimated DOAs a1(*k, n*) and a2(*k, n*) are represented by two lines, a first line 430 representing DOA a1(*k, n*) and a second line 440 representing DOA a2(*k, n*). The triangulation is possible via simple geometrical considerations knowing the position and orientation of each array.

The triangulation fails when the two lines 430, 440 are exactly parallel. In real applications, however, this is very unlikely. However, not all triangulation results correspond to a physical or feasible position for the sound event in the considered space. For example, the estimated position of the sound event might be too far away or even outside the assumed space, indicating that probably the DOAs do not correspond to any sound event which can be physically interpreted with the used model. Such results may be caused by sensor noise or too strong room reverberation. Therefore, according to an embodiment, such undesired results are flagged such that the information computation module 202 can treat them properly.

Figure 16:
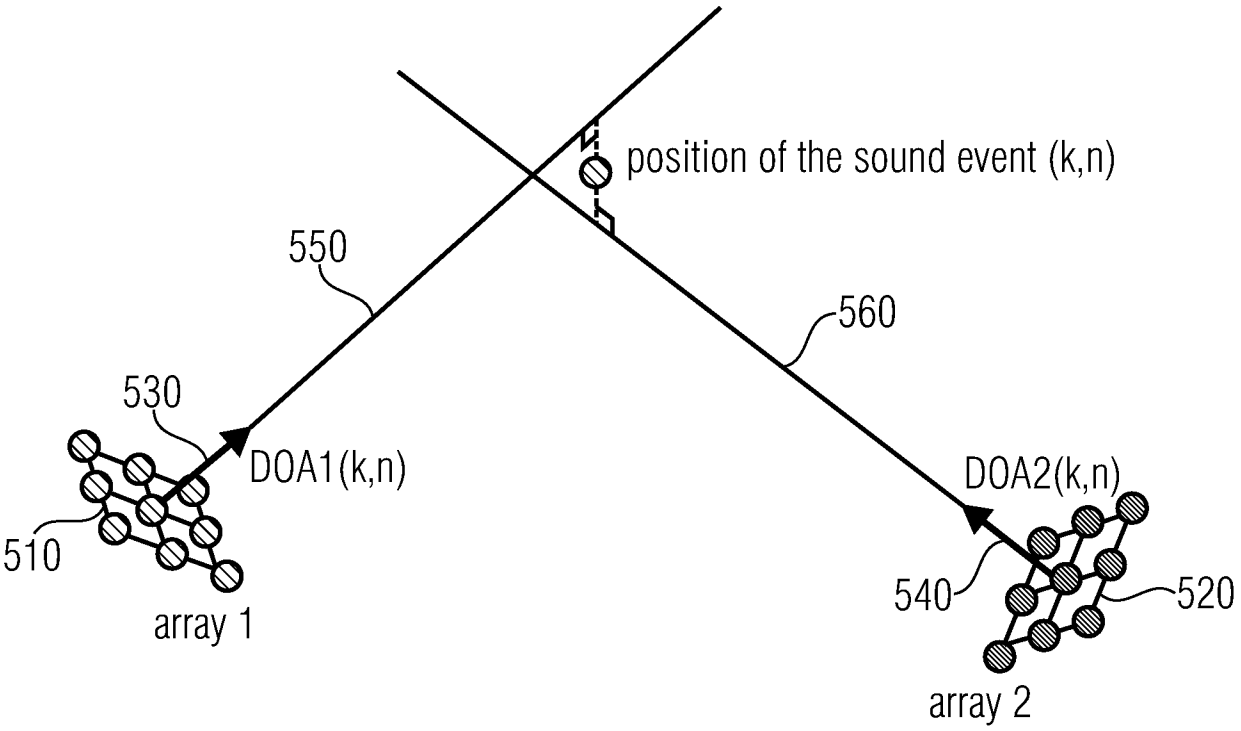
FIG. 16 depicts two spatial microphones in 3D for estimating the direction of arrival in 3D space.

FIG. 16 depicts a scenario, where the position of a sound event is estimated in 3D space. Proper spatial microphones are employed, for example, a planar or 3D microphone array. In FIG. 16, a first spatial microphone 510, for example, a first 3D microphone array, and a second spatial microphone 520, e.g., a first 3D microphone array, is illustrated. The DOA in the 3D space, may for example, be expressed as azimuth and elevation. Unit vectors 530, 540 may be employed to express the DOAs. Two lines 550, 560 are projected according to the DOAs. In 3D, even with very reliable estimates, the two lines 550, 560 projected according to the DOAs might not intersect. However, the triangulation can still be carried out, for example, by choosing the middle point of the smallest segment connecting the two lines.

Similarly to the 2D case, the triangulation may fail or may yield unfeasible results for certain combinations of directions, which may then also be flagged, e.g. to the information computation module 202 of FIG. 14.

If more than two spatial microphones exist, several solutions are possible. For example, the triangulation explained above, could be carried out for all pairs of the real spatial microphones (if N=3, 1 with 2, 1 with 3, and 2 with 3). The resulting positions may then be averaged (along x and y, and, if 3D is considered, z).

Alternatively, more complex concepts may be used. For example, probabilistic approaches may be applied as described in

[15] J. Michael Steele, "Optimal Triangulation of Random Samples in the Plane", The Annals of Probability, Vol. 10, No. 3 (August, 1982), pp. 548-553.

According to an embodiment, the sound field may be analyzed in the time-frequency domain, for example, obtained via a short-time Fourier transform (STFT), in which k and n denote the frequency index k and time index n, respectively. The complex pressure $P_v(k, n)$ at an arbitrary position $p_v$ for a certain k and n is modeled as a single spherical wave emitted by a narrow-band isotropic point-like source, e.g. by employing the formula:

$$P_v(k,n)=P_{IPLS}(k,n)\cdot\gamma(k,p_{IPLS}(k,n),p_v), \quad (1)$$

where $P_{IPLS}(k, n)$ is the signal emitted by the IPLS at its position $p_{IPLS}(k, n)$. The complex factor $\gamma(k, p_{IPLS}, p_v)$ expresses the propagation from $p_{IPLS}(k, n)$ to $p_v$, e.g., it introduces appropriate phase and magnitude modifications. Here, the assumption may be applied that in each time-frequency bin only one IPLS is active. Nevertheless, multiple narrow-band IPLSs located at different positions may also be active at a single time instance.

Each IPLS either models direct sound or a distinct room reflection. Its position $p_{IPLS}(k, n)$ may ideally correspond to an actual sound source located inside the room, or a mirror image sound source located outside, respectively. Therefore, the position $p_{IPLS}(k, n)$ may also indicates the position of a sound event.

Please note that the term "real sound sources" denotes the actual sound sources physically existing in the recording environment, such as talkers or musical instruments. On the contrary, with "sound sources" or "sound events" or "IPLS" we refer to effective sound sources, which are active at certain time instants or at certain time-frequency bins, wherein the sound sources may, for example, represent real sound sources or mirror image sources.

Figure 28A:
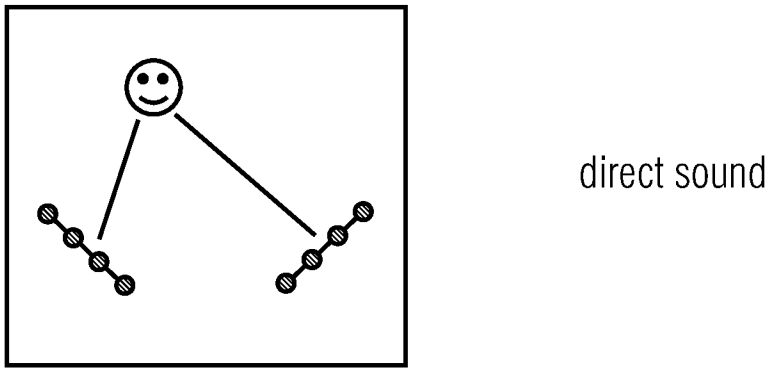
FIG. 28*a*-28*c* illustrate scenarios where two microphone arrays receive direct sound, sound reflected by a wall and diffuse sound.
Figure 28B:
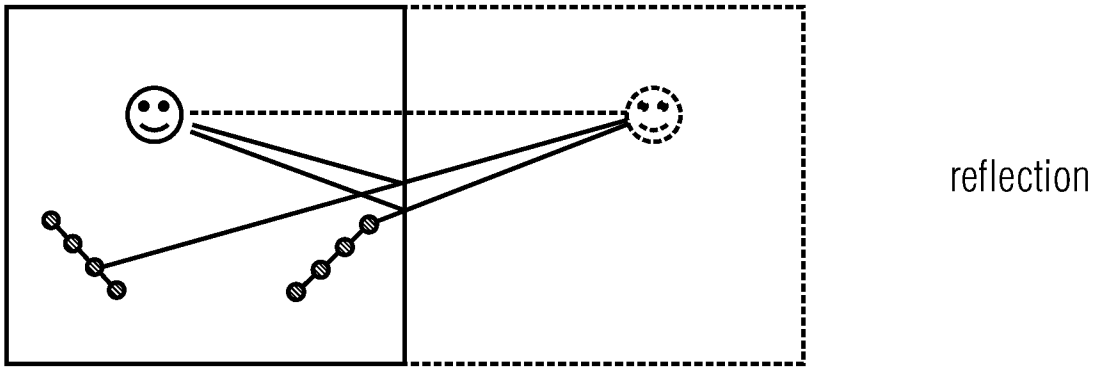

FIG. 28*a*-28*b* illustrate microphone arrays localizing sound sources. The localized sound sources may have different physical interpretations depending on their nature. When the microphone arrays receive direct sound, they may be able to localize the position of a true sound source (e.g. talkers). When the microphone arrays receive reflections, they may localize the position of a mirror image source. Mirror image sources are also sound sources.

FIG. 28*a* illustrates a scenario, where two microphone arrays 151 and 152 receive direct sound from an actual sound source (a physically existing sound source) 153.

FIG. 28*b* illustrates a scenario, where two microphone arrays 161, 162 receive reflected sound, wherein the sound has been reflected by a wall. Because of the reflection, the microphone arrays 161, 162 localize the position, where the sound appears to come from, at a position of an mirror image source 165, which is different from the position of the speaker 163.

Both the actual sound source 153 of FIG. 28*a*, as well as the mirror image source 165 are sound sources.

Figure 28C:
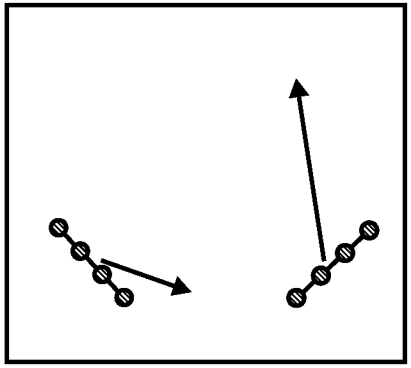

FIG. 28*c* illustrates a scenario, where two microphone arrays 171, 172 receive diffuse sound and are not able to localize a sound source.

While this single-wave model is accurate only for mildly reverberant environments given that the source signals fulfill the W-disjoint orthogonality (WDO) condition, i.e. the time-frequency overlap is sufficiently small. This is normally true for speech signals, see, for example,

[12] S. Rickard and Z. Yilmaz, "On the approximate W-disjoint orthogonality of speech," in Acoustics, Speech and Signal Processing, 2002. ICASSP 2002. IEEE International Conference on, April 2002, vol. 1.

However, the model also provides a good estimate for other environments and is therefore also applicable for those environments.

In the following, the estimation of the positions $p_{IPLS}(k, n)$ according to an embodiment is explained. The position $p_{IPLS}(k, n)$ of an active IPLS in a certain time-frequency bin, and thus the estimation of a sound event in a time-frequency bin, is estimated via triangulation on the basis of the direction of arrival (DOA) of sound measured in at least two different observation points.

Figure 17:
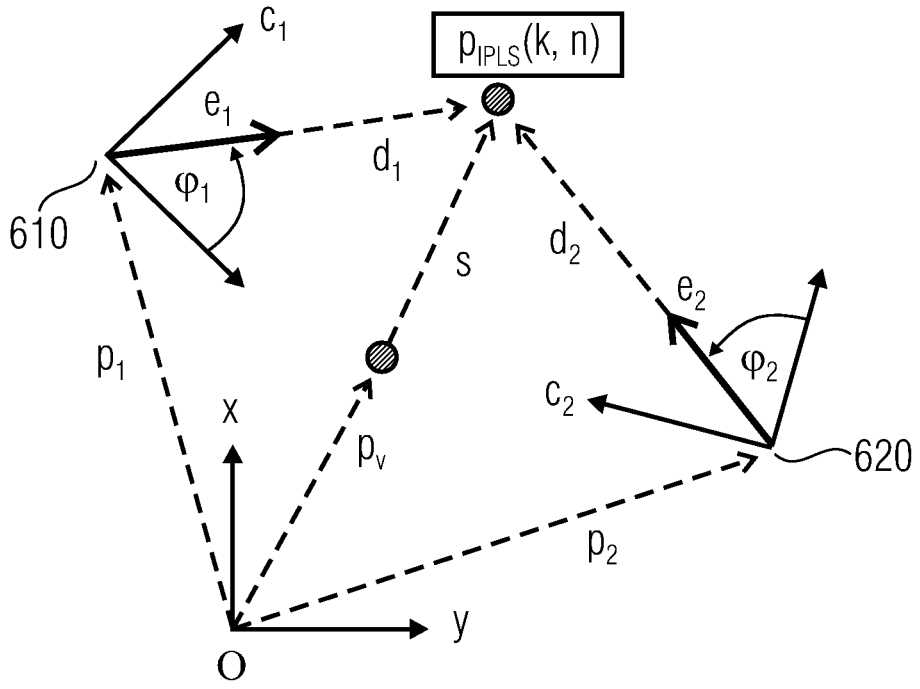
FIG. 17 illustrates a geometry where an isotropic point-like sound source of the current time-frequency bin(k, n) is located at a position $p_{IPLS}(k, n)$.

FIG. 17 illustrates a geometry, where the IPLS of the current time-frequency slot (k, n) is located in the unknown position $p_{IPLS}(k, n)$. In order to determine the necessitated DOA information, two real spatial microphones, here, two microphone arrays, are employed having a known geometry, position and orientation, which are placed in positions 610 and 620, respectively. The vectors $p_1$ and $p_2$ point to the positions 610, 620, respectively. The array orientations are defined by the unit vectors $c_1$ and $c_2$. The DOA of the sound is determined in the positions 610 and 620 for each (k, n) using a DOA estimation algorithm, for instance as provided by the DirAC analysis (see [2], [3]). By this, a first point-of-view unit vector $e_1^{POV}(k, n)$ and a second point-of-view unit vector $e_2^{POV}(k, n)$ with respect to a point of view of the microphone arrays (both not shown in FIG. 17) may be provided as output of the DirAC analysis. For example, when operating in 2D, the first point-of-view unit vector results to:

$$e_1^{POV}(k, n) = \begin{bmatrix} \cos(\varphi_1(k, n)) \\ \sin(\varphi_1(k, n)) \end{bmatrix}, \tag{2}$$

Here, $\varphi_1(k, n)$ represents the azimuth of the DOA estimated at the first microphone array, as depicted in FIG. 17. The corresponding DOA unit vectors $e_1(k, n)$ and $e_2(k, n)$, with respect to the global coordinate system in the origin, may be computed by applying the formulae:

$$e_1(k,n)=R_1 \cdot e_1^{POV}(k,n),$$

$$e_2(k,n)=R_2 \cdot e_2^{POV}(k,n), \tag{3}$$

where R are coordinate transformation matrices, e.g., $$R_1 = \begin{bmatrix} c_{1,x} & -c_{1,y} \\ c_{1,y} & c_{1,x} \end{bmatrix}, \tag{4}$$

when operating in 2D and $c_1=[c_{1,x}, c_{1,y}]^T$. For carrying out the triangulation, the direction vectors $d_1(k, n)$ and $d_2(k, n)$ may be calculated as:

$$d_1(k,n)=d_1(k,n)e_1(k,n),$$

$$d_2(k,n)=d_2(k,n)e_2(k,n), \tag{5}$$

where $d_1(k, n)=\|d_1(k, n)\|$ and $d_2(k, n)=\|d_2(k, n)\|$ are the unknown distances between the IPLS and the two microphone arrays. The following equation $$p_1+d_1(k,n)=p_2+d_2(k,n) \tag{6}$$

may be solved for $d_1(k, n)$. Finally, the position $p_{IPLS}(k, n)$ of the IPLS is given by $$p_{IPLS}(k,n)=d_1(k,n)e_1(k,n)+p_1. \tag{7}$$

In another embodiment, equation (6) may be solved for $d_2(k, n)$ and $p_{IPLS}(k, n)$ is analogously computed employing $d_2(k, n)$.

Equation (6) provides a solution when operating in 2D, unless $e_1(k, n)$ and $e_2(k, n)$ are parallel. However, when using more than two microphone arrays or when operating in 3D, a solution cannot be obtained when the direction vectors d do not intersect. According to an embodiment, in this case, the point which is closest to all direction vectors d is be computed and the result can be used as the position of the IPLS.

In an embodiment, all observation points $p_1$, $p_2$, . . . should be located such that the sound emitted by the IPLS falls into the same temporal block n. This requirement may simply be fulfilled when the distance Δ between any two of the observation points is smaller than $$\Delta_{max} = c\frac{n_{FFT}(1-R)}{f_s}, \tag{8}$$

where $n_{FFT}$ is the STFT window length, $0 \le R < 1$ specifies the overlap between successive time frames and $f_s$ is the sampling frequency. For example, for a 1024-point STFT at 48 kHz with 50% overlap (R=0.5), the maximum spacing between the arrays to fulfill the above requirement is Δ=3.65 m.

In the following, an information computation module 202, e.g. a virtual microphone signal and side information computation module, according to an embodiment is described in more detail.

Figure 18:
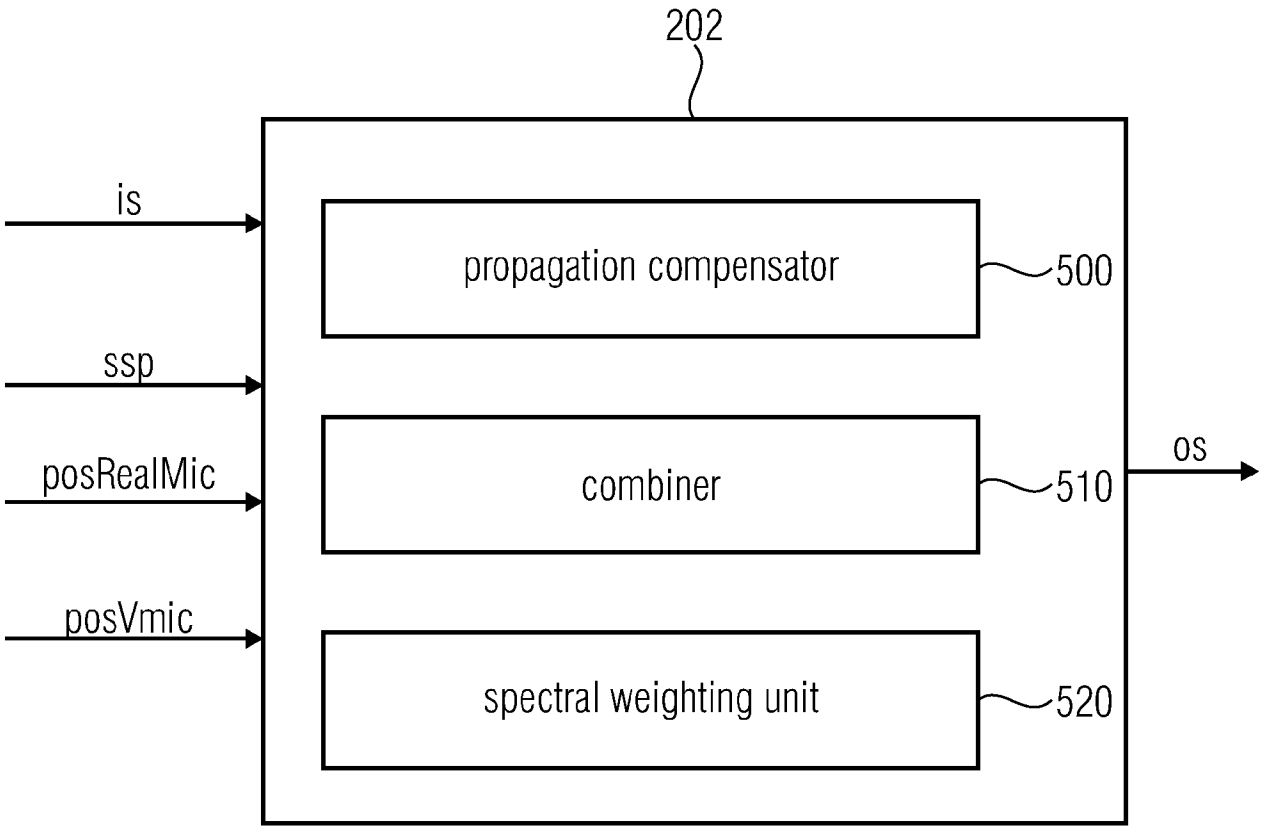
FIG. 18 depicts the information computation module according to an embodiment.

FIG. 18 illustrates a schematic overview of an information computation module 202 according to an embodiment. The information computation unit comprises a propagation compensator 500, a combiner 510 and a spectral weighting unit 520. The information computation module 202 receives the sound source position estimates ssp estimated by a sound events position estimator, one or more audio input signals is recorded by one or more of the real spatial microphones, positions posRealMic of one or more of the real spatial microphones, and the virtual position posVmic of the virtual microphone. It outputs an audio output signal os representing an audio signal of the virtual microphone.

Figure 19:
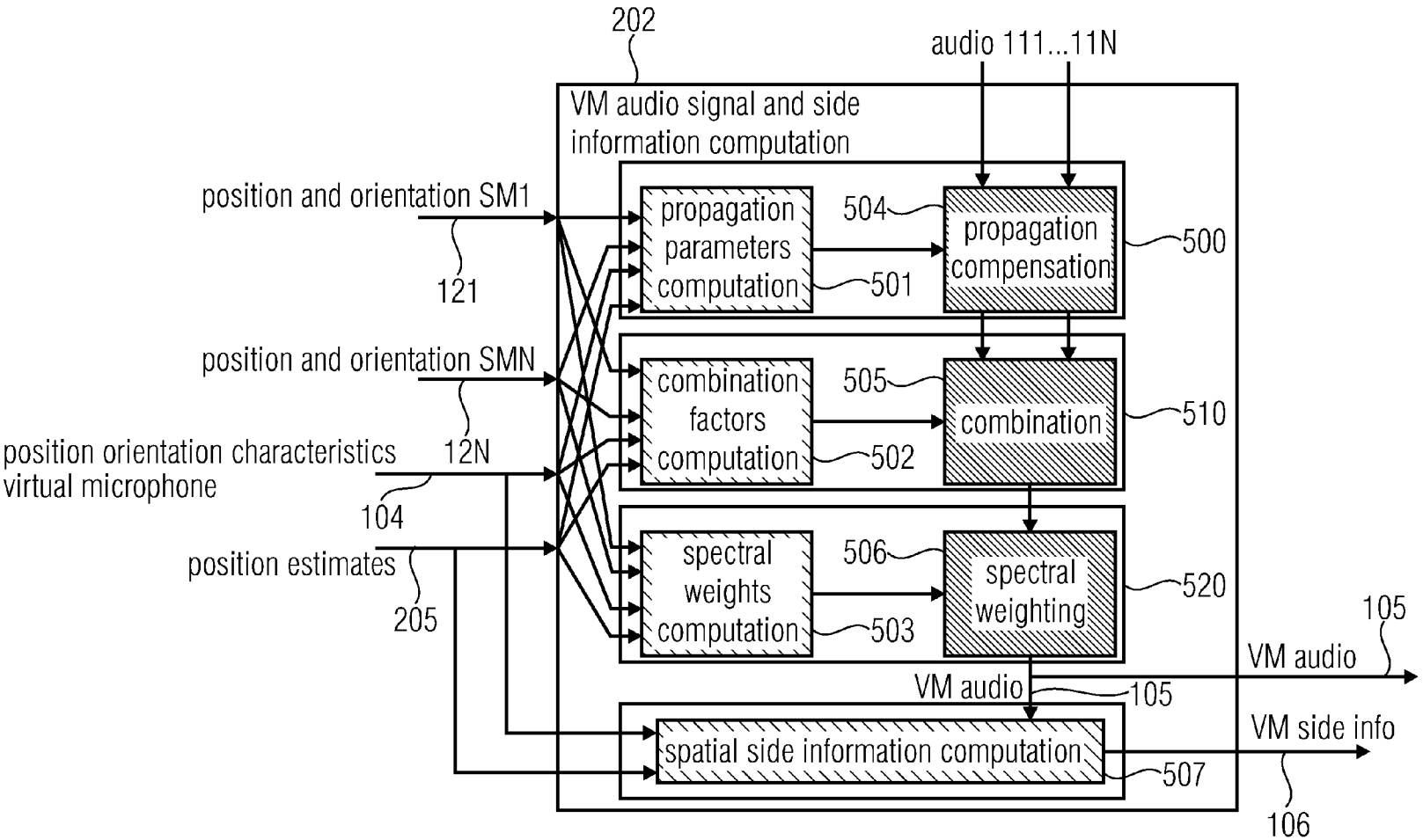
FIG. 19 depicts the information computation module according to another embodiment.

FIG. 19 illustrates an information computation module according to another embodiment. The information computation module of FIG. 19 comprises a propagation compensator 500, a combiner 510 and a spectral weighting unit 520. The propagation compensator 500 comprises a propagation parameters computation module 501 and a propagation compensation module 504. The combiner 510 comprises a combination factors computation module 502 and a combination module 505. The spectral weighting unit 520 comprises a spectral weights computation unit 503, a spectral weighting application module 506 and a spatial side information computation module 507.

To compute the audio signal of the virtual microphone, the geometrical information, e.g. the position and orientation of the real spatial microphones 121 . . . 12N, the position, orientation and characteristics of the virtual spatial microphone 104, and the position estimates of the sound events 205 are fed into the information computation module 202, in particular, into the propagation parameters computation module 501 of the propagation compensator 500, into the combination factors computation module 502 of the combiner 510 and into the spectral weights computation unit 503 of the spectral weighting unit 520. The propagation parameters computation module 501, the combination factors computation module 502 and the spectral weights computation unit 503 compute the parameters used in the modification of the audio signals 111 . . . 11N in the propagation compensation module 504, the combination module 505 and the spectral weighting application module 506.

In the information computation module 202, the audio signals 111 . . . 11N may at first be modified to compensate for the effects given by the different propagation lengths between the sound event positions and the real spatial microphones. The signals may then be combined to improve for instance the signal-to-noise ratio (SNR). Finally, the resulting signal may then be spectrally weighted to take the directional pick up pattern of the virtual microphone into account, as well as any distance dependent gain function. These three steps are discussed in more detail below.

Propagation compensation is now explained in more detail. In the upper portion of FIG. 20, two real spatial microphones (a first microphone array 910 and a second microphone array 920), the position of a localized sound event 930 for time-frequency bin (k, n), and the position of the virtual spatial microphone 940 are illustrated.

Figure 20:
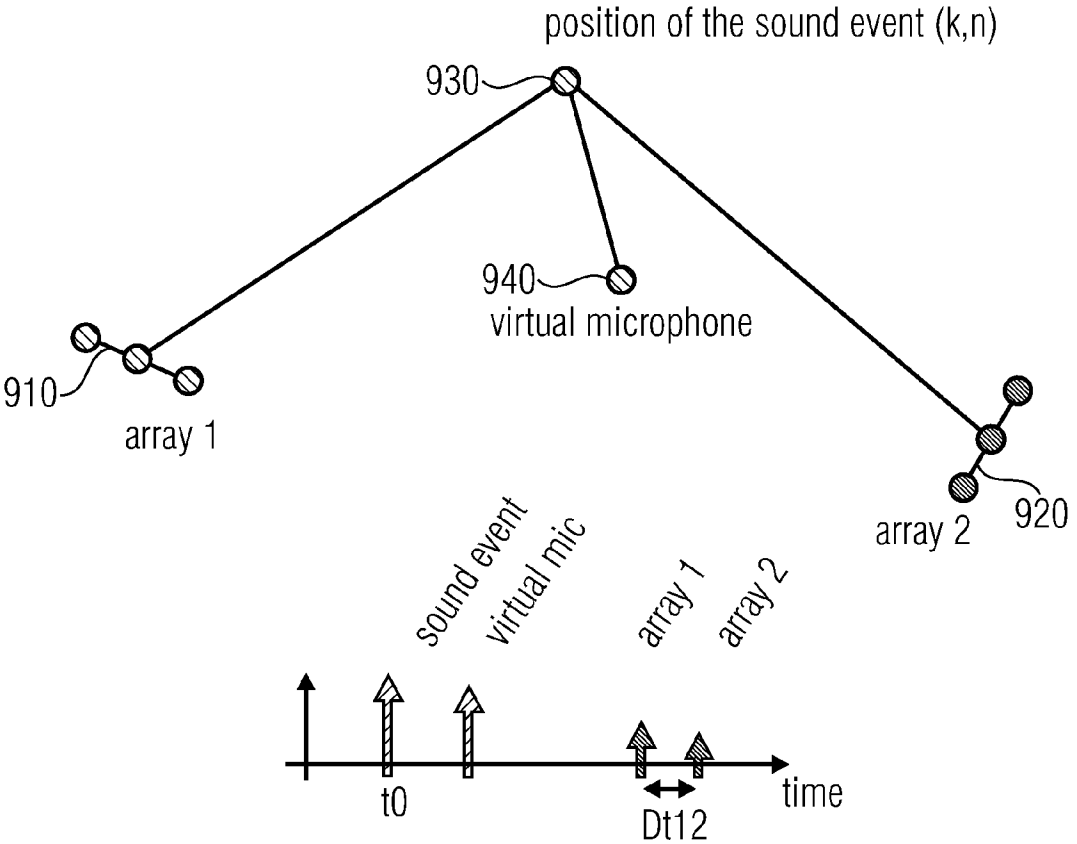
FIG. 20 shows two real spatial microphones, a localized sound event and a position of a virtual spatial microphone.

The lower portion of FIG. 20 depicts a temporal axis. It is assumed that a sound event is emitted at time t0 and then propagates to the real and virtual spatial microphones. The time delays of arrival as well as the amplitudes change with distance, so that the further the propagation length, the weaker the amplitude and the longer the time delay of arrival are.

The signals at the two real arrays are comparable only if the relative delay Dt12 between them is small. Otherwise, one of the two signals needs to be temporally realigned to compensate the relative delay Dt12, and possibly, to be scaled to compensate for the different decays.

Compensating the delay between the arrival at the virtual microphone and the arrival at the real microphone arrays (at one of the real spatial microphones) changes the delay independent from the localization of the sound event, making it superfluous for most applications.

Returning to FIG. 19, propagation parameters computation module 501 is adapted to compute the delays to be corrected for each real spatial microphone and for each sound event. If desired, it also computes the gain factors to be considered to compensate for the different amplitude decays.

The propagation compensation module 504 is configured to use this information to modify the audio signals accordingly. If the signals are to be shifted by a small amount of time (compared to the time window of the filter bank), then a simple phase rotation suffices. If the delays are larger, more complicated implementations are necessitated.

The output of the propagation compensation module 504 are the modified audio signals expressed in the original time-frequency domain.

In the following, a particular estimation of propagation compensation for a virtual microphone according to an embodiment will be described with reference to FIG. 17 which inter alia illustrates the position 610 of a first real spatial microphone and the position 620 of a second real spatial microphone.

In the embodiment that is now explained, it is assumed that at least a first recorded audio input signal, e.g. a pressure signal of at least one of the real spatial microphones (e.g. the microphone arrays) is available, for example, the pressure signal of a first real spatial microphone. We will refer to the considered microphone as reference microphone, to its position as reference position $p_{ref}$ and to its pressure signal as reference pressure signal $P_{ref}(k, n)$. However, propagation compensation may not only be conducted with respect to only one pressure signal, but also with respect to the pressure signals of a plurality or of all of the real spatial microphones.

The relationship between the pressure signal $P_{IPLS}(k, n)$ emitted by the IPLS and a reference pressure signal $P_{ref}(k, n)$ of a reference microphone located in $p_{ref}$ can be expressed by formula (9):

$$P_{ref}(k,n)=P_{IPLS}(k,n)\cdot\gamma(k,p_{IPLS},p_{ref}), \tag{9}$$

In general, the complex factor $\gamma(k, p_a, p_b)$ expresses the phase rotation and amplitude decay introduced by the propagation of a spherical wave from its origin in $p_a$ to $p_b$. However, practical tests indicated that considering only the amplitude decay in $\gamma$ leads to plausible impressions of the virtual microphone signal with significantly fewer artifacts compared to also considering the phase rotation.

The sound energy which can be measured in a certain point in space depends strongly on the distance r from the sound source, in FIG. 6 from the position $p_{IPLS}$ of the sound source. In many situations, this dependency can be modeled with sufficient accuracy using well-known physical principles, for example, the 1/r decay of the sound pressure in the far-field of a point source. When the distance of a reference microphone, for example, the first real microphone from the sound source is known, and when also the distance of the virtual microphone from the sound source is known, then, the sound energy at the position of the virtual microphone can be estimated from the signal and the energy of the reference microphone, e.g. the first real spatial microphone. This means, that the output signal of the virtual microphone can be obtained by applying proper gains to the reference pressure signal.

Assuming that the first real spatial microphone is the reference microphone, then $p_{ref}=p_1$. In FIG. 17, the virtual microphone is located in $p_v$. Since the geometry in FIG. 17 is known in detail, the distance $d_1(k, n)=\|d_1(k, n)\|$ between the reference microphone (in FIG. 17: the first real spatial microphone) and the IPLS can easily be determined, as well as the distance $s(k, n)=\|s(k, n)\|$ between the virtual microphone and the IPLS, namely $$s(k,n)=\|s(k,n)\|=\|p_1+d_1(k,n)-p_v\|. \tag{10}$$

The sound pressure $P_v(k, n)$ at the position of the virtual microphone is computed by combining formulas (1) and (9), leading to $$P_v(k, n) = \frac{\gamma(k, p_{IPLS}, p_v)}{\gamma(k, p_{IPLS}, p_{ref})} P_{ref}(k, n). \tag{11}$$

As mentioned above, in some embodiments, the factors γ may only consider the amplitude decay due to the propagation. Assuming for instance that the sound pressure decreases with 1/r, then $$P_v(k,n) = \frac{d_1(k,n)}{s(k,n)} P_{ref}(k,n). \tag{12}$$

When the model in formula (1) holds, e.g., when only direct sound is present, then formula (12) can accurately reconstruct the magnitude information. However, in case of pure diffuse sound fields, e.g., when the model assumptions are not met, the presented method yields an implicit dereverberation of the signal when moving the virtual microphone away from the positions of the sensor arrays. In fact, as discussed above, in diffuse sound fields, we expect that most IPLS are localized near the two sensor arrays. Thus, when moving the virtual microphone away from these positions, we likely increase the distance s=||s|| in FIG. 17. Therefore, the magnitude of the reference pressure is decreased when applying a weighting according to formula (11). Correspondingly, when moving the virtual microphone close to an actual sound source, the time-frequency bins corresponding to the direct sound will be amplified such that the overall audio signal will be perceived less diffuse. By adjusting the rule in formula (12), one can control the direct sound amplification and diffuse sound suppression at will.

By conducting propagation compensation on the recorded audio input signal (e.g. the pressure signal) of the first real spatial microphone, a first modified audio signal is obtained.

In embodiments, a second modified audio signal may be obtained by conducting propagation compensation on a recorded second audio input signal (second pressure signal) of the second real spatial microphone.

In other embodiments, further audio signals may be obtained by conducting propagation compensation on recorded further audio input signals (further pressure signals) of further real spatial microphones.

Now, combining in blocks 502 and 505 in FIG. 19 according to an embodiment is explained in more detail. It is assumed that two or more audio signals from a plurality different real spatial microphones have been modified to compensate for the different propagation paths to obtain two or more modified audio signals. Once the audio signals from the different real spatial microphones have been modified to compensate for the different propagation paths, they can be combined to improve the audio quality. By doing so, for example, the SNR can be increased or the reverberance can be reduced.

Possible solutions for the combination comprise:

- Weighted averaging, e.g., considering SNR, or the distance to the virtual microphone, or the diffuseness which was estimated by the real spatial microphones. Traditional solutions, for example, Maximum Ratio Combining (MRC) or Equal Gain Combining (EQC) may be employed, or
- Linear combination of some or all of the modified audio signals to obtain a combination signal. The modified audio signals may be weighted in the linear combination to obtain the combination signal, or
- Selection, e.g., only one signal is used, for example, dependent on SNR or distance or diffuseness.

The task of module 502 is, if applicable, to compute parameters for the combining, which is carried out in module 505.

Now, spectral weighting according to embodiments is described in more detail. For this, reference is made to blocks 503 and 506 of FIG. 19. At this final step, the audio signal resulting from the combination or from the propagation compensation of the input audio signals is weighted in the time-frequency domain according to spatial characteristics of the virtual spatial microphone as specified by input 104 and/or according to the reconstructed geometry (given in 205).

Figure 21:
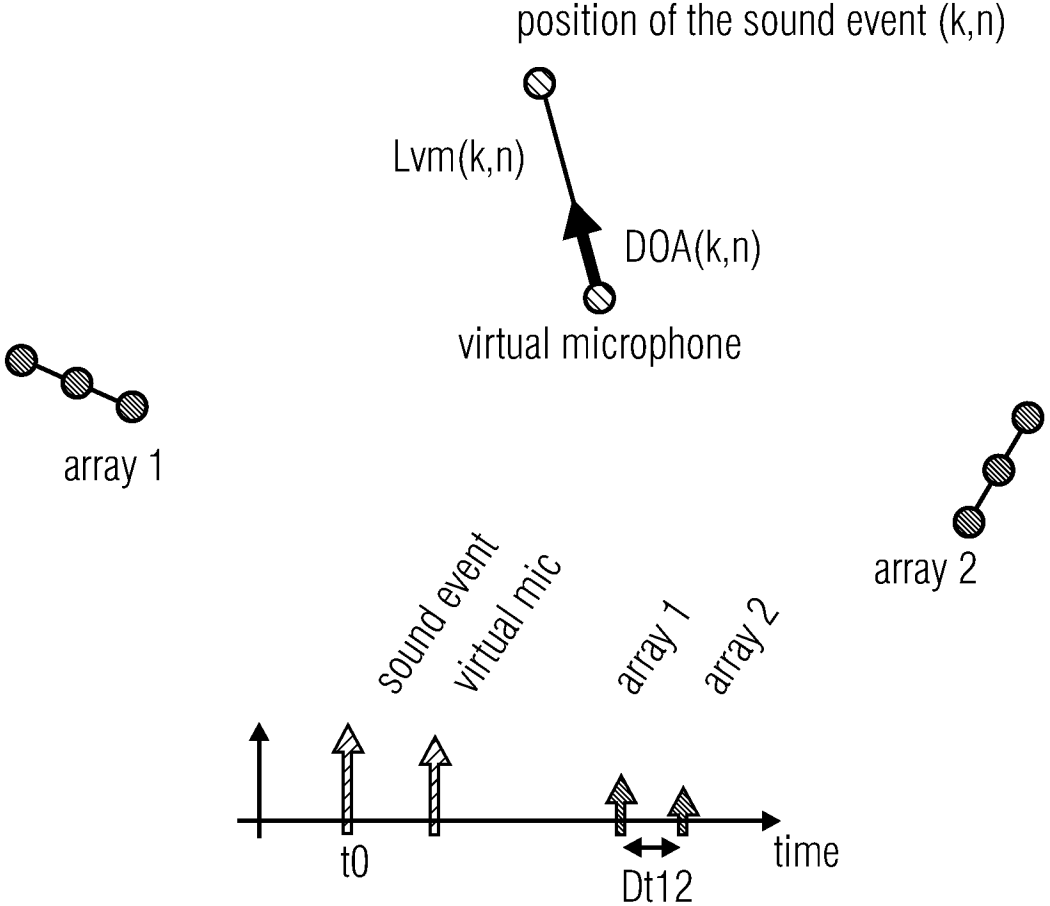
FIG. 21 illustrates, how to obtain the direction of arrival relative to a virtual microphone according to an embodiment.

For each time-frequency bin the geometrical reconstruction allows us to easily obtain the DOA relative to the virtual microphone, as shown in FIG. 21. Furthermore, the distance between the virtual microphone and the position of the sound event can also be readily computed.

The weight for the time-frequency bin is then computed considering the type of virtual microphone desired.

In case of directional microphones, the spectral weights may be computed according to a predefined pick-up pattern. For example, according to an embodiment, a cardioid microphone may have a pick up pattern defined by the function g(theta), $$g(\text{theta})=0.5+0.5\cos(\text{theta}),$$

where theta is the angle between the look direction of the virtual spatial microphone and the DOA of the sound from the point of view of the virtual microphone.

Another possibility is artistic (non physical) decay functions. In certain applications, it may be desired to suppress sound events far away from the virtual microphone with a factor greater than the one characterizing free-field propagation. For this purpose, some embodiments introduce an additional weighting function which depends on the distance between the virtual microphone and the sound event. In an embodiment, only sound events within a certain distance (e.g. in meters) from the virtual microphone should be picked up.

With respect to virtual microphone directivity, arbitrary directivity patterns can be applied for the virtual microphone. In doing so, one can for instance separate a source from a complex sound scene.

Since the DOA of the sound can be computed in the position $p_v$ of the virtual microphone, namely $$\varphi_v(k,n) = \arccos\left(\frac{s \cdot c_v}{\|s\|}\right), \tag{13}$$

where $c_v$ is a unit vector describing the orientation of the virtual microphone, arbitrary directivities for the virtual microphone can be realized. For example, assuming that $P_v(k,n)$ indicates the combination signal or the propagation-compensated modified audio signal, then the formula:

$$\tilde{P}_v(k,n)=P_v(k,n)[1+\cos(\varphi_v(k,n))] \tag{14}$$

calculates the output of a virtual microphone with cardioid directivity. The directional patterns, which can potentially be generated in this way, depend on the accuracy of the position estimation.

Figure 8:
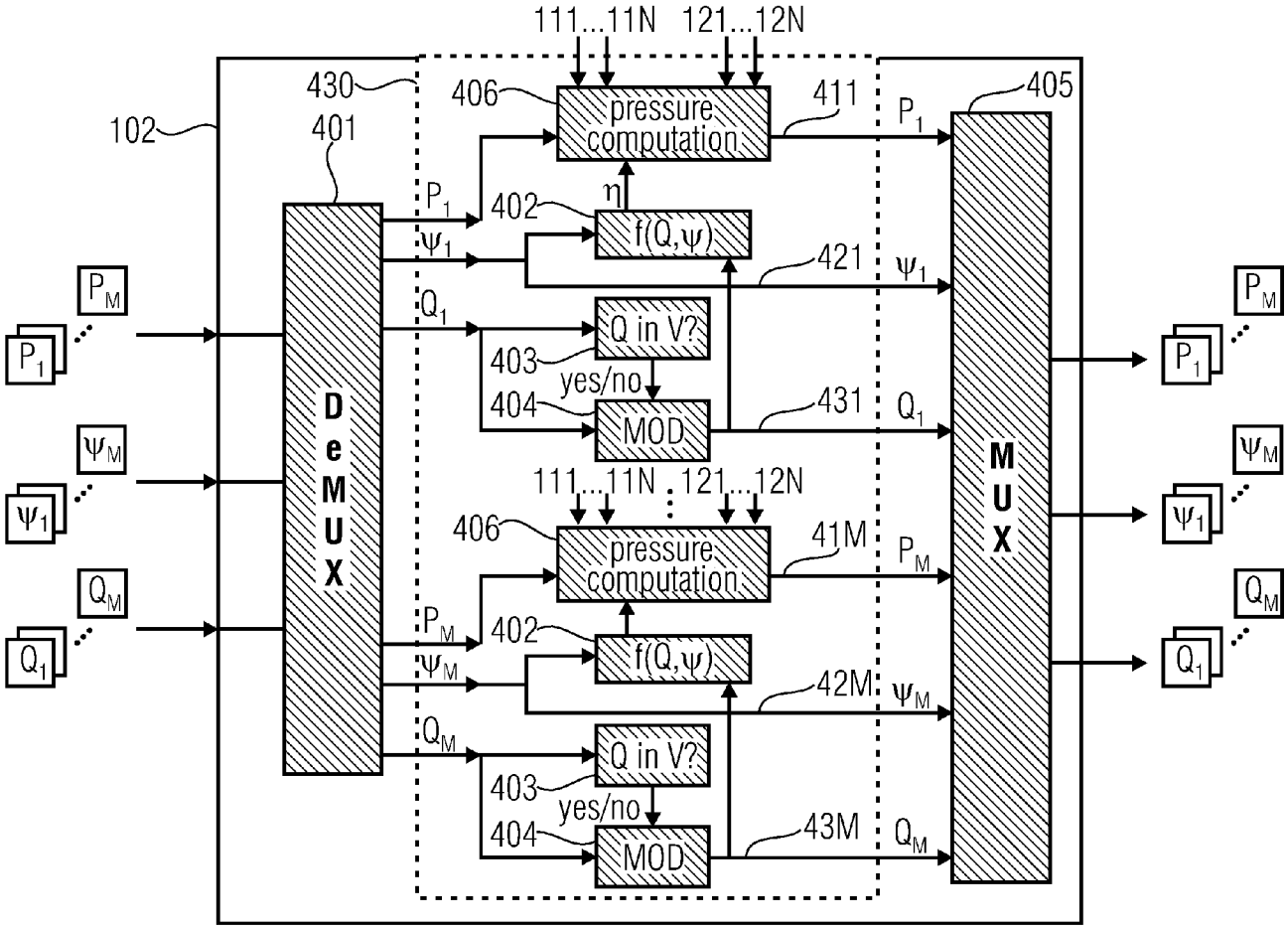
FIG. 8 depicts a modification module according to another embodiment.

In embodiments, one or more real, non-spatial microphones, for example, an omnidirectional microphone or a directional microphone such as a cardioid, are placed in the sound scene in addition to the real spatial microphones to further improve the sound quality of the virtual microphone signals 105 in FIG. 8. These microphones are not used to gather any geometrical information, but rather only to provide a cleaner audio signal. These microphones may be placed closer to the sound sources than the spatial microphones. In this case, according to an embodiment, the audio signals of the real, non-spatial microphones and their positions are simply fed to the propagation compensation module 504 of FIG. 19 for processing, instead of the audio signals of the real spatial microphones. Propagation compensation is then conducted for the one or more recorded audio signals of the non-spatial microphones with respect to the position of the one or more non-spatial microphones. By this, an embodiment is realized using additional non-spatial microphones.

In a further embodiment, computation of the spatial side information of the virtual microphone is realized. To compute the spatial side information 106 of the microphone, the information computation module 202 of FIG. 19 comprises a spatial side information computation module 507, which is adapted to receive as input the sound sources' positions 205 and the position, orientation and characteristics 104 of the virtual microphone. In certain embodiments, according to the side information 106 that needs to be computed, the audio signal of the virtual microphone 105 can also be taken into account as input to the spatial side information computation module 507.

The output of the spatial side information computation module 507 is the side information of the virtual microphone 106. This side information can be, for instance, the DOA or the diffuseness of sound for each time-frequency bin (k, n) from the point of view of the virtual microphone. Another possible side information could, for instance, be the active sound intensity vector Ia(k, n) which would have been measured in the position of the virtual microphone. How these parameters can be derived, will now be described.

According to an embodiment, DOA estimation for the virtual spatial microphone is realized. The information computation module 120 is adapted to estimate the direction of arrival at the virtual microphone as spatial side information, based on a position vector of the virtual microphone and based on a position vector of the sound event as illustrated by FIG. 22.

Figure 22:
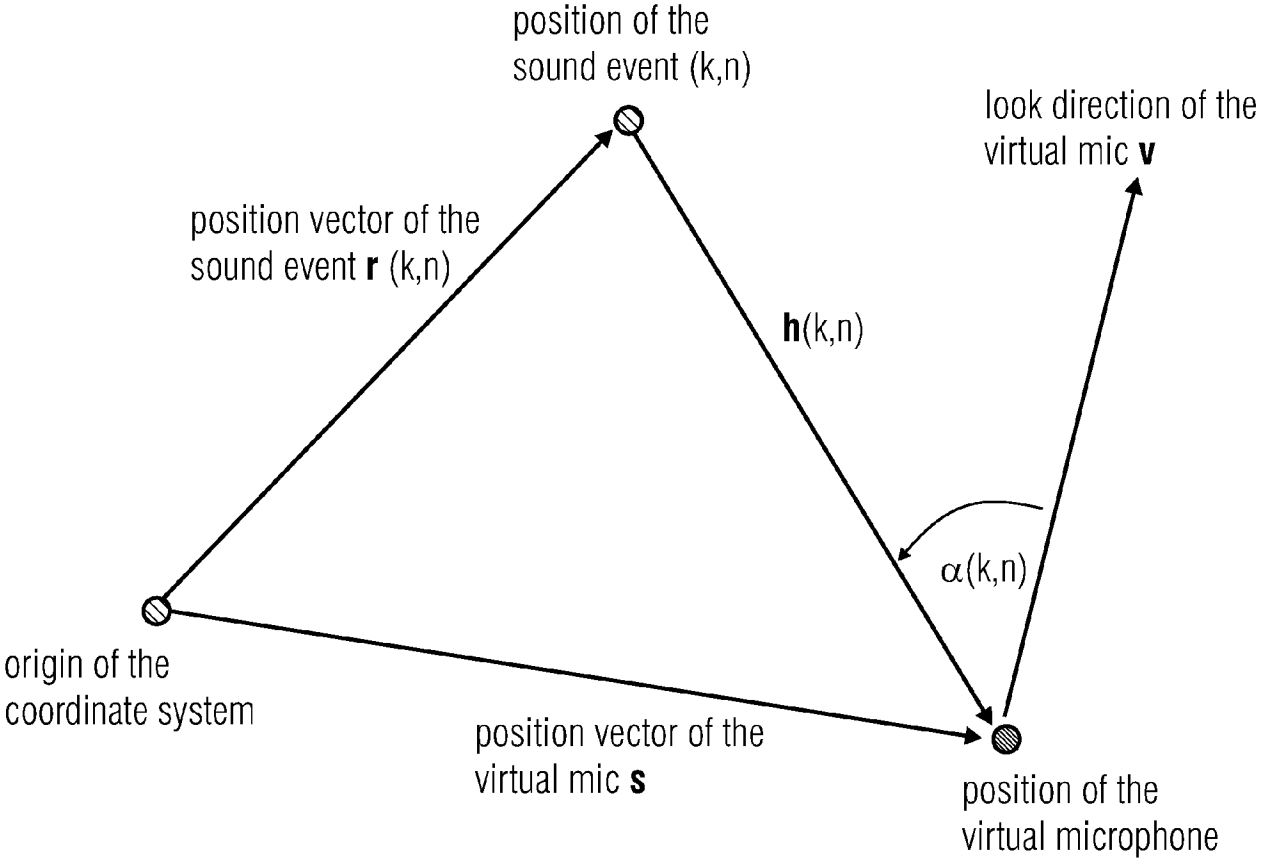
FIG. 22 depicts a possible way to derive the DOA of the sound from the point of view of the virtual microphone according to an embodiment.

FIG. 22 depicts a possible way to derive the DOA of the sound from the point of view of the virtual microphone. The position of the sound event, provided by block 205 in FIG. 19, can be described for each time-frequency bin (k, n) with a position vector r(k, n), the position vector of the sound event. Similarly, the position of the virtual microphone, provided as input 104 in FIG. 19, can be described with a position vector s(k,n), the position vector of the virtual microphone. The look direction of the virtual microphone can be described by a vector v(k, n). The DOA relative to the virtual microphone is given by a(k,n). It represents the angle between v and the sound propagation path h(k,n). h(k, n) can be computed by employing the formula:

$$h(k,n)=s(k,n)-r(k,n).$$

The desired DOA a(k, n) can now be computed for each (k, n) for instance via the definition of the dot product of h(k, n) and v(k,n), namely $$a(k,n)=\arccos(h(k,n)\cdot v(k,n)/(\|h(k,n)\|\|v(k,n)\|)).$$

In another embodiment, the information computation module 120 may be adapted to estimate the active sound intensity at the virtual microphone as spatial side information, based on a position vector of the virtual microphone and based on a position vector of the sound event as illustrated by FIG. 22.

From the DOA a(k, n) defined above, we can derive the active sound intensity Ia(k, n) at the position of the virtual microphone. For this, it is assumed that the virtual microphone audio signal 105 in FIG. 19 corresponds to the output of an omnidirectional microphone, e.g., we assume, that the virtual microphone is an omnidirectional microphone. Moreover, the looking direction v in FIG. 22 is assumed to be parallel to the x-axis of the coordinate system. Since the desired active sound intensity vector Ia(k, n) describes the net flow of energy through the position of the virtual microphone, we can compute Ia(k, n) can be computed, e.g. according to the formula:

$$Ia(k,n)=-(\tfrac{1}{2}\mathrm{rho})|P_v(k,n)|^2*[\cos a(k,n), \sin a(k,n)]^T,$$

where $[\ ]^T$ denotes a transposed vector, rho is the air density, and $P_v(k, n)$ is the sound pressure measured by the virtual spatial microphone, e.g., the output 105 of block 506 in FIG. 19.

If the active intensity vector shall be computed expressed in the general coordinate system but still at the position of the virtual microphone, the following formula may be applied:

$$Ia(k,n)=(\tfrac{1}{2}\mathrm{rho})|P_v(k,n)|^2h(k,n)/\|h(k,n)\|.$$

The diffuseness of sound expresses how diffuse the sound field is in a given time-frequency slot (see, for example, [2]). Diffuseness is expressed by a value $\Psi$, wherein $0\leq\psi\leq1$. A diffuseness of 1 indicates that the total sound field energy of a sound field is completely diffuse. This information is important e.g. in the reproduction of spatial sound. Traditionally, diffuseness is computed at the specific point in space in which a microphone array is placed.

According to an embodiment, the diffuseness may be computed as an additional parameter to the side information generated for the Virtual Microphone (VM), which can be placed at will at an arbitrary position in the sound scene. By this, an apparatus that also calculates the diffuseness besides the audio signal at a virtual position of a virtual microphone can be seen as a virtual DirAC front-end, as it is possible to produce a DirAC stream, namely an audio signal, direction of arrival, and diffuseness, for an arbitrary point in the sound scene. The DirAC stream may be further processed, stored, transmitted, and played back on an arbitrary multi-loudspeaker setup. In this case, the listener experiences the sound scene as if he or she were in the position specified by the virtual microphone and were looking in the direction determined by its orientation.

Figure 23:
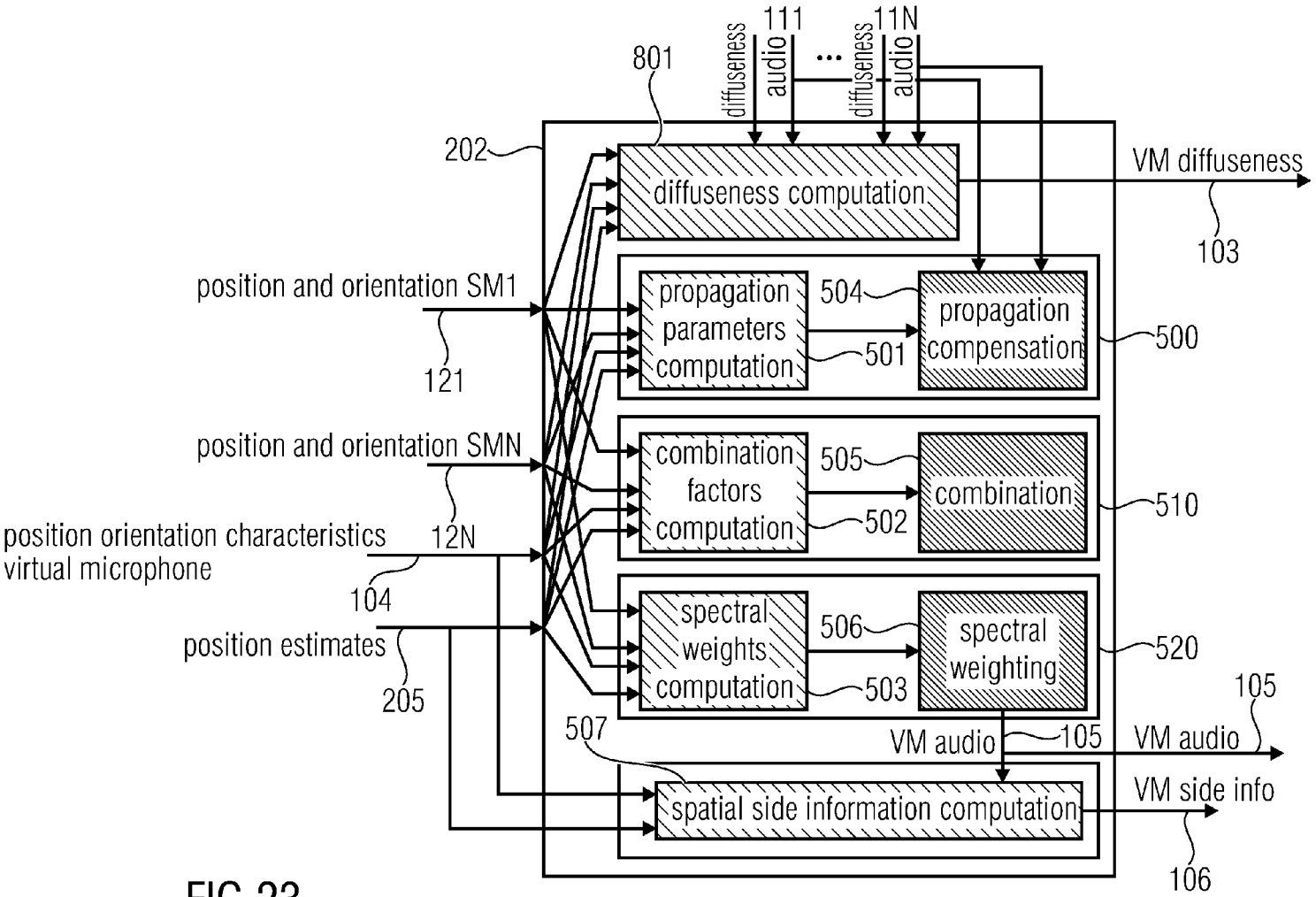
FIG. 23 illustrates an information computation block comprising a diffuseness computation unit according to an embodiment.

FIG. 23 illustrates an information computation block according to an embodiment comprising a diffuseness computation unit 801 for computing the diffuseness at the virtual microphone. The information computation block 202 is adapted to receive inputs 111 to 11N, that in addition to the inputs of FIG. 14 also include diffuseness at the real spatial microphones. Let $\Psi^{(SM1)}$ to $\Psi^{(SMN)}$ denote these values. These additional inputs are fed to the information computation module 202. The output 103 of the diffuseness computation unit 801 is the diffuseness parameter computed at the position of the virtual microphone.

Figure 24:
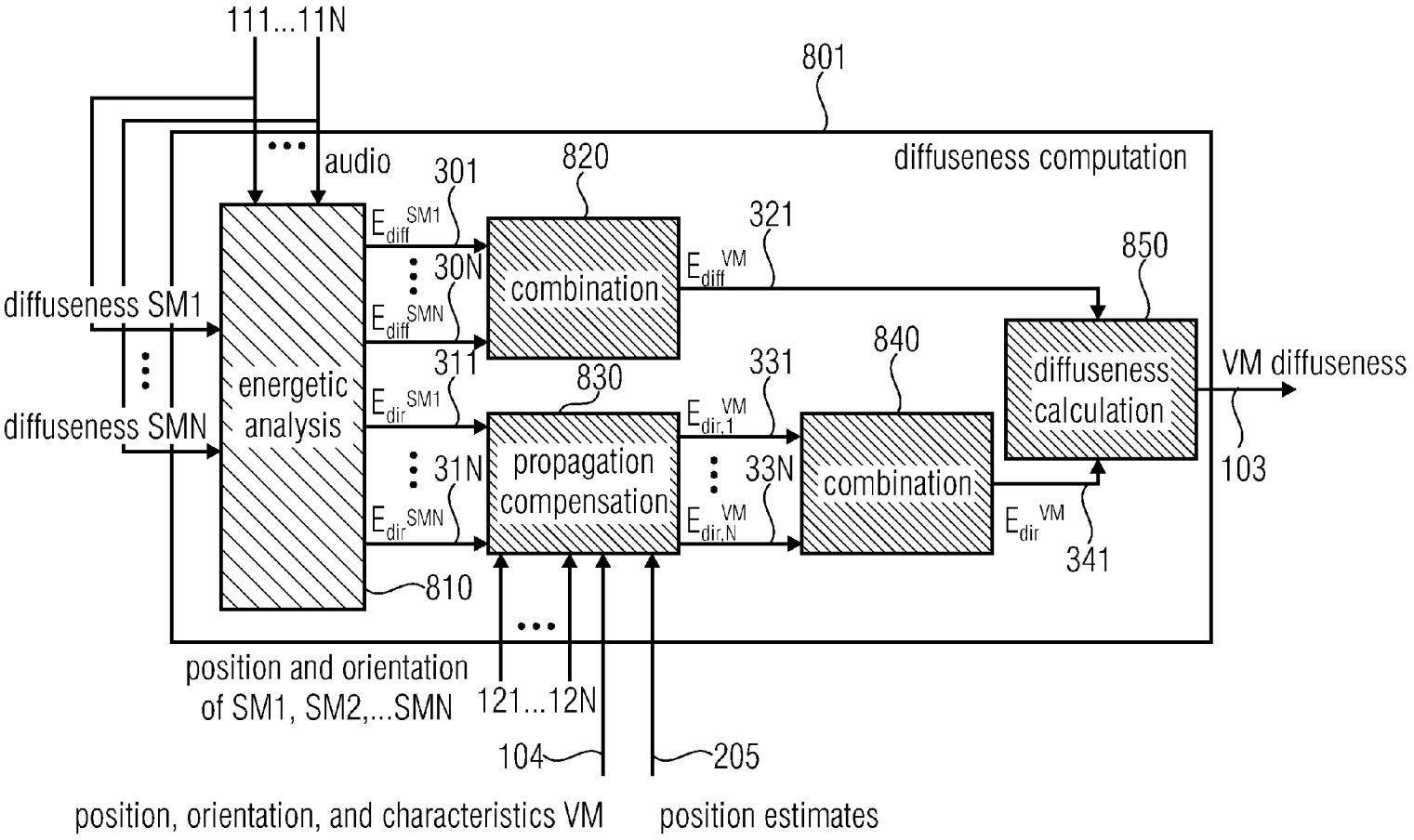
FIG. 24 depicts a diffuseness computation unit according to an embodiment.

A diffuseness computation unit 801 of an embodiment is illustrated in FIG. 24 depicting more details. According to an embodiment, the energy of direct and diffuse sound at each of the N spatial microphones is estimated. Then, using the information on the positions of the IPLS, and the information on the positions of the spatial and virtual microphones, N estimates of these energies at the position of the virtual microphone are obtained. Finally, the estimates can be combined to improve the estimation accuracy and the diffuseness parameter at the virtual microphone can be readily computed.

Let $E_{dir}^{(SM\ 1)}$ to $E_{dir}^{(SM\ N)}$ and $E_{diff}^{(SM\ 1)}$ to $E_{diff}^{(SM\ N)}$ denote the estimates of the energies of direct and diffuse sound for the N spatial microphones computed by energy analysis unit 810. If $P_i$ is the complex pressure signal and $\Psi_i$ is diffuseness for the i-th spatial microphone, then the energies may, for example, be computed according to the formulae:

$$E_{dir}^{(SMi)}=(1-\Psi_i)\cdot|P_i|^2$$

$$E_{diff}^{(SMi)}=\Psi_i\cdot|P_i|^2$$

The energy of diffuse sound should be equal in all positions, therefore, an estimate of the diffuse sound energy $E_{diff}^{(VM)}$ at the virtual microphone can be computed simply by averaging $E_{diff}^{(SM\ 1)}$ to $E_{diff}^{(SM\ N)}$, e.g. in a diffuseness combination unit 820, for example, according to the formula:

$$E_{diff}^{(VM)}=\frac{1}{N}\sum_{i=1}^{N}E_{diff}^{(SMi)}$$

A more effective combination of the estimates $E_{diff}^{(SM\ 1)}$ to $E_{diff}^{(SM\ N)}$ could be carried out by considering the variance of the estimators, for instance, by considering the SNR.

The energy of the direct sound depends on the distance to the source due to the propagation. Therefore, $E_{dir}^{(SM\ 1)}$ to $E_{dir}^{(SM\ N)}$ may be modified to take this into account. This may be carried out, e.g., by a direct sound propagation adjustment unit 830. For example, if it is assumed that the energy of the direct sound field decays with 1 over the distance squared, then the estimate for the direct sound at the virtual microphone for the i-th spatial microphone may be calculated according to the formula:

$$E_{dir,i}^{(VM)}=\left(\frac{\text{distance } SMi-IPLS}{\text{distance } VM-IPLS}\right)^2E_{dir}^{(SMi)}$$

Similarly to the diffuseness combination unit 820, the estimates of the direct sound energy obtained at different spatial microphones can be combined, e.g. by a direct sound combination unit 840. The result is $E_{dir}^{(VM)}$, e.g., the estimate for the direct sound energy at the virtual microphone. The diffuseness at the virtual microphone $\Psi^{(VM)}$ may be computed, for example, by a diffuseness sub-calculator 850, e.g. according to the formula:

$$\psi^{(VM)}=\frac{E_{diff}^{(VM)}}{E_{diff}^{(VM)}+E_{dir}^{(VM)}}$$

Figure 25:
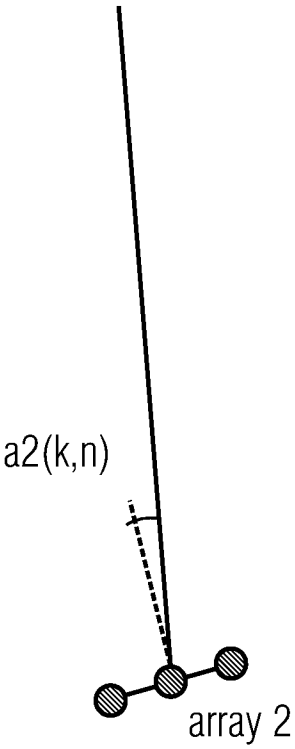
FIG. 25 illustrates a scenario, where the sound events position estimation is not possible.
Figure 25:
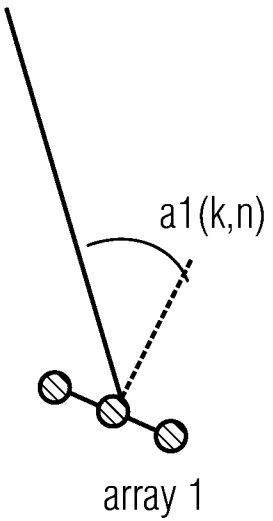

As mentioned above, in some cases, the sound events position estimation carried out by a sound events position estimator fails, e.g., in case of a wrong direction of arrival estimation. FIG. 25 illustrates such a scenario. In these cases, regardless of the diffuseness parameters estimated at the different spatial microphone and as received as inputs 111 to 11N, the diffuseness for the virtual microphone 103 may be set to 1 (i.e., fully diffuse), as no spatially coherent reproduction is possible.

Additionally, the reliability of the DOA estimates at the N spatial microphones may be considered. This may be expressed e.g. in terms of the variance of the DOA estimator or SNR. Such an information may be taken into account by the diffuseness sub-calculator 850, so that the VM diffuseness 103 can be artificially increased in case that the DOA estimates are unreliable. In fact, as a consequence, the position estimates 205 will also be unreliable.

Figure 1:
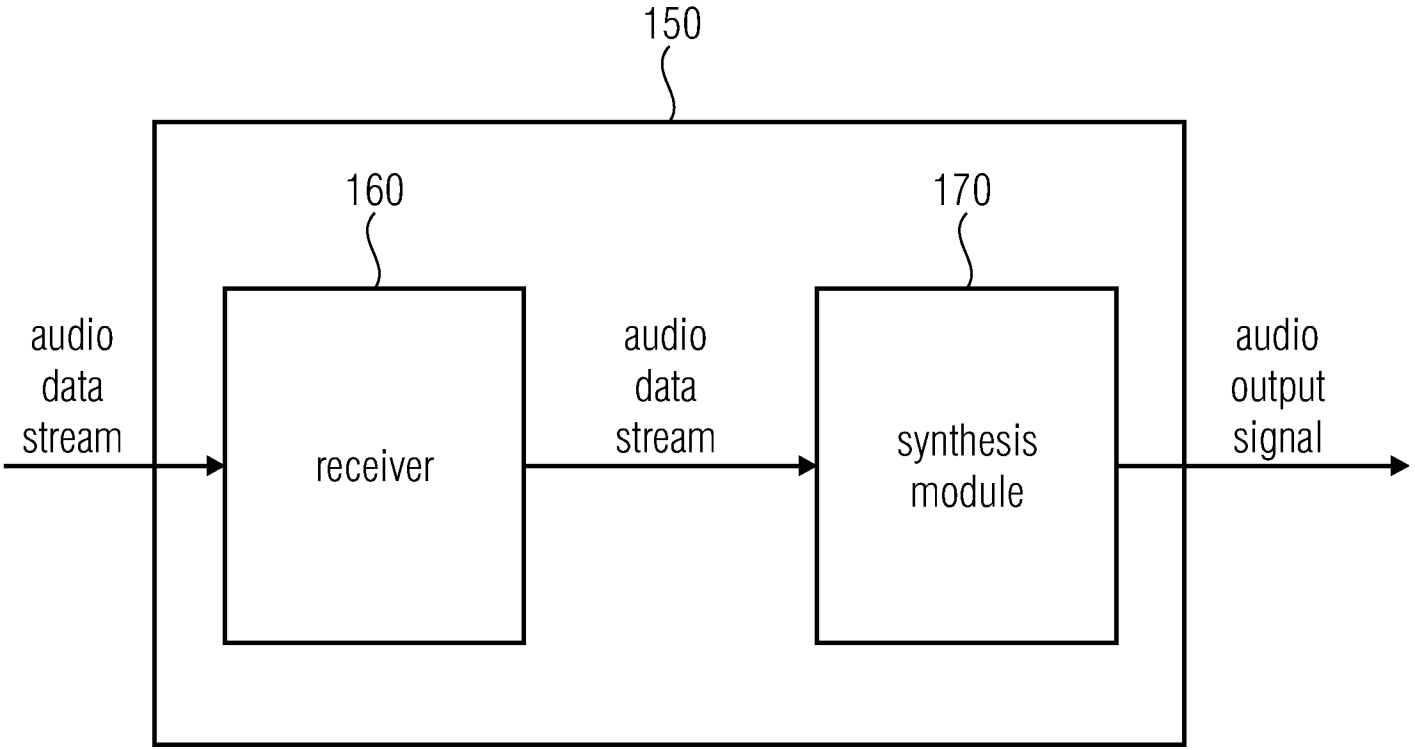
FIG. 1 illustrates an apparatus for generating at least one audio output signal based on an audio data stream comprising audio data relating to one or more sound sources according to an embodiment.

FIG. 1 illustrates an apparatus 150 for generating at least one audio output signal based on an audio data stream comprising audio data relating to one or more sound sources according to an embodiment.

The apparatus 150 comprises a receiver 160 for receiving the audio data stream comprising the audio data. The audio data comprises one or more pressure values for each one of the one or more sound sources. Furthermore, the audio data comprises one or more position values indicating a position of one of the sound sources for each one of the sound sources. Moreover, the apparatus comprises a synthesis module 170 for generating the at least one audio output signal based on at least one of the one or more pressure values of the audio data of the audio data stream and based on at least one of the one or more position values of the audio data of the audio data stream. The audio data is defined for a time-frequency bin of a plurality of time-frequency bins. For each one of the sound sources, at least one pressure value is comprised in the audio data, wherein the at least one pressure value may be a pressure value relating to an emitted sound wave, e.g. originating from the sound source. The pressure value may be a value of an audio signal, for example, a pressure value of an audio output signal generated by an apparatus for generating an audio output signal of a virtual microphone, wherein that the virtual microphone is placed at the position of the sound source.

Thus, FIG. 1 illustrates an apparatus 150 that may be employed for receiving or processing the mentioned audio data stream, i.e. the apparatus 150 may be employed on a receiver/synthesis side. The audio data stream comprises audio data which comprises one or more pressure values and one or more position values for each one of a plurality of sound sources, i.e. each one of the pressure values and the position values relates to a particular sound source of the one or more sound sources of the recorded audio scene. This means that the position values indicate positions of sound sources instead of the recording microphones. With respect to the pressure value this means that the audio data stream comprises one or more pressure value for each one of the sound sources, i.e. the pressure values indicate an audio signal which is related to a sound source instead of being related to a recording of a real spatial microphone.

According to an embodiment, the receiver 160 may be adapted to receive the audio data stream comprising the audio data, wherein the audio data furthermore comprises one or more diffuseness values for each one of the sound sources. The synthesis module 170 may be adapted to generate the at least one audio output signal based on at least one of the one or more diffuseness values.

Figure 2:
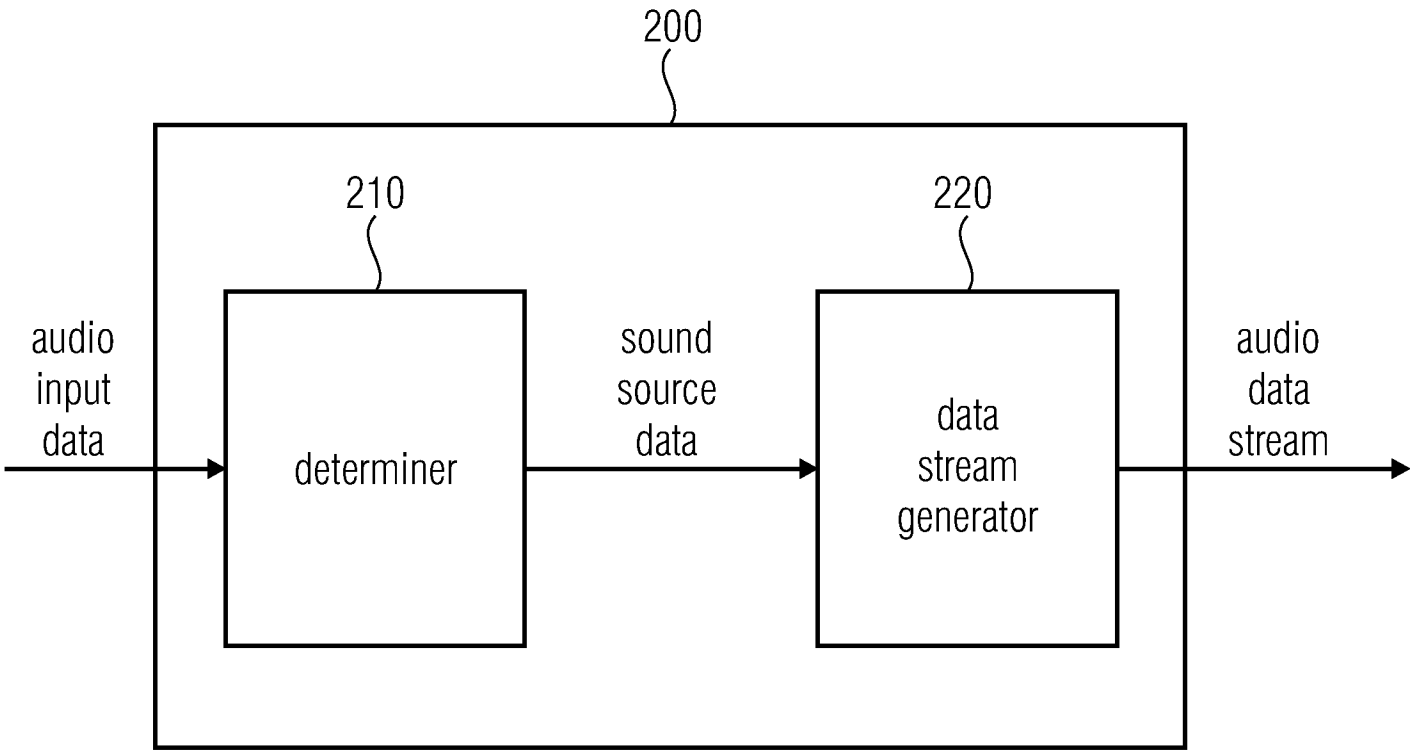
FIG. 2 illustrates an apparatus for generating an audio data stream comprising sound source data relating to one or more sound sources according to an embodiment.

FIG. 2 illustrates an apparatus 200 for generating an audio data stream comprising sound source data relating to one or more sound sources according to an embodiment. The apparatus 200 for generating an audio data stream comprises a determiner 210 for determining the sound source data based on at least one audio input signal recorded by at least one spatial microphone and based on audio side information provided by at least two spatial microphones. Furthermore, the apparatus 200 comprises a data stream generator 220 for generating the audio data stream such that the audio data stream comprises the sound source data. The sound source data comprises one or more pressure values for each one of the sound sources. Moreover, the sound source data furthermore comprises one or more position values indicating a sound source position for each one of the sound sources. Furthermore, the sound source data is defined for a time-frequency bin of a plurality of time-frequency bins.

The audio data stream generated by the apparatus 200 may then be transmitted. Thus, the apparatus 200 may be employed on an analysis/transmitter side. The audio data stream comprises audio data which comprises one or more pressure values and one or more position values for each one of a plurality of sound sources, i.e. each one of the pressure values and the position values relates to a particular sound source of the one or more sound sources of the recorded audio scene. This means that with respect to the position values, the position values indicate positions of sound sources instead of the recording microphones.

In a further embodiment, the determiner 210 may be adapted to determine the sound source data based on diffuseness information by at least one spatial microphone. The data stream generator 220 may be adapted to generate the audio data stream such that the audio data stream comprises the sound source data. The sound source data furthermore comprises one or more diffuseness values for each one of the sound sources.

Figure 3A:
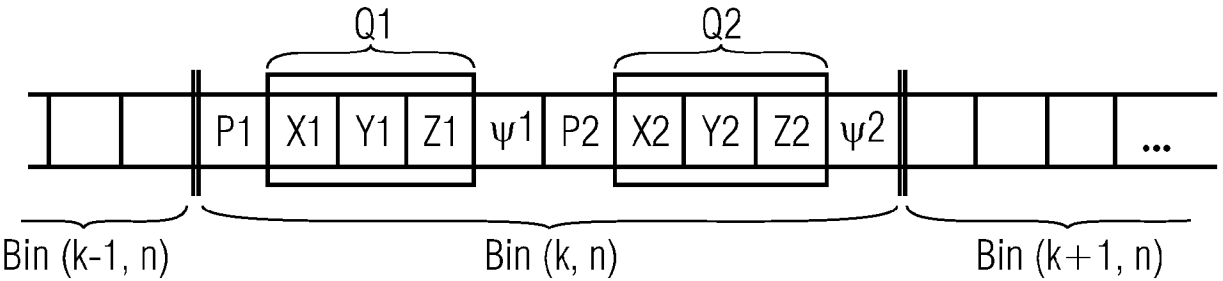
FIG. 3*a*-3*c* illustrate audio data streams according to different embodiments.

FIG. 3*a* illustrates an audio data stream according to an embodiment. The audio data stream comprises audio data relating to two sound sources being active in one time-frequency bin. In particular, FIG. 3*a* illustrates the audio data that is transmitted for a time-frequency bin (k, n), wherein k denotes the frequency index and n denotes the time index. The audio data comprises a pressure value P1, a position value Q1 and a diffuseness value Ψ1 of a first sound source. The position value Q1 comprises three coordinate values X1, Y1 and Z1 indicating the position of the first sound source. Furthermore, the audio data comprises a pressure value P2, a position value Q2 and a diffuseness value Ψ2 of a second sound source. The position value Q2 comprises three coordinate values X2, Y2 and Z2 indicating the position of the second sound source.

Figure 3B:
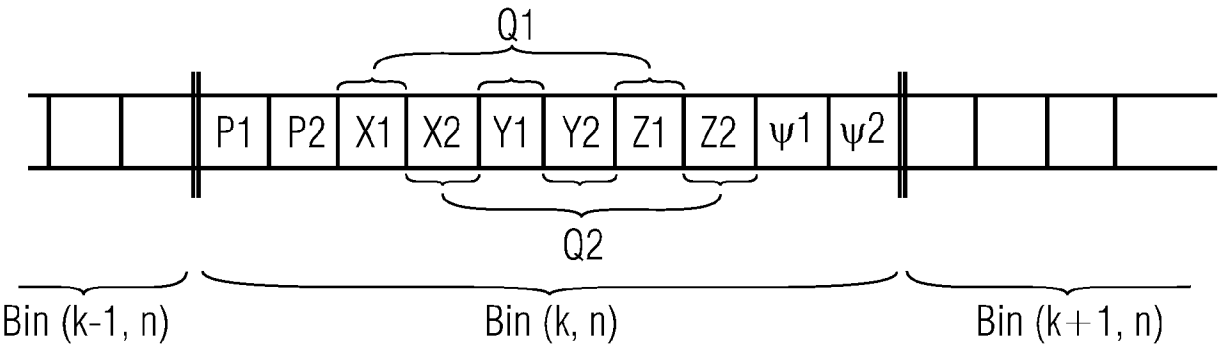

FIG. 3*b* illustrates an audio stream according to another embodiment. Again, the audio data comprises a pressure value P1, a position value Q1 and a diffuseness value Ψ1 of a first sound source. The position value Q1 comprises three coordinate values X1, Y1 and Z1 indicating the position of the first sound source. Furthermore, the audio data comprises a pressure value P2, a position value Q2 and a diffuseness value Ψ2 of a second sound source. The position value Q2 comprises three coordinate values X2, Y2 and Z2 indicating the position of the second sound source.

Figure 3C:
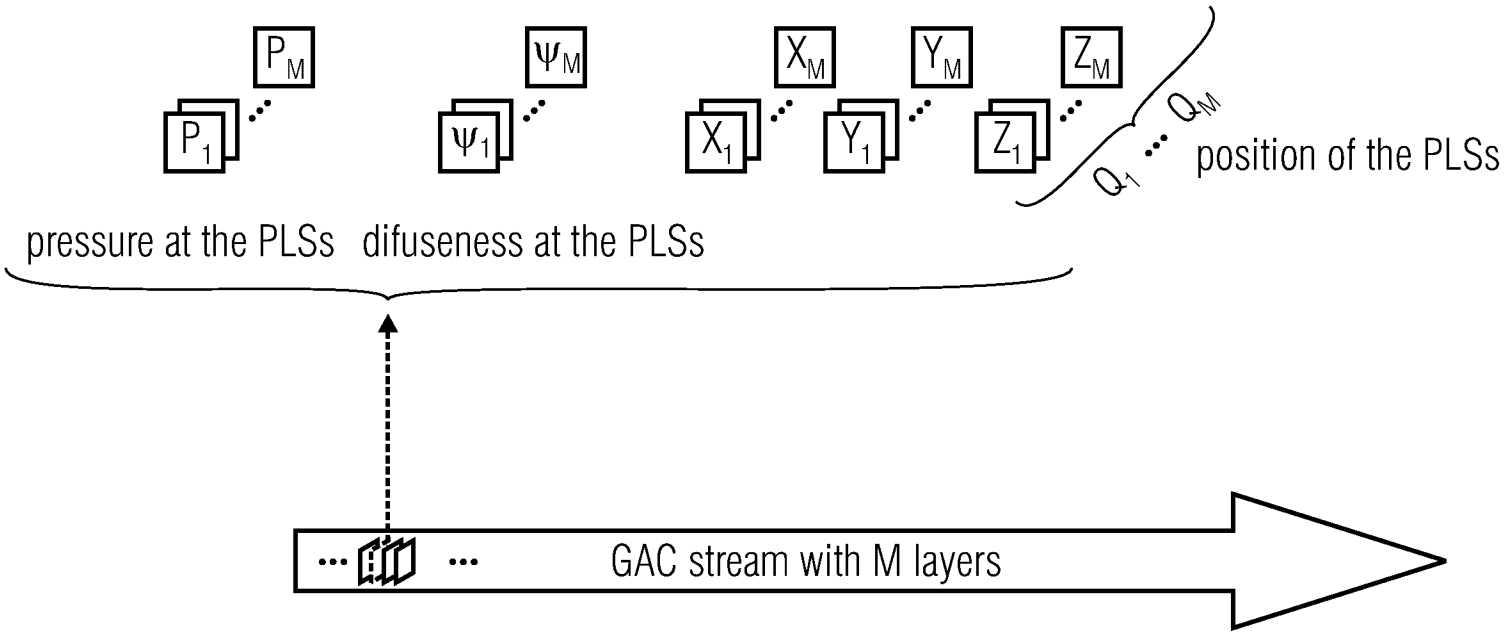

FIG. 3*c* provides another illustration of the audio data stream. As the audio data stream provides geometry-based spatial audio coding (GAC) information, it is also referred to as "geometry-based spatial audio coding stream" or "GAC stream". The audio data stream comprises information which relates to the one or more sound sources, e.g. one or more isotropic point-like source (IPLS). As already explained above, the GAC stream may comprise the following signals, wherein k and n denote the frequency index and the time index of the considered time-frequency bin:

P(k, n): Complex pressure at the sound source, e.g. at the IPLS. This signal possibly comprises direct sound (the sound originating from the IPLS itself) and diffuse sound.

Q(k,n): Position (e.g. Cartesian coordinates in 3D) of the sound source, e.g. of the IPLS: The position may, for example, comprise Cartesian coordinates X(k,n), Y(k, n), Z(k,n).

Diffuseness at the IPLS: Ψ(k,n). This parameter is related to the power ratio of direct to diffuse sound comprised in P(k,n). If $P(k,n)=P_{dir}(k,n)+P_{diff}(k,n)$, then one possibility to express diffuseness is $\Psi(k,n)=|P_{diff}(k,n)|^2/|P(k,n)|^2$. If $|P(k,n)|^2$ is known, other equivalent representations are conceivable, for example, the Direct to Diffuse Ratio (DDR) $\Gamma=|Pdir(k,n)|^2/|Pdiff(k,n)|^2$.

As already stated, k and n denote the frequency and time indices, respectively. If desired and if the analysis allows it, more than one IPLS can be represented at a given time-frequency slot. This is depicted in FIG. 3*c* as M multiple layers, so that the pressure signal for the i-th layer (i.e., for the i-th IPLS) is denoted with $P_i(k, n)$. For convenience, the position of the IPLS can be expressed as the vector $Q_i(k, n)=[X_i(k, n), Y_i(k, n), Z_i(k, n)]^T$. Differently than the state-of-the-art, all parameters in the GAC stream are expressed with respect to the one or more sound source, e.g. with respect to the IPLS, thus achieving independence from the recording position. In FIG. 3*c*, as well as in FIGS. 3*a* and 3*b*, all quantities in the figure are considered in time-frequency domain; the (k,n) notation was neglected for reasons of simplicity, for example, $P_i$ means $P_i(k,n)$, e.g. $P_i=P_i(k,n)$.

In the following, an apparatus for generating an audio data stream according to an embodiment is explained in more detail. As the apparatus of FIG. 2, the apparatus of FIG. 4 comprises a determiner 210 and a data stream generator 220 which may be similar to the determiner 210. As the determiner analyzes the audio input data to determine the sound source data based on which the data stream generator generates the audio data stream, the determiner and the data stream generator may together be referred to as an "analysis module". (see analysis module 410 in FIG. 4).

The analysis module 410 computes the GAC stream from the recordings of the N spatial microphones. Depending on the number M of layers desired (e.g. the number of sound sources for which information shall be comprised in the audio data stream for a particular time-frequency bin), the type and number N of spatial microphones, different methods for the analysis are conceivable. A few examples are given in the following.

As a first example, parameter estimation for one sound source, e.g. one IPLS, per time-frequency slot is considered. In the case of M=1, the GAC stream can be readily obtained with the concepts explained above for the apparatus for generating an audio output signal of a virtual microphone, in that a virtual spatial microphone can be placed in the position of the sound source, e.g. in the position of the IPLS. This allows the pressure signals to be calculated at the position of the IPLS, together with the corresponding position estimates, and possibly the diffuseness. These three parameters are grouped together in a GAC stream and can be further manipulated by module 102 in FIG. 8 before being transmitted or stored.

For example, the determiner may determine the position of a sound source by employing the concepts proposed for the sound events position estimation of the apparatus for generating an audio output signal of a virtual microphone. Moreover, the determiner may comprise an apparatus for generating an audio output signal and may use the determined position of the sound source as the position of the virtual microphone to calculate the pressure values (e.g. the values of the audio output signal to be generated) and the diffuseness at the position of the sound source.

Figure 4:
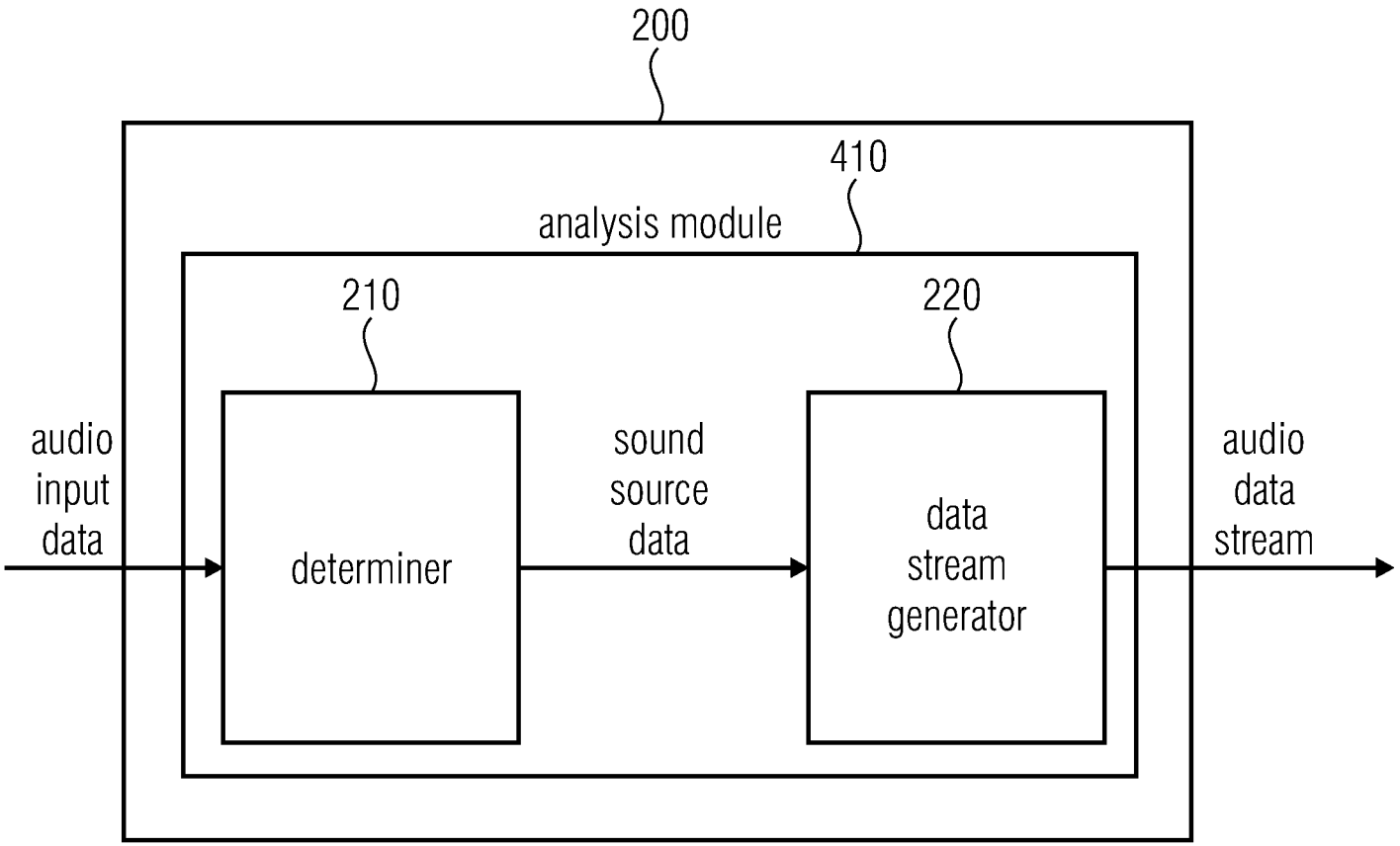
FIG. 4 illustrates an apparatus for generating an audio data stream comprising sound source data relating to one or more sound sources according to another embodiment.

In particular, the determiner 210, e.g., in FIG. 4), is configured to determine the pressure signals, the corresponding position estimates, and the corresponding diffuseness, while the data stream generator 220 is configured to generate the audio data stream based on the calculated pressure signals, position estimates and diffuseness.

As another example, parameter estimation for 2 sound sources, e.g. 2 IPLS, per time-frequency slot is considered. If the analysis module 410 is to estimate two sound sources per time-frequency bin, then the following concept based on state-of-the-art estimators can be used.

Figure 5:
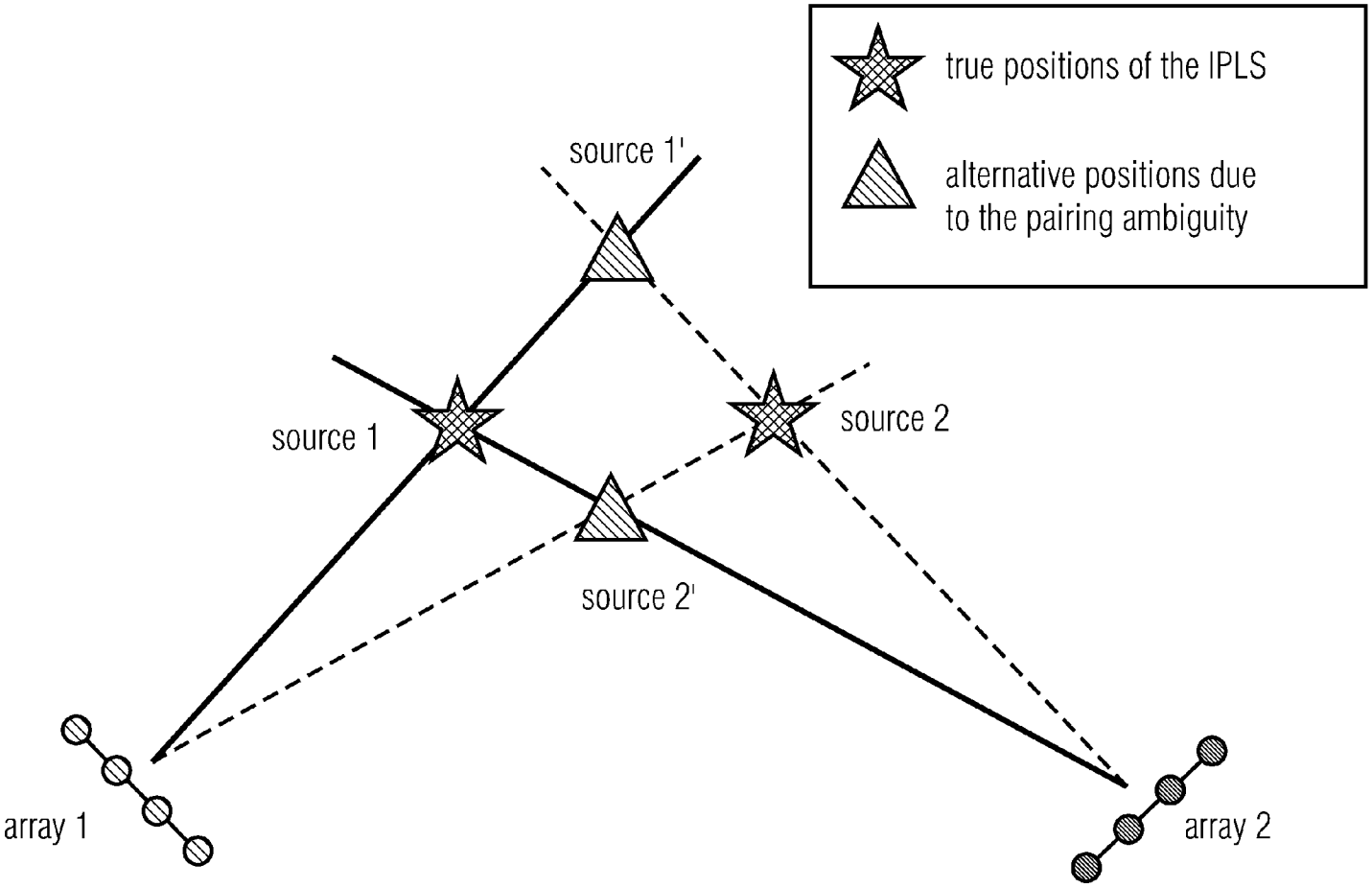
FIG. 5 illustrates a sound scene composed of two sound sources and two uniform linear microphone arrays.

FIG. 5 illustrates a sound scene composed of two sound sources and two uniform linear microphone arrays. Reference is made to ESPRIT, see

[26] R. Roy and T. Kailath. ESPRIT-estimation of signal parameters via rotational invariance techniques. Acoustics, Speech and Signal Processing, IEEE Transactions on, 37(7):984-995, July 1989.

ESPRIT ([26]) can be employed separately at each array to obtain two DOA estimates for each time-frequency bin at each array. Due to a pairing ambiguity, this leads to two possible solutions for the position of the sources. As can be seen from FIG. 5, the two possible solutions are given by (1, 2) and (1', 2'). In order to solve this ambiguity, the following solution can be applied. The signal emitted at each source is estimated by using a beamformer oriented in the direction of the estimated source positions and applying a proper factor to compensate for the propagation (e.g., multiplying by the inverse of the attenuation experienced by the wave). This can be carried out for each source at each array for each of the possible solutions. We can then define an estimation error for each pair of sources (i, j) as:

$$E_{i,j}=|P_{i,1}-P_{i,2}|+|P_{j,1}-P_{j,2}|, \quad (1)$$

where $(i, j)\in\{(1, 2), (1', 2')\}$ (see FIG. 5) and $P_{i,1}$ stands for the compensated signal power seen by array r from sound source i. The error is minimal for the true sound source pair. Once the pairing issue is solved and the correct DOA estimates are computed, these are grouped, together with the corresponding pressure signals and diffuseness estimates into a GAC stream. The pressure signals and diffuseness estimates can be obtained using the same method already described for the parameter estimation for one sound source.

Figure 6A:
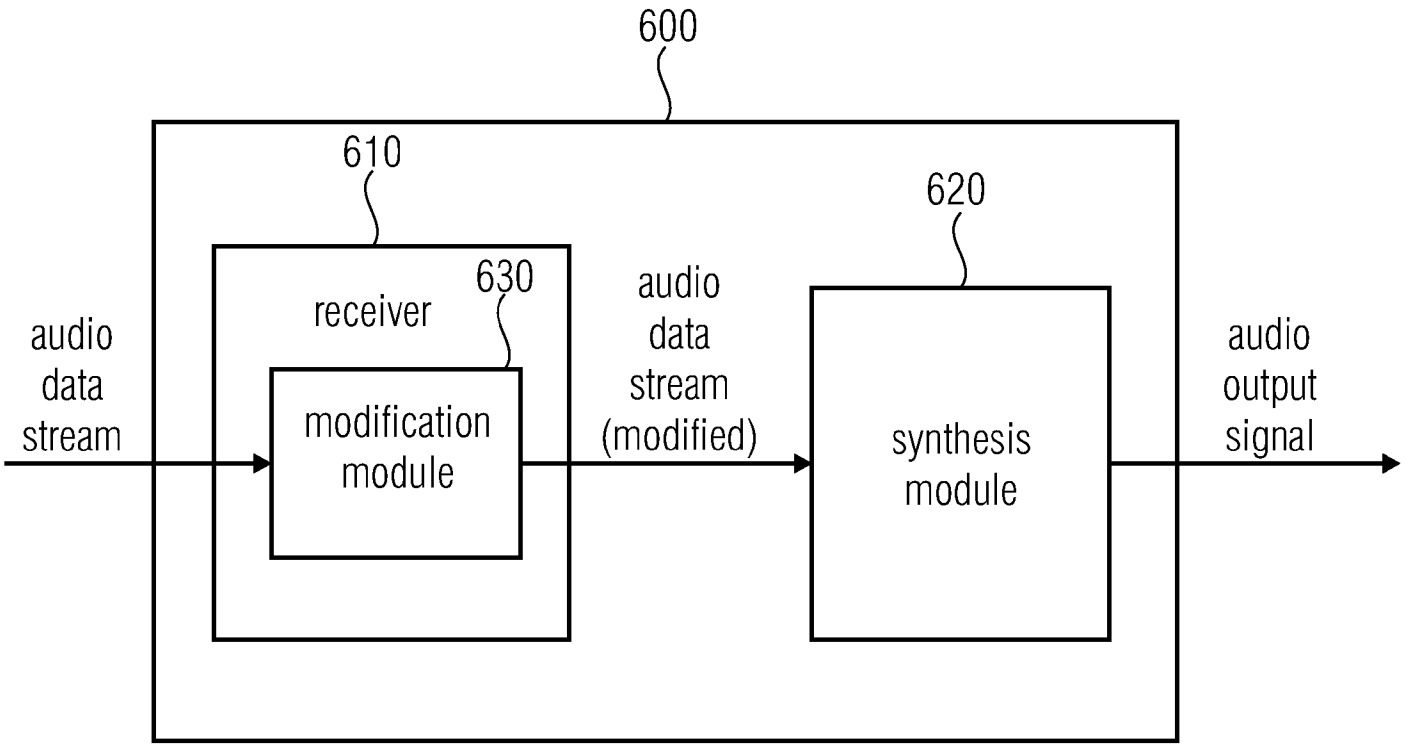
FIG. 6*a* illustrates an apparatus 600 for generating at least one audio output signal based on an audio data stream according to an embodiment.

FIG. 6*a* illustrates an apparatus 600 for generating at least one audio output signal based on an audio data stream according to an embodiment. The apparatus 600 comprises a receiver 610 and a synthesis module 620. The receiver 610 comprises a modification module 630 for modifying the audio data of the received audio data stream by modifying at least one of the pressure values of the audio data, at least one of the position values of the audio data or at least one of the diffuseness values of the audio data relating to at least one of the sound sources.

Figure 6B:
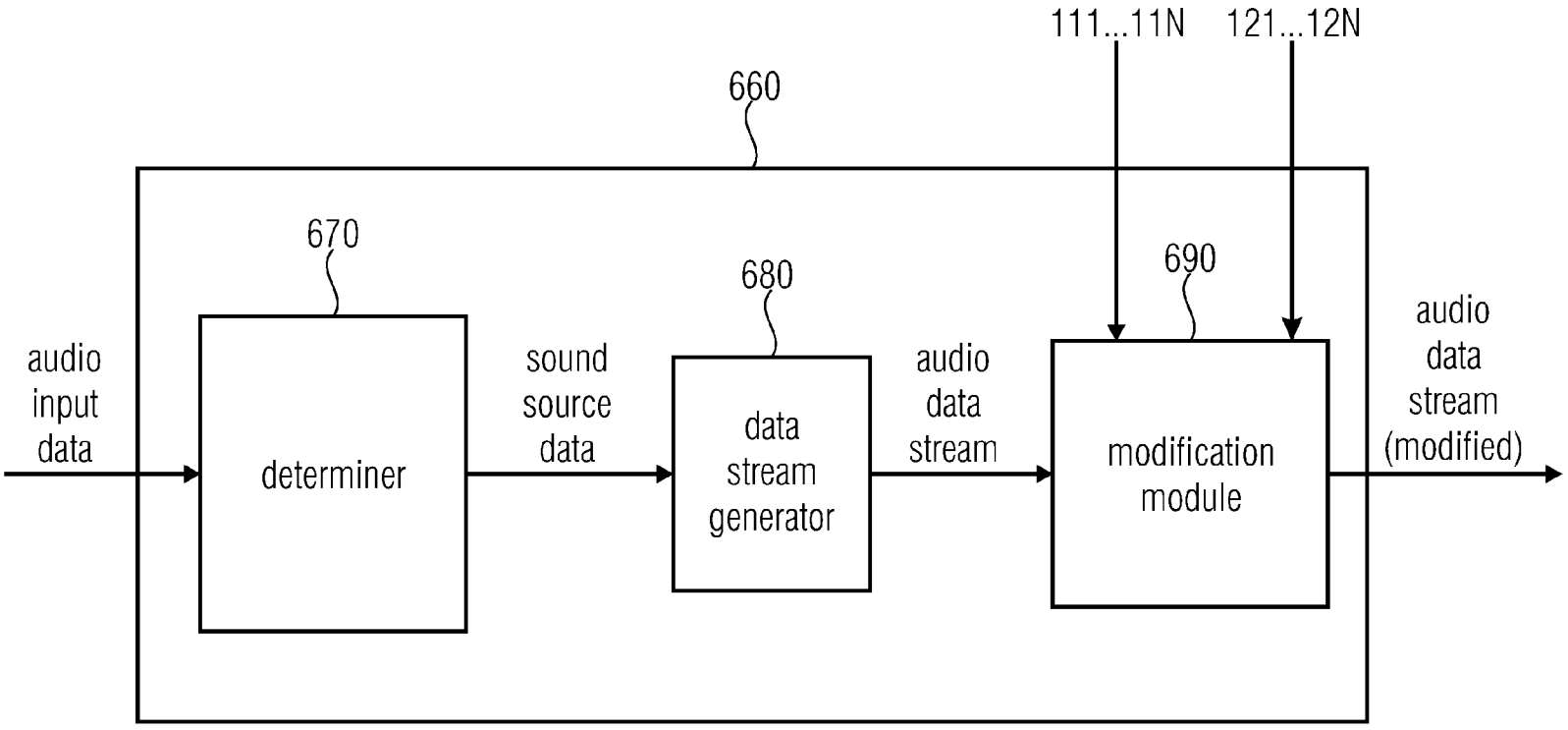
FIG. 6*b* illustrates an apparatus 660 for generating an audio data stream comprising sound source data relating to one or more sound sources according to an embodiment.

FIG. 6*b* illustrates an apparatus 660 for generating an audio data stream comprising sound source data relating to one or more sound sources according to an embodiment. The apparatus for generating an audio data stream comprises a determiner 670, a data stream generator 680 and furthermore a modification module 690 for modifying the audio data stream generated by the data stream generator by modifying at least one of the pressure values of the audio data, at least one of the position values of the audio data or at least one of the diffuseness values of the audio data relating to at least one of the sound sources.

While the modification module 610 of FIG. 6*a* is employed on a receiver/synthesis side, the modification module 660 of FIG. 6*b* is employed on a transmitter/analysis side.

The modifications of the audio data stream conducted by the modification modules 610, 660 may also be considered as modifications of the sound scene. Thus, the modification modules 610, 660 may also be referred to as sound scene manipulation modules.

The sound field representation provided by the GAC stream allows different kinds of modifications of the audio data stream, i.e. as a consequence, manipulations of the sound scene. Some examples in this context are:

1. Expanding arbitrary sections of space/volumes in the sound scene (e.g. expansion of a point-like sound source in order to make it appear wider to the listener);
2. Transforming a selected section of space/volume to any other arbitrary section of space/volume in the sound scene (the transformed space/volume could e.g. contain a source that is necessitated to be moved to a new location);
3. Position-based filtering, where selected regions of the sound scene are enhanced or partially/completely suppressed In the following a layer of an audio data stream, e.g. a GAC stream, is assumed to comprise all audio data of one of the sound sources with respect to a particular time-frequency bin.

Figure 7:
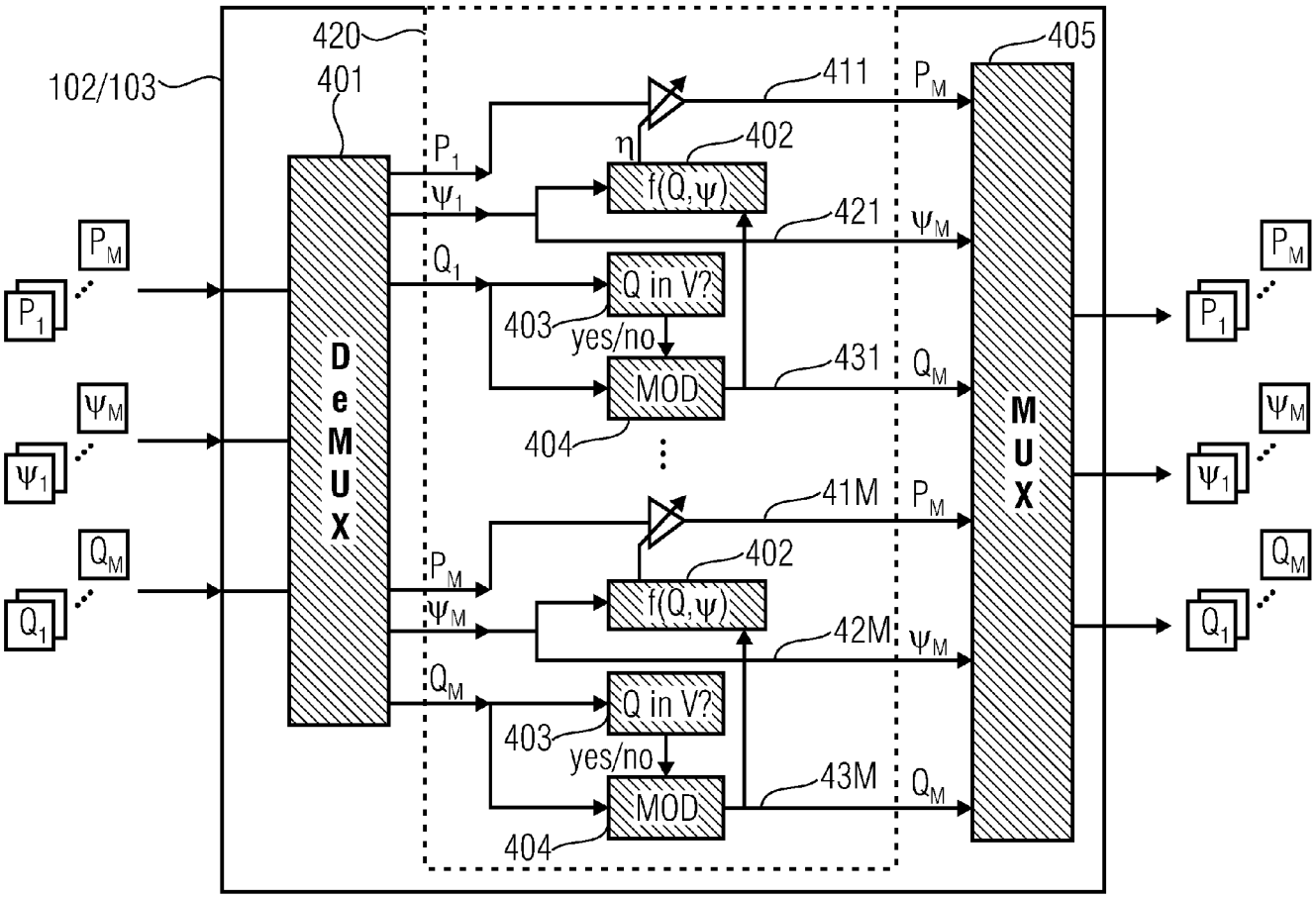
FIG. 7 depicts a modification module according to an embodiment.

FIG. 7 depicts a modification module according to an embodiment. The modification unit of FIG. 7 comprises a demultiplexer 401, a manipulation processor 420 and a multiplexer 405.

The demultiplexer 401 is configured to separate the different layers of the M-layer GAC stream and form M single-layer GAC streams. Moreover, the manipulation processor 420 comprises units 402, 403 and 404, which are applied on each of the GAC streams separately. Furthermore, the multiplexer 405 is configured to form the resulting M-layer GAC stream from the manipulated single-layer GAC streams.

Based on the position data from the GAC stream and the knowledge about the position of the real sources (e.g. talkers), the energy can be associated with a certain real source for every time-frequency bin. The pressure values P are then weighted accordingly to modify the loudness of the respective real source (e.g. talker). It necessitates a priori information or an estimate of the location of the real sound sources (e.g. talkers).

In some embodiments, if knowledge about the position of the real sources is available, then based on the position data from the GAC stream, the energy can be associated with a certain real source for every time-frequency bin.

The manipulation of the audio data stream, e.g. the GAC stream can take place at the modification module 630 of the apparatus 600 for generating at least one audio output signal of FIG. 6*a*, i.e. at a receiver/synthesis side and/or at the modification module 690 of the apparatus 660 for generating an audio data stream of FIG. 6*b*, i.e. at a transmitter/analysis side.

For example, the audio data stream, i.e. the GAC stream, can be modified prior to transmission, or before the synthesis after transmission.

Unlike the modification module 630 of FIG. 6*a* at the receiver/synthesis side, the modification module 690 of FIG. 6*b* at the transmitter/analysis side may exploit the additional information from the inputs 111 to 11N (the recorded signals) and 121 to 12N (relative position and orientation of the spatial microphones), as this information is available at the transmitter side. Using this information, a modification unit according to an alternative embodiment can be realized, which is depicted in FIG. 8.

Figure 9:
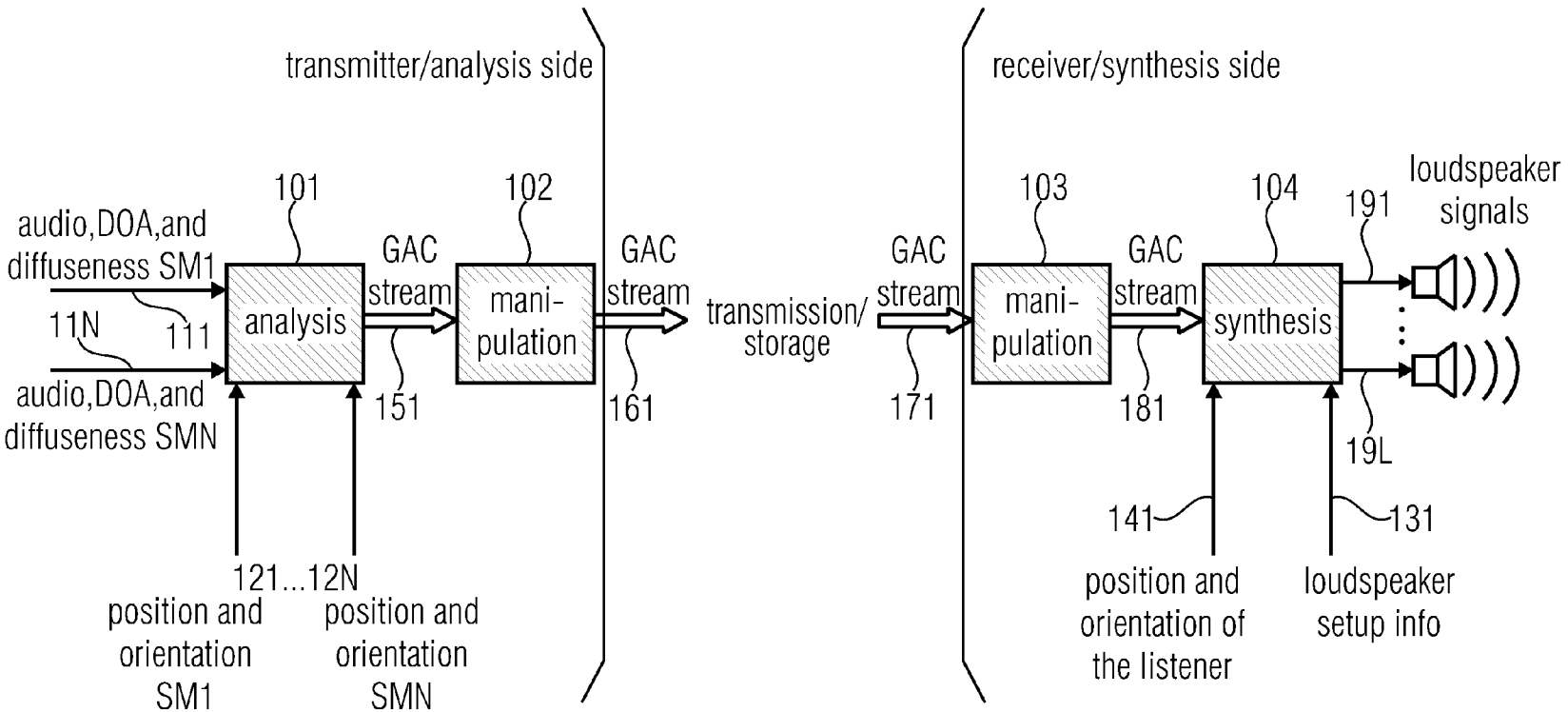
FIG. 9 illustrates transmitter/analysis units and a receiver/synthesis units according to an embodiment.

FIG. 9 depicts an embodiment by illustrating a schematic overview of a system, wherein a GAC stream is generated on a transmitter/analysis side, where, optionally, the GAC stream may be modified by a modification module 102 at a transmitter/analysis side, where the GAC stream may, optionally, be modified at a receiver/synthesis side by modification module 103 and wherein the GAC stream is used to generate a plurality of audio output signals 191 . . . 19L.

At the transmitter/analysis side, the sound field representation (e.g., the GAC stream) is computed in unit 101 from the inputs 111 to 11N, i.e., the signals recorded with N≥2 spatial microphones, and from the inputs 121 to 12N, i.e., relative position and orientation of the spatial microphones.

The output of unit 101 is the aforementioned sound field representation, which in the following is denoted as Geometry-based spatial Audio Coding (GAC) stream. Similarly to the proposal in

[20] Giovanni Del Galdo, Oliver Thiergart, Tobias Weller, and E. A. P. Habets. Generating virtual microphone signals using geometrical information gathered by distributed arrays. In Third Joint Workshop on Hands-free Speech Communication and Microphone Arrays (HSCMA '11), Edinburgh, United Kingdom, May 2011.

and as described for the apparatus for generating an audio output signal of a virtual microphone at a configurable virtual position, a complex sound scene is modeled by means of sound sources, e.g. isotropic point-like sound sources (IPLS), which are active at specific slots in a time-frequency representation, such as the one provided by the Short-Time Fourier Transform (STFT).

The GAC stream may be further processed in the optional modification module 102, which may also be referred to as a manipulation unit. The modification module 102 allows for a multitude of applications. The GAC stream can then be transmitted or stored. The parametric nature of the GAC stream is highly efficient. At the synthesis/receiver side, one more optional modification modules (manipulation units) 103 can be employed. The resulting GAC stream enters the synthesis unit 104 which generates the loudspeaker signals. Given the independence of the representation from the recording, the end user at the reproduction side can potentially manipulate the sound scene and decide the listening position and orientation within the sound scene freely.

The modification/manipulation of the audio data stream, e.g. the GAC stream can take place at modification modules 102 and/or 103 in FIG. 9, by modifying the GAC stream accordingly either prior to transmission in module 102 or after the transmission before the synthesis 103. Unlike in modification module 103 at the receiver/synthesis side, the modification module 102 at the transmitter/analysis side may exploit the additional information from the inputs 111 to 11N (the audio data provided by the spatial microphones) and 121 to 12N (relative position and orientation of the spatial microphones), as this information is available at the transmitter side. FIG. 8 illustrates an alternative embodiment of a modification module which employs this information.

Examples of different concepts for the manipulation of the GAC stream are described in the following with reference to FIG. 7 and FIG. 8. Units with equal reference signals have equal function.

1. Volume Expansion

It is assumed that a certain energy in the scene is located within volume V. The volume V may indicate a predefined area of an environment. Θ denotes the set of time-frequency bins (k, n) for which the corresponding sound sources, e.g. IPLS, are localized within the volume V.

If expansion of the volume V to another volume V' is desired, this can be achieved by adding a random term to the position data in the GAC stream whenever (k, n)∈Θ (evaluated in the decision units 403) and substituting Q(k, n)=[X(k, n), Y(k, n), Z(k, n)]$^T$ (the index layer is dropped for simplicity) such that the outputs 431 to 43M of units 404 in FIGS. 7 and 8 become $$Q(k,n)=[X(k,n)+\Phi_x(k,n);Y(k,n)+\Phi_y(k,n)Z(k,n)+\Phi_z(k,n)]^T \quad (2)$$

where $\Phi_x$, $\Phi_y$ and $\Phi_z$ are random variables whose range depends on the geometry of the new volume V' with respect to the original volume V. This concept can for example be employed to make a sound source be perceived wider. In this example, the original volume V is infinitesimally small, i.e., the sound source, e.g. the IPLS, should be localized at the same point Q(k, n)=[X(k, n), Y(k, n), Z(k, n)]$^T$ for all (k, n)∈Θ. This mechanism may be seen as a form of dithering of the position parameter Q(k, n).

According to an embodiment, each one of the position values of each one of the sound sources comprise at least two coordinate values, and the modification module is adapted to modify the coordinate values by adding at least one random number to the coordinate values, when the coordinate values indicate that a sound source is located at a position within a predefined area of an environment.

2. Volume Transformation

In addition to the volume expansion, the position data from the GAC stream can be modified to relocate sections of space/volumes within the sound field. In this case as well, the data to be manipulated comprises the spatial coordinates of the localized energy.

V denotes again the volume which shall be relocated, and Θ denotes the set of all time-frequency bins (k, n) for which the energy is localized within the volume V. Again, the volume V may indicate a predefined area of an environment.

Volume relocation may be achieved by modifying the GAC stream, such that for all time-frequency bins (k,n)∈Θ, Q(k,n) are replaced by f(Q(k,n)) at the outputs 431 to 43M of units 404, where f is a function of the spatial coordinates (X, Y, Z), describing the volume manipulation to be performed. The function f might represent a simple linear transformation such as rotation, translation, or any other complex non-linear mapping. This technique can be used for example to move sound sources from one position to another within the sound scene by ensuring that Θ corresponds to the set of time-frequency bins in which the sound sources have been localized within the volume V. The technique allows a variety of other complex manipulations of the entire sound scene, such as scene mirroring, scene rotation, scene enlargement and/or compression etc. For example, by applying an appropriate linear mapping on the volume V, the complementary effect of volume expansion, i.e., volume shrinkage can be achieved. This could e.g. be done by mapping Q(k,n) for (k,n)∈Θ to f(Q(k,n))∈V', where V'⊂V and V' comprises a significantly smaller volume than V.

According to an embodiment, the modification module is adapted to modify the coordinate values by applying a deterministic function on the coordinate values, when the coordinate values indicate that a sound source is located at a position within a predefined area of an environment.

3. Position-Based Filtering

The geometry-based filtering (or position-based filtering) idea offers a method to enhance or completely/partially remove sections of space/volumes from the sound scene. Compared to the volume expansion and transformation techniques, in this case, however, only the pressure data from the GAC stream is modified by applying appropriate scalar weights.

In the geometry-based filtering, a distinction can be made between the transmitter-side 102 and the receiver-side modification module 103, in that the former one may use the inputs 111 to 11N and 121 to 12N to aid the computation of appropriate filter weights, as depicted in FIG. 8. Assuming that the goal is to suppress/enhance the energy originating from a selected section of space/volume V, geometry-based filtering can be applied as follows:

For all $(k, n) \in \Theta$, the complex pressure P(k, n) in the GAC stream is modified to $\eta P(k, n)$ at the outputs of 402, where $\eta$ is a real weighting factor, for example computed by unit 402. In some embodiments, module 402 can be adapted to compute a weighting factor dependent on diffuseness also.

The concept of geometry-based filtering can be used in a plurality of applications, such as signal enhancement and source separation. Some of the applications and the necessitated a priori information comprise:

- Dereverberation. By knowing the room geometry, the spatial filter can be used to suppress the energy localized outside the room borders which can be caused by multipath propagation. This application can be of interest, e.g. for hands-free communication in meeting rooms and cars. Note that in order to suppress the late reverberation, it is sufficient to close the filter in case of high diffuseness, whereas to suppress early reflections a position-dependent filter is more effective. In this case, as already mentioned, the geometry of the room needs to be known a-priori.
- Background Noise Suppression. A similar concept can be used to suppress the background noise as well. If the potential regions where sources can be located, (e.g., the participants' chairs in meeting rooms or the seats in a car) are known, then the energy located outside of these regions is associated to background noise and is therefore suppressed by the spatial filter. This application necessitates a priori information or an estimate, based on the available data in the GAC streams, of the approximate location of the sources.
- Suppression of a point-like interferer. If the interferer is clearly localized in space, rather than diffuse, position-based filtering can be applied to attenuate the energy localized at the position of the interferer. It necessitates a priori information or an estimate of the location of the interferer.
- Echo control. In this case the interferers to be suppressed are the loudspeaker signals. For this purpose, similarly as in the case for point-like interferers, the energy localized exactly or at the close neighborhood of the loudspeakers position is suppressed. It necessitates a priori information or an estimate of the loudspeaker positions.
- Enhanced voice detection. The signal enhancement techniques associated with the geometry-based filtering invention can be implemented as a preprocessing step in a conventional voice activity detection system, e.g. in cars. The dereverberation, or noise suppression can be used as add-ons to improve the system performance.
- Surveillance. Preserving only the energy from certain areas and suppressing the rest is a commonly used technique in surveillance applications. It necessitates a priori information on the geometry and location of the area of interest.
- Source Separation. In an environment with multiple simultaneously active sources geometry-based spatial filtering may be applied for source separation. Placing an appropriately designed spatial filter centered at the location of a source, results in suppression/attenuation of the other simultaneously active sources. This innovation may be used e.g. as a front-end in SAOC. A priori information or an estimate of the source locations is necessitated.
- Position-dependent Automatic Gain Control (AGC). Position-dependent weights may be used e.g. to equalize the loudness of different talkers in teleconferencing applications.

In the following, synthesis modules according to embodiments are described. According to an embodiment, a synthesis module may be adapted to generate at least one audio output signal based on at least one pressure value of audio data of an audio data stream and based on at least one position value of the audio data of the audio data stream. The at least one pressure value may be a pressure value of a pressure signal, e.g. an audio signal.

The principles of operation behind the GAC synthesis are motivated by the assumptions on the perception of spatial sound given in

[27] WO2004077884: Tapio Lokki, Juha Merimaa, and Ville Pulkki. Method for reproducing natural or modified spatial impression in multichannel listening, 2006.

In particular, the spatial cues necessitated to correctly perceive the spatial image of a sound scene can be obtained by correctly reproducing one direction of arrival of nondiffuse sound for each time-frequency bin. The synthesis, depicted in FIG. 10*a*, is therefore divided in two stages.

The first stage considers the position and orientation of the listener within the sound scene and determines which of the M IPLS is dominant for each time-frequency bin. Consequently, its pressure signal $P_{dir}$ and direction of arrival $\theta$ can be computed. The remaining sources and diffuse sound are collected in a second pressure signal $P_{diff}$.

The second stage is identical to the second half of the DirAC synthesis described in [27]. The nondiffuse sound is reproduced with a panning mechanism which produces a point-like source, whereas the diffuse sound is reproduced from all loudspeakers after having being decorrelated.

Figure 10A:
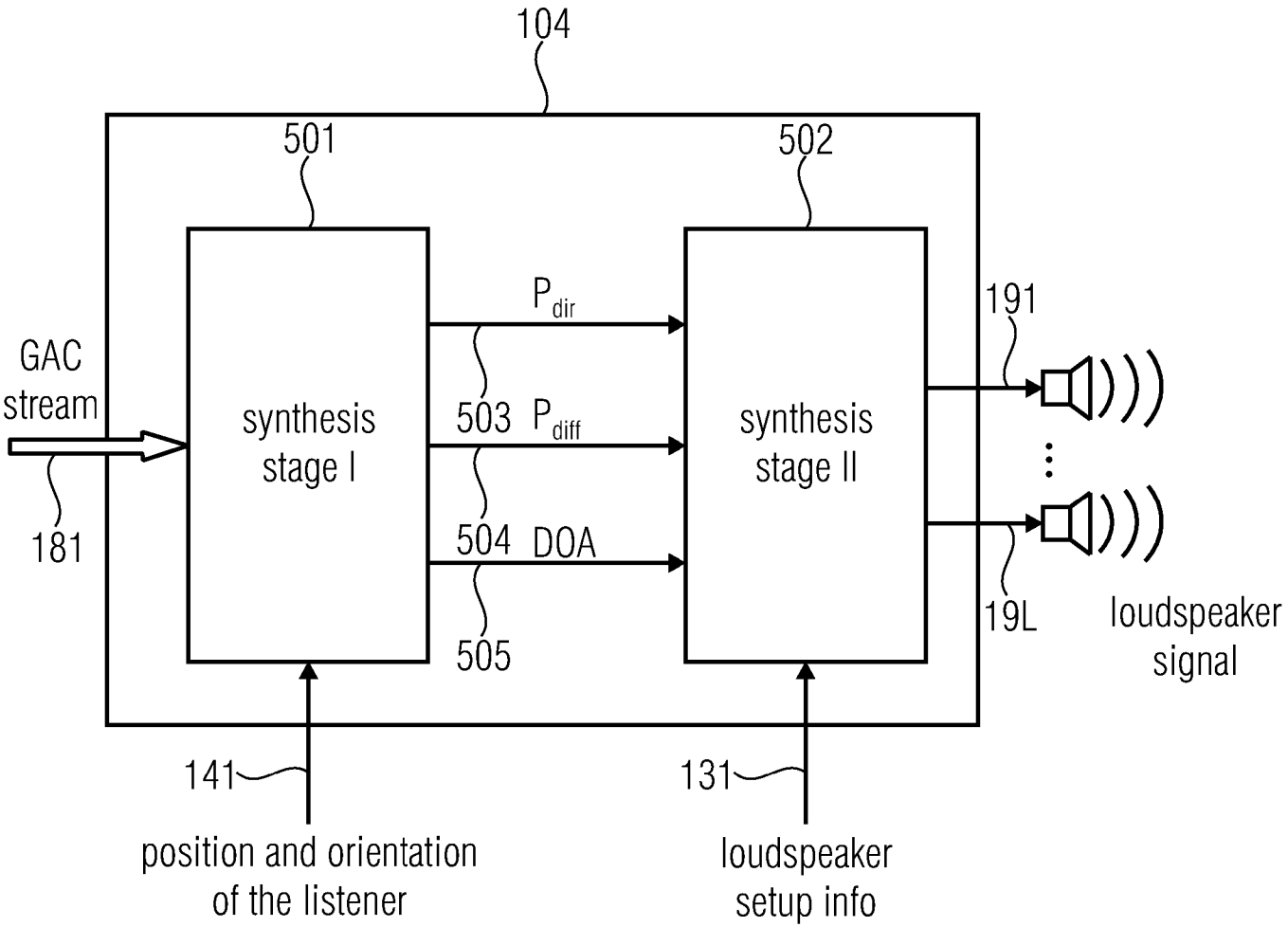
FIG. 10*a* depicts a synthesis module according to an embodiment.

FIG. 10*a* depicts a synthesis module according to an embodiment illustrating the synthesis of the GAC stream.

The first stage synthesis unit 501, computes the pressure signals $P_{dir}$ and $P_{diff}$ which need to be played back differently. In fact, while $P_{dir}$ comprises sound which has to be played back coherently in space, $P_{diff}$ comprises diffuse sound. The third output of first stage synthesis unit 501 is the Direction Of Arrival (DOA) $\theta$ 505 from the point of view of the desired listening position, i.e. a direction of arrival information. Note that the Direction of Arrival (DOA) may be expressed as an azimuthal angle if 2D space, or by an azimuth and elevation angle pair in 3D. Equivalently, a unit norm vector pointed at the DOA may be used. The DOA specifies from which direction (relative to the desired listening position) the signal $P_{dir}$ should come from. The first stage synthesis unit 501 takes the GAC stream as an input, i.e., a parametric representation of the sound field, and computes the aforementioned signals based on the listener position and orientation specified by input 141. In fact, the end user can decide freely the listening position and orientation within the sound scene described by the GAC stream.

The second stage synthesis unit 502 computes the L loudspeaker signals 511 to 51L based on the knowledge of the loudspeaker setup 131. Please recall that unit 502 is identical to the second half of the DirAC synthesis described in [27].

Figure 10B:
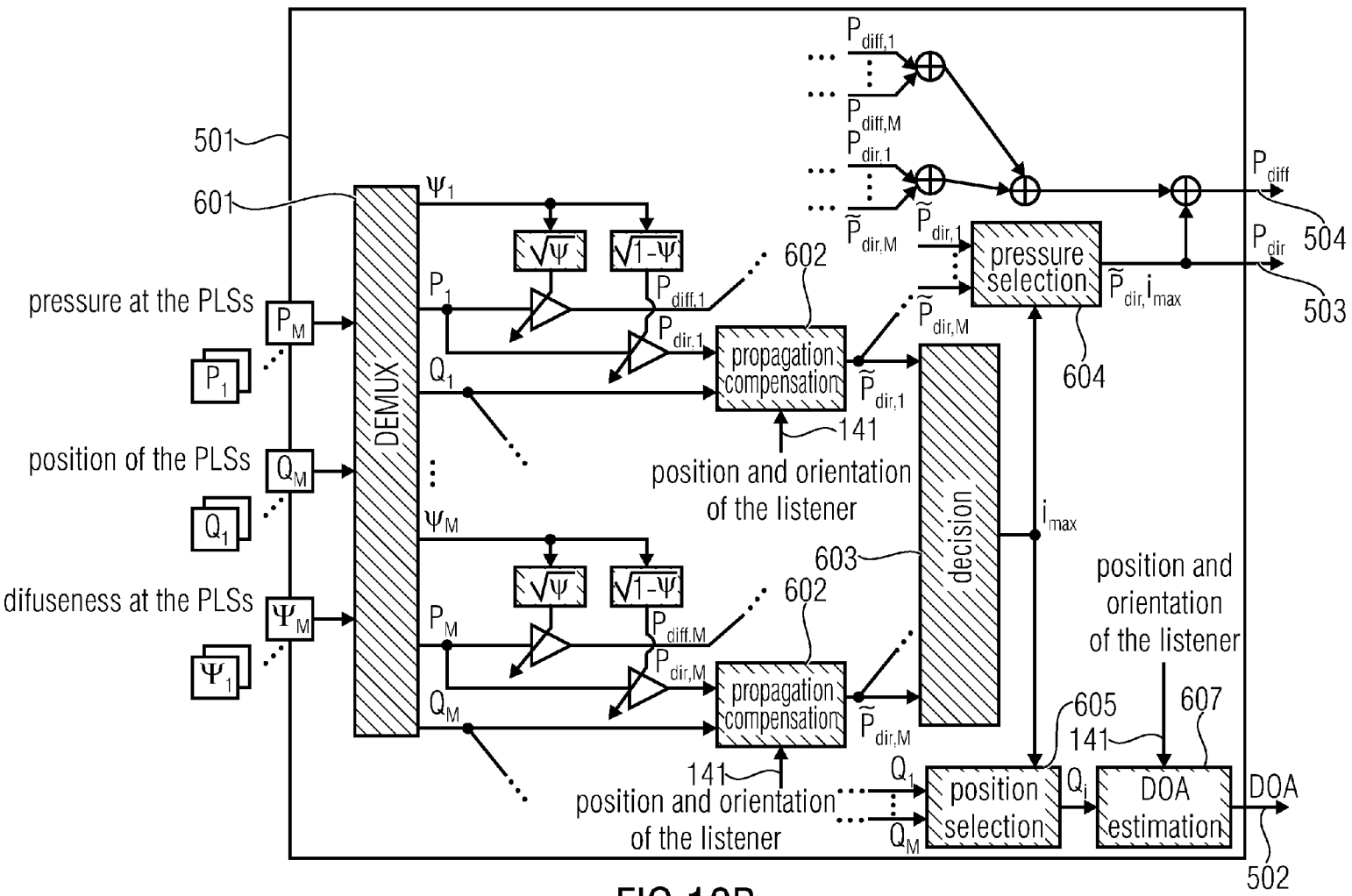
FIG. 10*b* depicts a first synthesis stage unit according to an embodiment.

FIG. 10*b* depicts a first synthesis stage unit according to an embodiment. The input provided to the block is a GAC stream composed of M layers. In a first step, unit 601 demultiplexes the M layers into M parallel GAC stream of one layer each.

The i-th GAC stream comprises a pressure signal $P_i$, a diffuseness $\Psi_i$ and a position vector $Q_i=[X_i, Y_i, Z_i]^T$. The pressure signal $P_i$ comprises one or more pressure values. The position vector is a position value. At least one audio output signal is now generated based on these values.

The pressure signal for direct and diffuse sound $P_{dir,i}$ and $P_{diff,i}$, are obtained from $P_i$ by applying a proper factor derived from the diffuseness $\Psi_i$. The pressure signals comprise direct sound enter a propagation compensation block 602, which computes the delays corresponding to the signal propagation from the sound source position, e.g. the IPLS position, to the position of the listener. In addition to this, the block also computes the gain factors necessitated for compensating the different magnitude decays. In other embodiments, only the different magnitude decays are compensated, while the delays are not compensated.

The compensated pressure signals, denoted by $\tilde{P}_{dir,i}$ enter block 603, which outputs the index $i_{max}$ of the strongest input $$i_{max} = \underset{i}{\operatorname{argmax}} |\tilde{P}_{dir,i}|^2 \tag{3}$$

The main idea behind this mechanism is that of the M IPLS active in the time-frequency bin under study, only the strongest (with respect to the listener position) is going to be played back coherently (i.e., as direct sound). Blocks 604 and 605 select from their inputs the one which is defined by $i_{max}$. Block 607 computes the direction of arrival of the $i_{max}$-th IPLS with respect to the position and orientation of the listener (input 141). The output of block 604 $\tilde{P}_{dir,i_{max}}$ corresponds to the output of block 501, namely the sound signal $P_{dir}$ which will be played back as direct sound by block 502. The diffuse sound, namely output 504 $P_{diff}$, comprises the sum of all diffuse sound in the M branches as well as all direct sound signals $\tilde{P}_{dir,j}$ except for the $i_{max}$-th, namely $\forall j \neq i_{max}$.

Figure 10C:
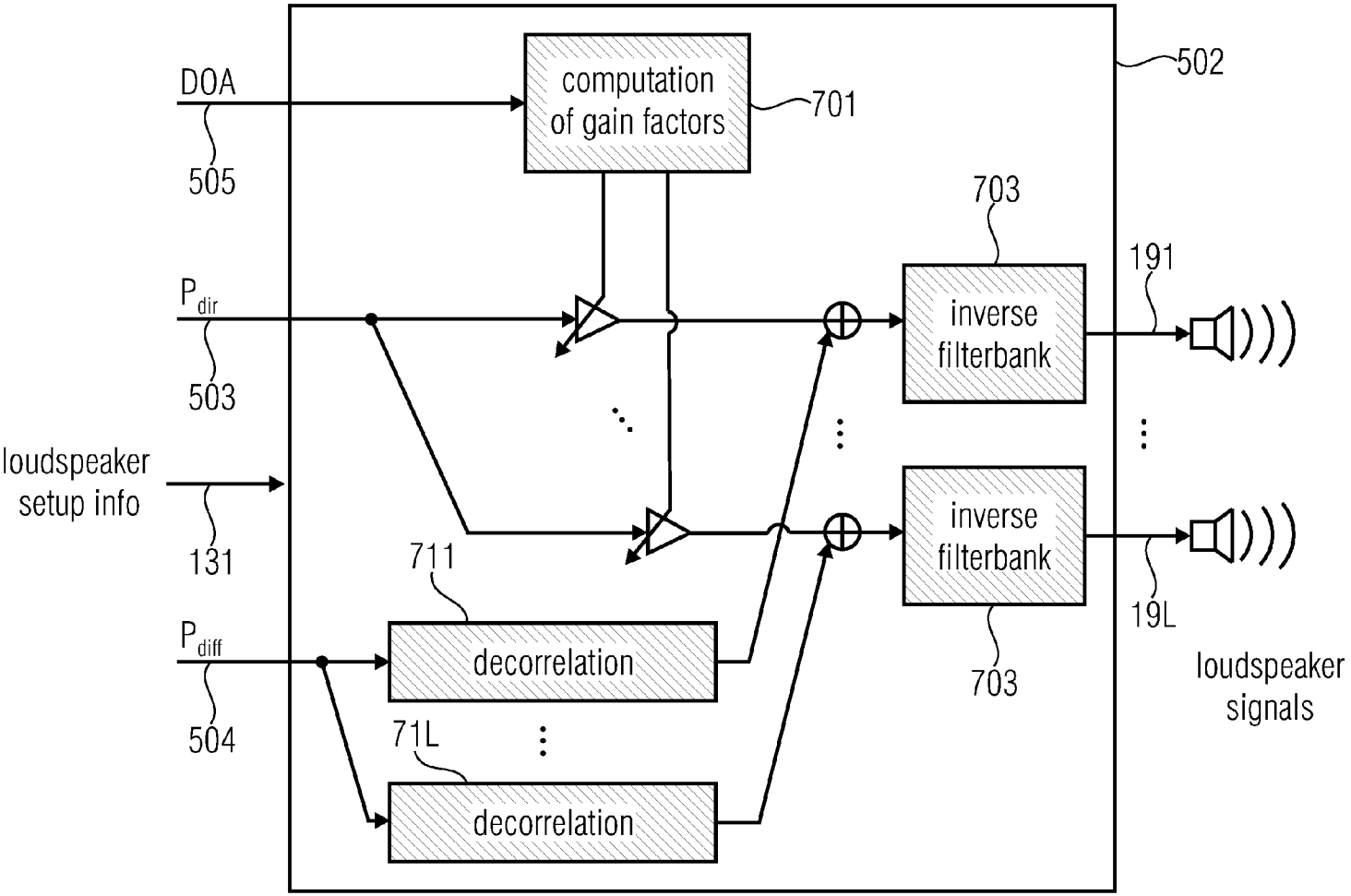
FIG. 10*c* depicts a second synthesis stage unit according to an embodiment.

FIG. 10*c* illustrates a second synthesis stage unit 502. As already mentioned, this stage is identical to the second half of the synthesis module proposed in [27]. The nondiffuse sound $P_{dir}$ 503 is reproduced as a point-like source by e.g. panning, whose gains are computed in block 701 based on the direction of arrival (505). On the other hand, the diffuse sound, $P_{diff}$, goes through L distinct decorrelators (711 to 71L). For each of the L loudspeaker signals, the direct and diffuse sound paths are added before going through the inverse filterbank (703).

Figure 11:
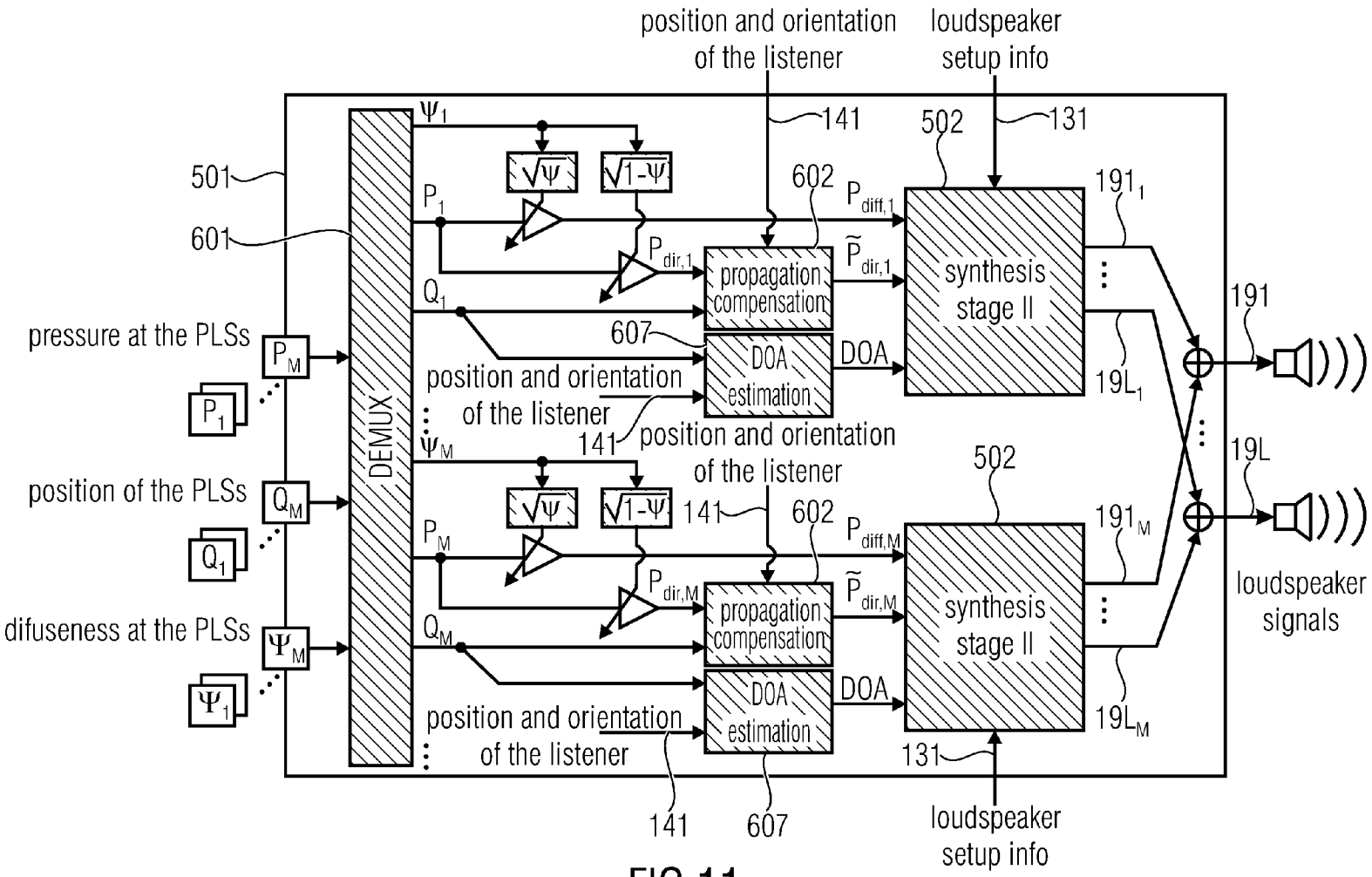
FIG. 11 depicts a synthesis module according to another embodiment.

FIG. 11 illustrates a synthesis module according to an alternative embodiment. All quantities in the figure are considered in time-frequency domain; the (k,n) notation was neglected for reasons of simplicity, e.g. $P_i=P_i(k,n)$. In order to improve the audio quality of the reproduction in case of particularly complex sound scenes, e.g., numerous sources active at the same time, the synthesis module, e.g. synthesis module 104 may, for example, be realized as shown in FIG. 11. Instead of selecting the most dominant IPLS to be reproduced coherently, the synthesis in FIG. 11 carries out a full synthesis of each of the M layers separately. The L loudspeaker signals from the i-th layer are the output of block 502 and are denoted by 191$_i$ to 19$L_i$. The h-th loudspeaker signal 19*h* at the output of the first synthesis stage unit 501 is the sum of 19$h_1$ to 19$h_M$. Please note that differently from FIG. 10*b*, the DOA estimation step in block 607 needs to be carried out for each of the M layers.

Figure 26:
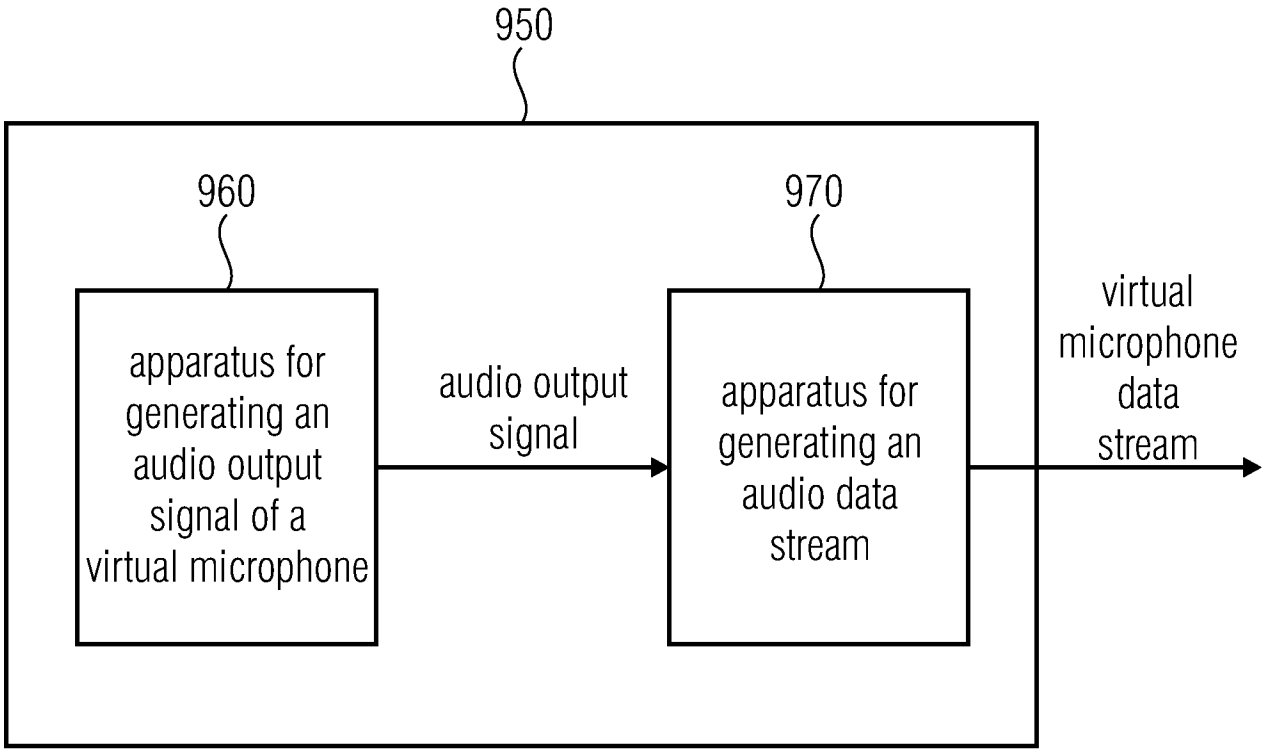
FIG. 26 illustrates an apparatus for generating a virtual microphone data stream according to an embodiment.

FIG. 26 illustrates an apparatus 950 for generating a virtual microphone data stream according to an embodiment. The apparatus 950 for generating a virtual microphone data stream comprises an apparatus 960 for generating an audio output signal of a virtual microphone according to one of the above-described embodiments, e.g. according to FIG. 12, and an apparatus 970 for generating an audio data stream according to one of the above-described embodiments, e.g. according to FIG. 2, wherein the audio data stream generated by the apparatus 970 for generating an audio data stream is the virtual microphone data stream.

The apparatus 960 e.g. in FIG. 26 for generating an audio output signal of a virtual microphone comprises a sound events position estimator and an information computation module as in FIG. 12. The sound events position estimator is adapted to estimate a sound source position indicating a position of a sound source in the environment, wherein the sound events position estimator is adapted to estimate the sound source position based on a first direction information provided by a first real spatial microphone being located at a first real microphone position in the environment, and based on a second direction information provided by a second real spatial microphone being located at a second real microphone position in the environment. The information computation module is adapted to generate the audio output signal based on a recorded audio input signal, based on the first real microphone position and based on the calculated microphone position.

The apparatus 960 for generating an audio output signal of a virtual microphone is arranged to provide the audio output signal to the apparatus 970 for generating an audio data stream. The apparatus 970 for generating an audio data stream comprises a determiner, for example, the determiner 210 described with respect to FIG. 2. The determiner of the apparatus 970 for generating an audio data stream determines the sound source data based on the audio output signal provided by the apparatus 960 for generating an audio output signal of a virtual microphone.

Figure 27:
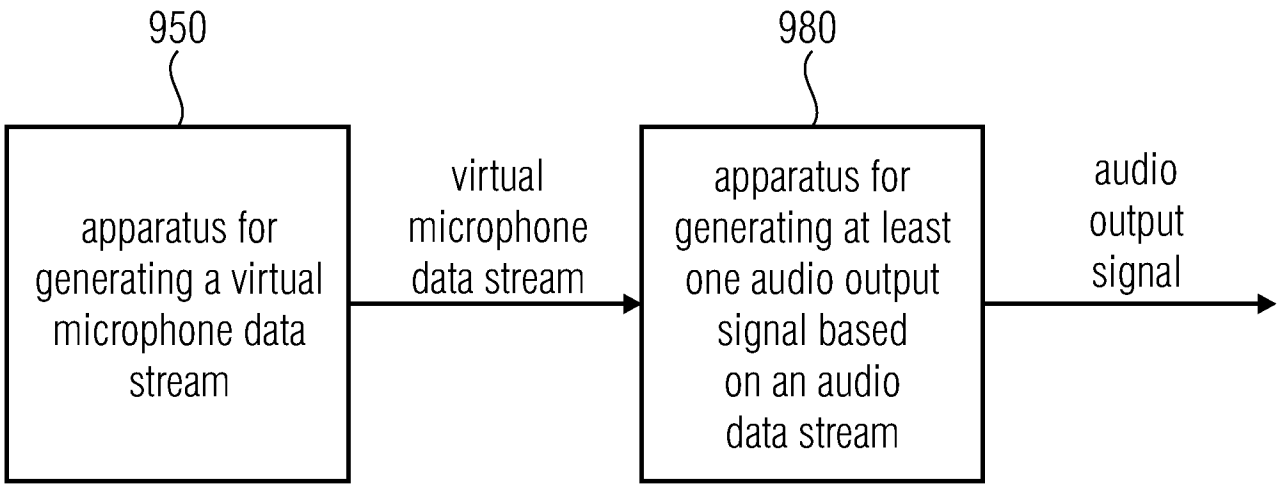
FIG. 27 illustrates an apparatus for generating at least one audio output signal based on an audio data stream according to another embodiment.

FIG. 27 illustrates an apparatus 980 for generating at least one audio output signal based on an audio data stream according to one of the above-described embodiments, e.g. the apparatus of claim 1, being configured to generate the audio output signal based on a virtual microphone data stream as the audio data stream provided by an apparatus 950 for generating a virtual microphone data stream, e.g. the apparatus 950 in FIG. 26.

The apparatus 980 for generating a virtual microphone data stream feeds the generated virtual microphone signal into the apparatus 980 for generating at least one audio output signal based on an audio data stream. It should be noted, that the virtual microphone data stream is an audio data stream. The apparatus 980 for generating at least one audio output signal based on an audio data stream generates an audio output signal based on the virtual microphone data stream as audio data stream, for example, as described with respect to the apparatus of FIG. 1.

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding unit or item or feature of a corresponding apparatus.

The inventive decomposed signal can be stored on a digital storage medium or can be transmitted on a transmission medium such as a wireless transmission medium or a wired transmission medium such as the Internet.

Depending on certain implementation requirements, embodiments of the invention can be implemented in hardware or in software. The implementation can be performed using a digital storage medium, for example a floppy disk, a DVD, a CD, a ROM, a PROM, an EPROM, an EEPROM or a FLASH memory, having electronically readable control signals stored thereon, which cooperate (or are capable of cooperating) with a programmable computer system such that the respective method is performed.

Some embodiments according to the invention comprise a non-transitory data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may for example be stored on a machine readable carrier.

Other embodiments comprise the computer program for performing one of the methods described herein, stored on a machine readable carrier.

In other words, an embodiment of the inventive method is, therefore, a computer program having a program code for performing one of the methods described herein, when the computer program runs on a computer.

A further embodiment of the inventive methods is, therefore, a data carrier (or a digital storage medium, or a computer-readable medium) comprising, recorded thereon, the computer program for performing one of the methods described herein.

A further embodiment of the inventive method is, therefore, a data stream or a sequence of signals representing the computer program for performing one of the methods described herein. The data stream or the sequence of signals may for example be configured to be transferred via a data communication connection, for example via the Internet.

A further embodiment comprises a processing means, for example a computer, or a programmable logic device, configured to or adapted to perform one of the methods described herein.

A further embodiment comprises a computer having installed thereon the computer program for performing one of the methods described herein.

In some embodiments, a programmable logic device (for example a field programmable gate array) may be used to perform some or all of the functionalities of the methods described herein. In some embodiments, a field programmable gate array may cooperate with a microprocessor in order to perform one of the methods described herein. Generally, the methods may be performed by any hardware apparatus.

While this invention has been described in terms of several embodiments, there are alterations, permutations, and equivalents which will be apparent to others skilled in the art and which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

LITERATURE

[1] Michael A. Gerzon. Ambisonics in multichannel broadcasting and video. J. Audio Eng. Soc, 33(11):859-871, 1985.

[2] V. Pulkki, "Directional audio coding in spatial sound reproduction and stereo upmixing," in Proceedings of the AES 28$^{th}$ International Conference, pp. 251-258, Pita Sweden, Jun. 30-Jul. 2, 2006.

[3] V. Pulkki, "Spatial sound reproduction with directional audio coding," J. Audio Eng. Soc., vol. 55, no. 6, pp. 503-516. June 2007.

[4] C. Faller: "Microphone Front-Ends for Spatial Audio Coders", in Proceedings of the AES 125$^{th}$ international Convention, San Francisco, October 2008.

[5] M. Kallinger, H. Ochsenfeld, G. Del Galdo, F. Küch, D. Mahne, R. Schultz-Amling, and O. Thiergart, "A spatial filleting approach for directional audio coding," in Audio Engineering Society Convention 126, Munich, Germany, May 2009.

[6] R. Schultz-Amling, F. Hüch, O. Thiergart, and M. Kallinger, "Acoustical zooming based on a parametric sound field representation," in Audio Engineering Society Convention 128, London UK, May 2010.

[7] J. Herre, C. Falch, D. Mahne, G. Del Galdo, M. Kallinger, and O. Thiergart, "Interactive teleconferencing combining spatial audio Object coding and DirAC technology," in Audio Engineering Society Convention 128, London UK, May 2010.

[8] G. Williams, Fourier Acoustics: Sound Radiation and Nearfield Acoustical Holography. Academic Press, 1999.

[9] A. Kuntz and R. Rabenstein, "Limitations in the extrapolation of wave fields from circular measurements," in 15th European Signal Processing Conference (EUSIPCO 2007), 2007.

[10] A. Walther and C. Faller, "Linear simulation of spaced microphone arrays using b-format recordings," in Audio Engineering Society Convention 128, London UK, May 2010.

[11] U.S. 61/287,596: An Apparatus and a Method for Converting a First Parametric Spatial Audio Signal into a Second Parametric Spatial Audio Signal.

[12] S. Rickard and Z. Yilmaz, "On the approximate W-disjoint orthogonality of speech," in Acoustics, Speech and Signal Processing, 2002, ICASSP 2002 IEEE International Conference on, April 2002, vol. 1.

[13] R. Roy, A. Paulraj, and T. Kailath, "Direction-of-arrival estimation by subspace rotation methods—ESPRIT," in IEEE International Conference on Acoustics, Speech, and Signal Processing (ICASSP), Stanford, Calif., USA, April 1986.

[14] R. Schmidt, "Multiple emitter location and signal parameter estimation," IEEE Transactions on Antennas and Propagation, vol. 34, no. 3, pp. 276-280, 1986.

[15] J. Michael Steele, "Optimal Triangulation of Random Samples in the Plane", The Annals of Probability, Vol. 10, No. 3 (August, 1982), pp. 548-553.

[16] F. J. Fahy, Sound Intensity, Essex; Elsevier Science Publishers Ltd., 1989,

[17] R. Schultz-Amling, F. Küch, M. Kallinger, G. Del Galdo, T. Ahonen and V. Pulkki, "Planar microphone array processing for the analysis and reproduction of spatial audio using directional audio coding," in Audio Engineering Society Convention 124, Amsterdam, The Netherlands, May 2008.

[18] M. Kallinger, F. Küch, R. Schultz-Amling, G. Del Galdo, T. Ahonen and V. Pulkki, "Enhanced direction estimation using microphone arrays for directional audio coding;" in Hands-Free Speech Communication and Microphone Arrays, 2008 HSCMA 2008, May 2008, pp. 45-48.

[19] R. K. Furness, "Ambisonics—An overview," in AES 8th International Conference, April 1990, pp. 181-189.

[20] Giovanni Del Galdo, Oliver Thiergart, TobiasWeller, and E. A. P. Habets. Generating virtual microphone signals using geometrical information gathered by distributed arrays. In Third Joint Workshop on Hands-free Speech Communication and Microphone Arrays (HSCMA '11), Edinburgh, United Kingdom, May 2011.

[21] J. Herre, K. Kjörling, J. Breebaart, C. Faller, S. Disch, H. Purnhagen, J. Koppens, J. Hilpert, J. Roden, W. Oomen, K. Linzmeier, K. S. Chong: "MPEG Surround—The ISO/MPEG Standard for Efficient and Compatible Multichannel Audio Coding", 122nd AES Convention, Vienna, Austria, 2007, Preprint 7084.

[22] Ville Pulkki. Spatial sound reproduction with directional audio coding. J. Audio Eng. Soc, 55(6):503-516, June 2007.

[23] C. Faller. Microphone front-ends for spatial audio coders. In Proc. of the AES 125th International Convention, San Francisco, October 2008.

[24] Emmanuel Gallo and Nicolas Tsingos. Extracting and re-rendering structured auditory scenes from field recordings. In AES 30th International Conference on Intelligent Audio Environments, 2007.

[25] Jeroen Breebaart, Jonas Engdegård, Cornelia Falch, Oliver Hellmuth, Johannes Hilpert, Andreas Hoelzer, Jeroens Koppens, Werner Oomen, Barbara Resch, Erik Schuijers, and Leonid Terentiev. Spatial audio object coding (saoc)—the upcoming mpeg standard on parametric object based audio coding. In Audio Engineering Society Convention 124, 5 2008.

[26] R. Roy and T. Kailath. ESPRIT-estimation of signal parameters via rotational invariance techniques. Acoustics, Speech and Signal Processing, IEEE Transactions on, 37(7):984-995, July 1989.

[27] WO2004077884: Tapio Lokki, Juha Merimaa, and Ville Pulkki. Method for reproducing natural or modified spatial impression in multichannel listening, 2006.

[28] Svein Berge. Device and method for converting spatial audio signal. U.S. patent application Ser. No. 10/547,151.

The invention claimed is:

1. An apparatus for generating at least two audio output signals based on an audio data stream comprising audio data relating to two or more sound sources, wherein the apparatus comprises:

a receiver for receiving the audio data stream comprising the audio data, wherein the audio data comprises for each one of the two or more sound sources one or more sound pressure values, wherein the audio data furthermore comprises for each one of the two or more sound sources one or more position values indicating a position of one of the two or more sound sources, wherein each one of the one or more position values comprises at least two coordinate values, and wherein the audio data furthermore comprises one or more diffuseness-of-sound values for each one of the two or more sound sources; and a synthesis module for generating the at least two audio output signals based on the one or more sound pressure values of each one of the two or more sound sources, based on the one or more position values of each one of the two or more sound sources and based on the one or more diffuseness-of-sound values of each one of the two or more sound sources, wherein the synthesis module comprises a first stage synthesis unit for generating a direct sound pressure signal comprising direct sound, a diffuse sound pressure signal comprising diffuse sound and direction of arrival information based on the sound pressure values of the two or more sound sources of the audio data of the audio data stream, based on the position values of the two or more sound sources of the audio data of the audio data stream and based on the diffuseness-of-sound values of the two or more sound sources of the audio data of the audio data stream, and wherein the synthesis module comprises a second stage synthesis unit for generating the at least two audio output signals based on the direct sound pressure signal, the diffuse sound pressure signal and the direction of arrival information, wherein the direct sound pressure signal comprises the compensated direct sound pressure value of that one of the two or more sound sources that has an index $i_{max}$, with $$i_{max} = \underset{i}{\operatorname{argmax}} |\tilde{P}_{dir,i}|^2$$

wherein $\tilde{P}_{dir,i}$ is the compensated direct sound pressure value of an i-th sound source of the two or more sound sources, and wherein the diffuse sound pressure signal depends on all diffuse pressure values of the two or more sound sources and of all compensated direct sound pressure values of the two or more sound sources except the compensated direct sound pressure value of the $i_{max}$-th sound source.

2. The apparatus according to claim 1, wherein the audio data is defined in a time-frequency domain.

3. The apparatus according to claim 1, wherein the receiver furthermore comprises a modification module for modifying the audio data of the received audio data stream by modifying at least one of the one or more sound pressure values of the two or more sound sources of the audio data, or by modifying at least one of the one or more position values of the two or more sound sources of the audio data, or by modifying at least one of the one or more diffuseness-of-sound values of the two or more sound sources of the audio data, and wherein the synthesis module is adapted to generate the at least one audio output signal based on the at least one sound pressure value that has been modified or based on the at least one position value that has been modified or based on the at least one diffuseness-of-sound value that has been modified.

4. The apparatus according to claim 3, wherein each one of the position values of each one of the two or more sound sources comprises at least two coordinate values, and wherein the modification module is adapted to modify the coordinate values by adding at least one random number to the coordinate values, when the coordinate values indicate that a sound source is located at a position within a predefined area of an environment.

5. The apparatus according to claim 3, wherein each one of the position values of each one of the two or more sound sources comprise at least two coordinate values, and wherein the modification module is adapted to modify the coordinate values by applying a deterministic function on the coordinate values, when the coordinate values indicate that a sound source is located at a position within a predefined area of an environment.

6. The apparatus according to claim 3, wherein each one of the position values of each one of the two or more sound sources comprise at least two coordinate values, and wherein the modification module is adapted to modify a selected sound pressure value of the one or more sound pressure values of the two or more sound sources of the audio data, the selected sound pressure value relating to the same sound source as the coordinate values, when the coordinate values indicate that a sound source is located at a position within a predefined area of an environment.

7. The apparatus according to claim 6, wherein the modification module is adapted to modify the selected sound pressure value of the one or more sound pressure values of the two or more sound sources of the audio data based on one of the one or more diffuseness-of-sound values, when the coordinate values indicate that the sound source is located at the position within the predefined area of an environment.

8. The apparatus according to claim 1, being configured to generate the audio output signal based on a virtual microphone data stream as the audio data stream provided by an apparatus for generating a virtual microphone data stream, comprising: an apparatus for generating an audio output signal of a virtual microphone; and an apparatus for generating an audio data stream as the virtual microphone data stream, wherein the audio data stream comprises audio data, wherein the audio data comprises for each one of the one or more sound sources one or more position values indicating a sound source position, wherein each one of the one or more position values comprises at least two coordinate values, wherein the apparatus for generating an audio data stream comprises: a determiner for determining the sound source data based on at least one audio input signal recorded by at least one microphone and based on audio side information provided by at least two spatial microphones, the audio side information being spatial side information describing spatial sound; and a data stream generator for generating the audio data stream such that the audio data stream comprises the sound source data; wherein each one of the at least two spatial microphones is an apparatus for the acquisition of spatial sound capable of retrieving direction of arrival of sound, and wherein the sound source data comprises one or more sound pressure values for each one of the sound sources, wherein the sound source data furthermore comprises one or more position values indicating a sound source position for each one of the sound sources; and wherein the apparatus for generating an audio output signal of a virtual microphone comprises: a sound events position estimator for estimating a sound source position indicating a position of a sound source in the environment, wherein the sound events position estimator is adapted to estimate the sound source position based on a first direction of arrival of sound emitted by a first real spatial microphone being located at a first real microphone position in the environment, and based on a second direction of arrival of sound emitted by a second real spatial microphone being located at a second real microphone position in the environment; and an information computation module for generating the audio output signal based on a recorded audio input signal being recorded by the first real spatial microphone, based on the first real microphone position and based on a virtual position of the virtual microphone, wherein the first real spatial microphone and the second real spatial microphone are apparatuses for the acquisition of spatial sound capable of retrieving direction of arrival of sound, and wherein the apparatus for generating an audio output signal of a virtual microphone is arranged to provide the audio output signal to the apparatus for generating an audio data stream, and wherein the determiner of the apparatus for generating an audio data stream determines the sound source data based on the audio output signal provided by the apparatus for generating an audio output signal of a virtual microphone, the audio output signal being one of the at least one audio input signal of said apparatus for generating an audio data stream.

9. A system, comprising:

an apparatus for generating at least two audio output signals based on an audio data stream comprising audio data relating to two or more sound sources, and an apparatus for generating an audio data stream comprising sound source data relating to two or more sound sources, wherein the apparatus for generating the at least two audio output signals comprises:

a receiver for receiving the audio data stream comprising the audio data, wherein the audio data comprises for each one of the two or more sound sources one or more sound pressure values, wherein the audio data furthermore comprises for each one of the two or more sound sources one or more position values indicating a position of one of the two or more sound sources, wherein each one of the one or more position values comprises at least two coordinate values, and wherein the audio data furthermore comprises one or more diffuseness-of-sound values for each one of the two or more sound sources; and a synthesis module for generating the at least two audio output signals based on the one or more sound pressure values of each one of the two or more sound sources, based on the one or more position values of each one of the two or more sound sources and based on the one or more diffuseness-of-sound values of each one of the two or more sound sources, wherein the synthesis module comprises a first stage synthesis unit for generating a direct sound pressure signal comprising direct sound, a diffuse sound pressure signal comprising diffuse sound and direction of arrival information based on the sound pressure values of the two or more sound sources of the audio data of the audio data stream, based on the position values of the two or more sound sources of the audio data of the audio data stream and based on the diffuseness-of-sound values of the two or more sound sources of the audio data of the audio data stream, and wherein the synthesis module comprises a second stage synthesis unit for generating the at least two audio output signals based on the direct sound pressure signal, the diffuse sound pressure signal and the direction of arrival information, wherein the direct sound pressure signal comprises the compensated direct sound pressure value of that one of the two or more sound sources that has an index $i_{max}$, with $$i_{max} = \underset{i}{\operatorname{argmax}} |\tilde{P}_{dir,i}|^2$$

wherein $\tilde{P}_{dir,i}$ is the compensated direct sound pressure value of an i-th sound source of the two or more sound sources, and wherein the diffuse sound pressure signal depends on all diffuse pressure values of the two or more sound sources and of all compensated direct sound pressure values of the two or more sound sources except the compensated direct sound pressure value of the $i_{max}$-th sound source; and wherein the apparatus for generating an audio data stream comprises:

a determiner for determining the sound source data based on at least one audio input signal recorded by at least one microphone and based on audio side information provided by at least two spatial microphones, the audio side information being spatial side information describing spatial sound; and a data stream generator for generating the audio data stream such that the audio data stream comprises the sound source data; wherein each one of the at least two spatial microphones is an apparatus for the acquisition of spatial sound capable of retrieving direction of arrival of sound, and wherein the sound source data comprises one or more sound pressure values for each one of the two or more sound sources, wherein the sound source data furthermore comprises one or more position values indicating a sound source position for each one of the two or more sound sources, and wherein the sound source data furthermore comprises one or more diffuseness-of-sound values for each one of the two or more sound sources.

10. A method for generating at least two audio output signals based on an audio data stream comprising audio data relating to two or more sound sources, wherein the method comprises:

receiving the audio data stream comprising the audio data, wherein the audio data comprises for each one of the two or more sound sources one or more sound pressure values, wherein the audio data furthermore comprises for each one of the two or more sound sources one or more position values indicating a position of one of the two or more sound sources, wherein each one of the one or more position values comprises at least two coordinate values, and wherein the audio data furthermore comprises one or more diffuseness-of-sound values for each one of the two or more sound sources; and generating the at least two audio output signals based on the sound pressure value of each one of the two or more sound sources, based on the position value of each one of the two or more sound sources and based on the diffuseness-of-sound value of each one of the two or more sound sources, wherein generating the at least two audio output signals comprises generating a direct sound pressure signal comprising direct sound, a diffuse sound pressure signal comprising diffuse sound and direction of arrival information based on the sound pressure values of the two or more sound sources of the audio data of the audio data stream, based on position values of the two or more sound sources of the audio data of the audio data stream and based on the diffuseness-of-sound values of the two or more sound sources of the audio data of the audio data stream, and wherein generating the at least two audio output signals comprises generating the at least two audio output signals based on the direct sound pressure signal, the diffuse sound pressure signal and the direction of arrival information, wherein the direct sound pressure signal comprises the compensated direct sound pressure value of that one of the two or more sound sources that has an index $i_{max}$, with $$i_{max} = \underset{i}{\operatorname{argmax}} |\tilde{P}_{dir,i}|^2$$

wherein $\tilde{P}_{dir,i}$ is the compensated direct sound pressure value of an i-th sound source of the two or more sound sources, and wherein the diffuse sound pressure signal depends on all diffuse pressure values of the two or more sound sources and of all compensated direct sound pressure values of the two or more sound sources except the compensated direct sound pressure value of the $i_{max}$-th sound source.

11. A non-transitory computer-readable medium comprising a computer program for implementing a method for generating at least two audio output signals based on an audio data stream comprising audio data relating to two or more sound sources, wherein the method comprises:

receiving the audio data stream comprising the audio data, wherein the audio data comprises for each one of the two or more sound sources one or more sound pressure values, wherein the audio data furthermore comprises for each one of the two or more sound sources one or more position values indicating a position of one of the two or more sound sources, wherein each one of the one or more position values comprises at least two coordinate values, and wherein the audio data furthermore comprises one or more diffuseness-of-sound values for each one of the two or more sound sources; and generating the at least two audio output signals based on the sound pressure value of each one of the two or more sound sources, based on the position value of each one of the two or more sound sources and based on the diffuseness-of-sound value of each one of the two or more sound sources, wherein generating the at least two audio output signals comprises generating a direct sound pressure signal comprising direct sound, a diffuse sound pressure signal comprising diffuse sound and direction of arrival information based on the sound pressure values of the two or more sound sources of the audio data of the audio data stream, based on the position values of the two or more sound sources of the audio data of the audio data stream and based on the diffuseness-of-sound values of the two or more sound sources of the audio data of the audio data stream, and wherein generating the at least two audio output signals comprises generating the at least two audio output signals based on the direct sound pressure signal, the diffuse sound pressure signal and the direction of arrival information, wherein the direct sound pressure signal comprises the compensated direct sound pressure value of that one of the two or more sound sources that has an index $i_{max}$, with $$i_{max} = \underset{i}{\operatorname{argmax}} |\tilde{P}_{dir,i}|^2$$

wherein $\tilde{P}_{dir,i}$ is the compensated direct sound pressure value of an i-th sound source of the two or more sound sources, and wherein the diffuse sound pressure signal depends on all diffuse pressure values of the two or more sound sources and of all compensated direct sound pressure values of the two or more sound sources except the compensated direct sound pressure value of the $i_{max}$-th sound source.

12. The system according to claim 9, wherein the sound source data is defined in a time-frequency domain.

13. The system according to claim 9, wherein the determiner of the apparatus for generating the audio data stream is adapted to determine the one or more diffuseness-of-sound values of the sound source data based on diffuseness-of-sound information relating to at least one spatial microphone of the at least two spatial microphones, the diffuseness-of-sound information indicating a diffuseness of sound at at least one of the at least two spatial microphones.

14. The system according to claim 13, wherein the apparatus for generating the audio data stream furthermore comprises a modification module for modifying the audio data stream generated by the data stream generator by modifying at least one of the sound pressure values of the two or more sound sources of the audio data, at least one of the position values of the two or more sound sources of the audio data or at least one of the diffuseness-of-sound values of the two or more sound sources of the audio data relating to at least one of the sound sources.

15. The system according to claim 14, wherein each one of the position values of each one of the sound sources comprise at least two coordinate values, and wherein the modification module of the apparatus for generating the audio data stream is adapted to modify the coordinate values by adding at least one random number to the coordinate values or by applying a deterministic function on the coordinate values, when the coordinate values indicate that a sound source is located at a position within a predefined area of an environment.

16. The system according to claim 14, wherein each one of the position values of each one of the sound sources comprise at least two coordinate values, and, when the coordinate values of one of the sound sources indicate that said sound source is located at a position within a predefined area of an environment, the modification module of the apparatus for generating the audio data stream is adapted to modify a selected sound pressure value of said sound source of the audio data.

17. The system according to claim 14, wherein the modification module of the apparatus for generating the audio data stream is adapted to modify the coordinate values by applying a deterministic function on the coordinate values, when the coordinate values indicate that a sound source is located at a position within a predefined area of an environment.

* * * * *